US007363753B2

(12) United States Patent
Gates et al.

(10) Patent No.: US 7,363,753 B2
(45) Date of Patent: Apr. 29, 2008

(54) METHOD FOR REMOVING A POUCH FROM A PLURALITY OF POUCHES INCLUDING BENDING AND PULLING OF THE POUCH

(75) Inventors: Anthony H. Gates, Alliance, OH (US); Scott E. Gates, Atwater, OH (US)

(73) Assignee: Gates Automation, Inc., Alliance, OH (US)

( * ) Notice: Subject to any disclaimer, the term of this patent is extended or adjusted under 35 U.S.C. 154(b) by 0 days.

(21) Appl. No.: 11/335,338

(22) Filed: Jan. 19, 2006

(65) Prior Publication Data

US 2006/0162291 A1 Jul. 27, 2006

Related U.S. Application Data

(60) Provisional application No. 60/646,910, filed on Jan. 25, 2005, provisional application No. 60/646,213, filed on Jan. 22, 2005.

(51) Int. Cl.
*B65B 43/18* (2006.01)

(52) U.S. Cl. ..... 53/459; 53/469; 53/571; 53/284.7; 53/384.1; 53/386.1

(58) Field of Classification Search ..... 53/459, 53/571, 386.1, 384.1; 221/210, 211; 271/106; *B65B 43/18*

See application file for complete search history.

(56) References Cited

U.S. PATENT DOCUMENTS 2,097,449 A * 11/1937 Cundall et al. ..... 53/284.7
2,332,187 A * 10/1943 Allen ..... 53/571
2,763,458 A * 9/1956 Kindseth ..... 53/284.7
2,952,954 A * 9/1960 Perrin ..... 53/459
3,213,588 A * 10/1965 Peterson ..... 141/10
3,294,616 A * 12/1966 Linsley et al. ..... 53/375.5
3,673,759 A * 7/1972 Ayres et al. ..... 53/459
3,691,715 A * 9/1972 Kelly et al. ..... 53/459
4,168,772 A * 9/1979 Eberle ..... 198/418.3
4,320,615 A * 3/1982 Gmur ..... 53/67
4,345,629 A * 8/1982 Inglett, Jr. ..... 141/114
4,545,184 A * 10/1985 Akiyama ..... 53/571
5,056,300 A * 10/1991 Suzuki et al. ..... 53/572
5,061,146 A * 10/1991 Nelson ..... 414/412
5,070,674 A 12/1991 Lerner
5,077,958 A 1/1992 Peppard
5,259,172 A 11/1993 Peppard (Continued)

FOREIGN PATENT DOCUMENTS

GB 2247879 A * 3/1992

(Continued)

*Primary Examiner*—Stephen F. Gerrity
(74) *Attorney, Agent, or Firm*—Zollinger & Bueleson Ltd.

(57) ABSTRACT

A method and apparatus for removing the first pouch from a stack of pouches includes apparatus adapted to bend an edge of the first pouch away from the second pouch of a stack to define a bent edge and a bend in the first pouch. The first pouch is then slid away from the second pouch to remove the first pouch from the plurality of adjacent pouches. This method allows the first pouch to be reliably separated from the second pouch by overcoming the various forces that typically cause adjacent pouches to cling to each other while stacked together.

15 Claims, 80 Drawing Sheets

U.S. PATENT DOCUMENTS

| | | | | |
|---|---|---|---|---|
| 5,265,402 | A | | 11/1993 | Lerner |
| 5,346,200 | A | * | 9/1994 | Sarvik et al. ..... 271/102 |
| 5,394,674 | A | | 3/1995 | Peppard |
| 5,417,039 | A | * | 5/1995 | Hansson et al. ..... 53/469 |
| 5,619,839 | A | | 4/1997 | Peppard |
| 5,626,004 | A | | 5/1997 | Gates |
| 6,189,293 | B1 | * | 2/2001 | Kraft et al. ..... 53/284.7 |
| 6,550,226 | B1 | | 4/2003 | Gates |
| 6,662,532 | B1 | | 12/2003 | Droog |
| 6,742,321 | B2 | | 6/2004 | Gates |
| 6,779,922 | B2 | | 8/2004 | Gates |
| 2004/0103619 | A1 | | 6/2004 | Droog |
| 2004/0168412 | A1 | | 9/2004 | Greening |

FOREIGN PATENT DOCUMENTS

| | | | | |
|---|---|---|---|---|
| JP | 3-176338 | A | * | 7/1991 |
| JP | 3-288737 | A | * | 12/1991 |
| JP | 7-277307 | A | * | 10/1995 |
| JP | 2001-171616 | A | * | 6/2001 |
| JP | 2001-253411 | A | * | 9/2001 |

* cited by examiner

METHOD FOR REMOVING A POUCH FROM A PLURALITY OF POUCHES INCLUDING BENDING AND PULLING OF THE POUCH

CROSS REFERENCE TO RELATED APPLICATIONS

This application claims priority from U.S. Provisional Patent Application Ser. No. 60/646,910 filed Jan. 25, 2005, and U.S. Provisional Patent Application Ser. No. 60/646,213 filed Jan. 22, 2005; the disclosures of which are incorporated herein by reference.

BACKGROUND OF THE INVENTION

1. Technical Field

The present invention generally relates to methods and apparatus for handling pouches and, more particularly, to methods and apparatus for presenting empty pouches to be filled. Specifically, the present invention relates to a method and apparatus for reliably removing a single pouch from a stack of pouches.

2. Background Information

A wide variety of pouch handling apparatus are known in the art for performing different actions on empty, unsealed pouches. One class of these apparatus load empty, unsealed pouches into a filling a station, fill the pouches with product, and then seal the pouches. Loading empty, unsealed pouches into the pouch handling apparatus is a problem common to most apparatus. One solution is to require the pouches to be individually loaded by a worker. Although accurate, this method is expensive due to the cost of the worker and the lower throughput of the apparatus. Other apparatus receive empty pouches on pouch wickets. Wicketed pouches may be individually removed from the wicket by partially opening the front pouch and pulling the pouch from the wicket with grippers that pinch the sides or top of the pouch. Drawbacks with wicketed pouches include the cost of providing the pouches on the wicket and the waste generated when the flange having the wicket holes is discarded after the pouch is sealed. Pouch handling apparatus that avoid the waste of wicket flanges include those that receive empty, unsealed pouches in simple stacks held in a pouch magazine. Although these pouches are easy to provide and easy to load, those skilled in the art have been challenged by making reliable automated pouch removable mechanisms. Stacked pouches have a tendency to cling to one another (static electricity forces and/or intermolecular attractions) thus requiring mechanisms that overcome the problem of grabbing a single pouch instead of a plurality of pouches. Various prior art solutions exist for this problem. Although most are suitable for their intended purpose, room for improvement remains in the art.

Another problem with stacked pouches is the limited number of zipper pouches that can be stacked. The zippers substantially increase the thickness of one end of the pouch causing the stack of pouches to be wedge shaped. The wedge limits the total number of pouches that may be stacked. When these pouches are processed, a worker must continually load small wedges of pouches into the pouch magazine while the apparatus is running. Those who use these pouch apparatus thus desire a pouch magazine that can hold an increase number of pouch wedges.

BRIEF SUMMARY OF THE INVENTION

In one embodiment, the invention provides a method and apparatus for removing a single pouch from a plurality of adjacent pouches by bending an edge of the pouch away from the next adjacent pouch and sliding the pouch away from the plurality of adjacent pouches. In one configuration, the apparatus includes a magazine that holds the plurality of adjacent pouches and a pouch separator adapted to remove a single pouch at a time.

In another embodiment, the invention provides a method and apparatus for tensioning the pouch as it is removed from the plurality of adjacent pouches.

In another embodiment, the invention provides a method and apparatus that removes and positions the next successive pouch while the previous pouch is being loaded in order to increase pouch throughput while maintaining the compact overall dimensions for the apparatus.

In another embodiment, the invention provides a magazine for a plurality of adjacent pouches wherein the magazine automatically refills itself at least once.

In another embodiment, a method and apparatus are disclosed for readily setting up the apparatus for pouches of differing sizes.

One aspect of the invention is that each pouch is retained by at least two holding devices at different locations through the method and apparatus to maintain control over the position of the pouch and to reduce lost pouches.

These invention embodiments may be used individually or in combination to provide methods and apparatus.

DISCLOSURE OF THE INVENTION

Figure 43:
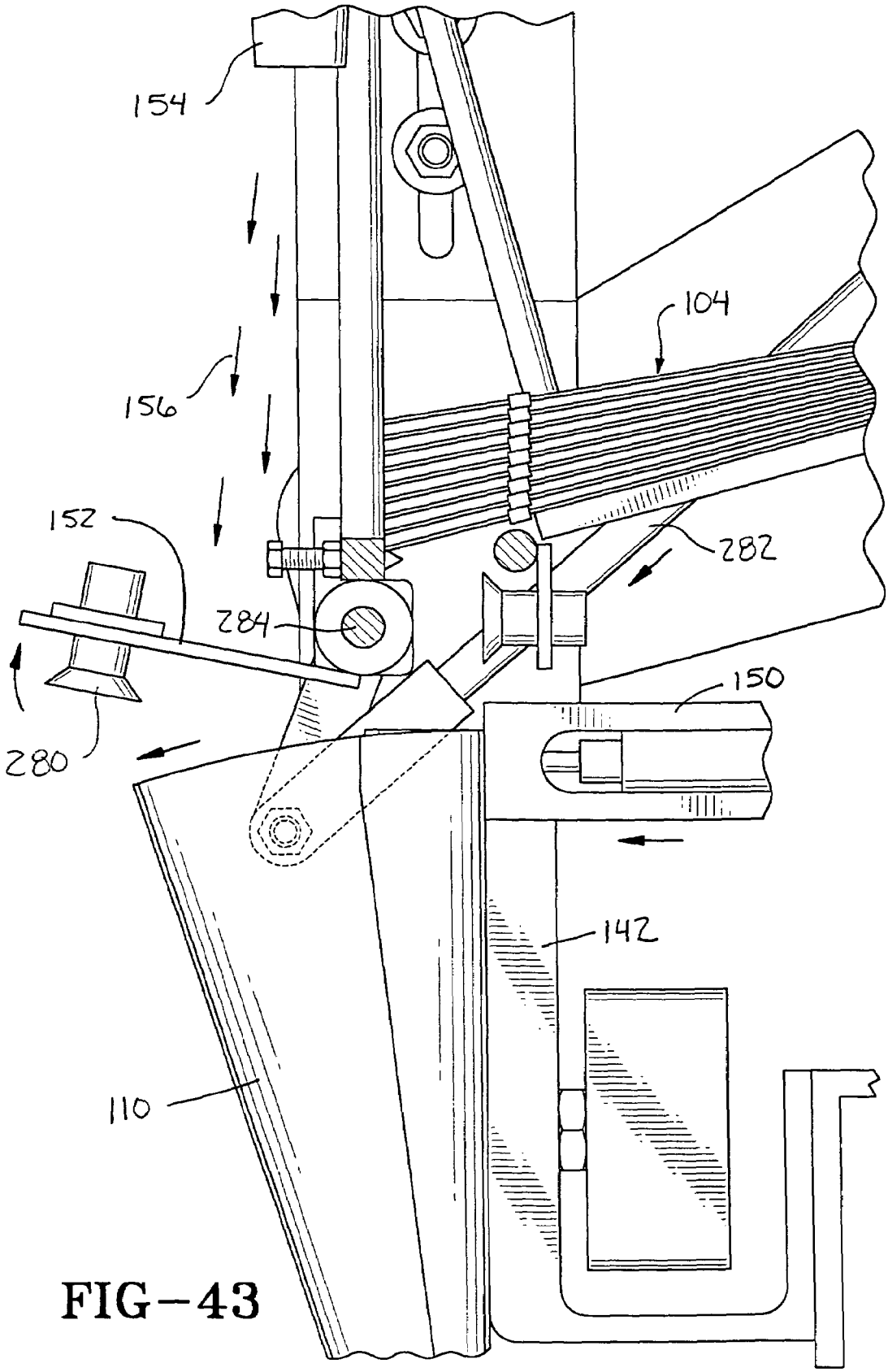

FIG. 43 shows the first pouch being opened with a blast of air from an overhead air knife and the movement of the bag opener from the second position to the first position. FIG. 43 also shows the optional step of having the shuttle arms moving forward to an intermediate position to help open the pouch. The opening step may occur in the position as shown in FIG. 43 or in an intermediate shuttle position on its way to the loading position so that the second pouch may be pulled down while the first pouch is being opened. This configuration may be used to increase the throughput of the apparatus.

Figure 44:
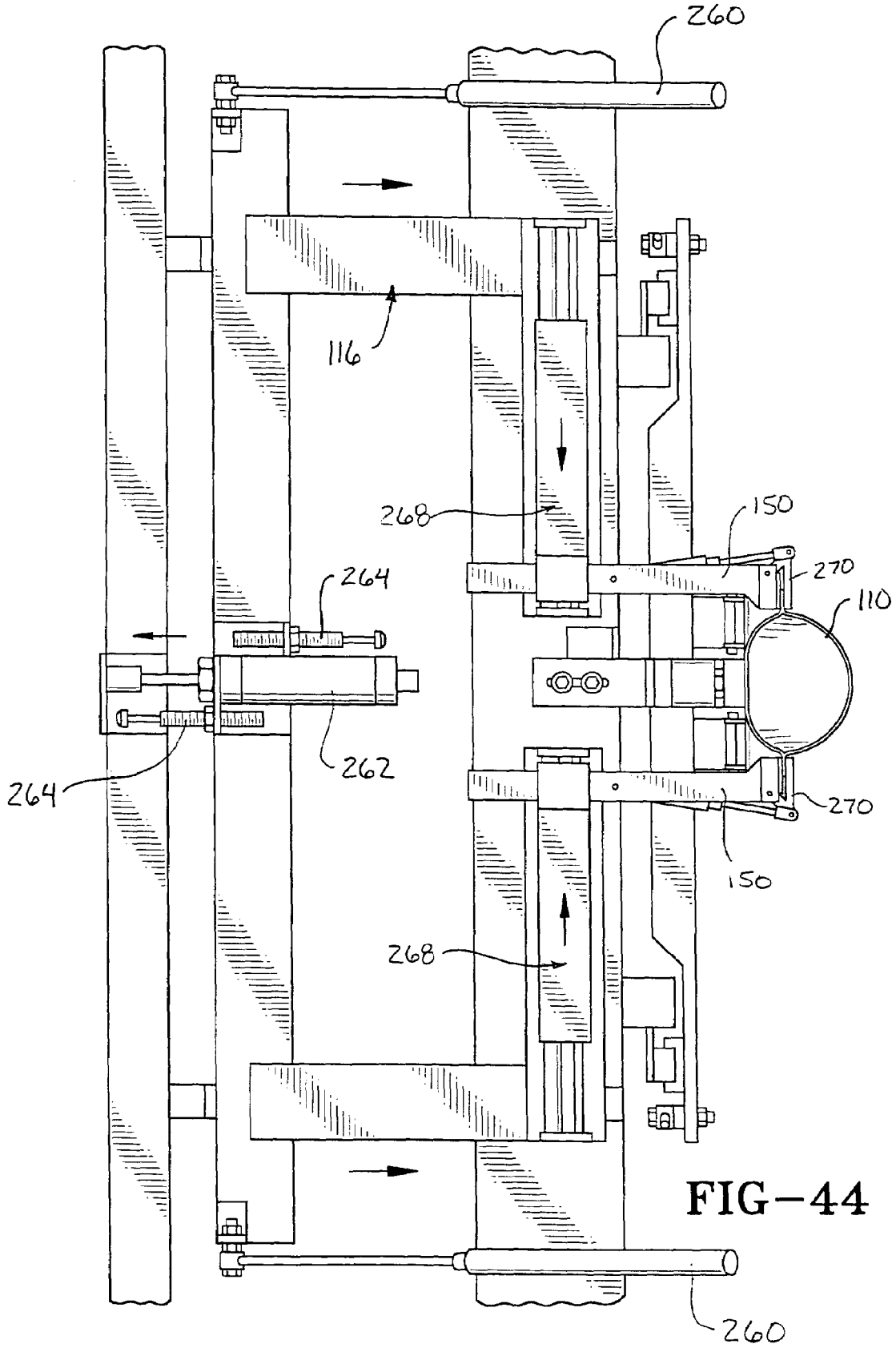

FIG. 44 is a top view of the shuttle arms moving inwardly to help open the first pouch.

Figure 45:
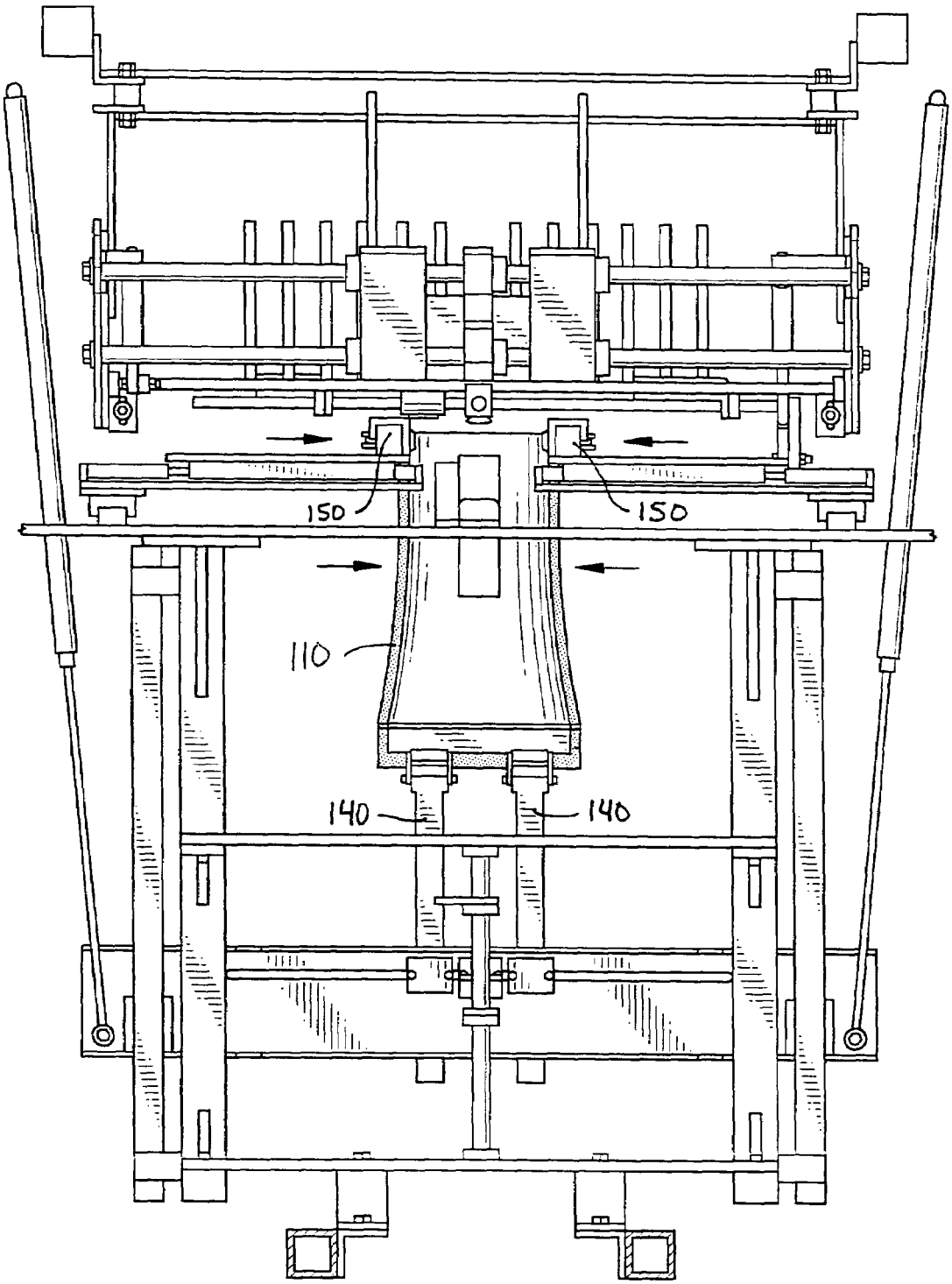

FIG. 45 is a rear view of the shuttle arms moving inwardly to help open the first pouch.

Figure 46:
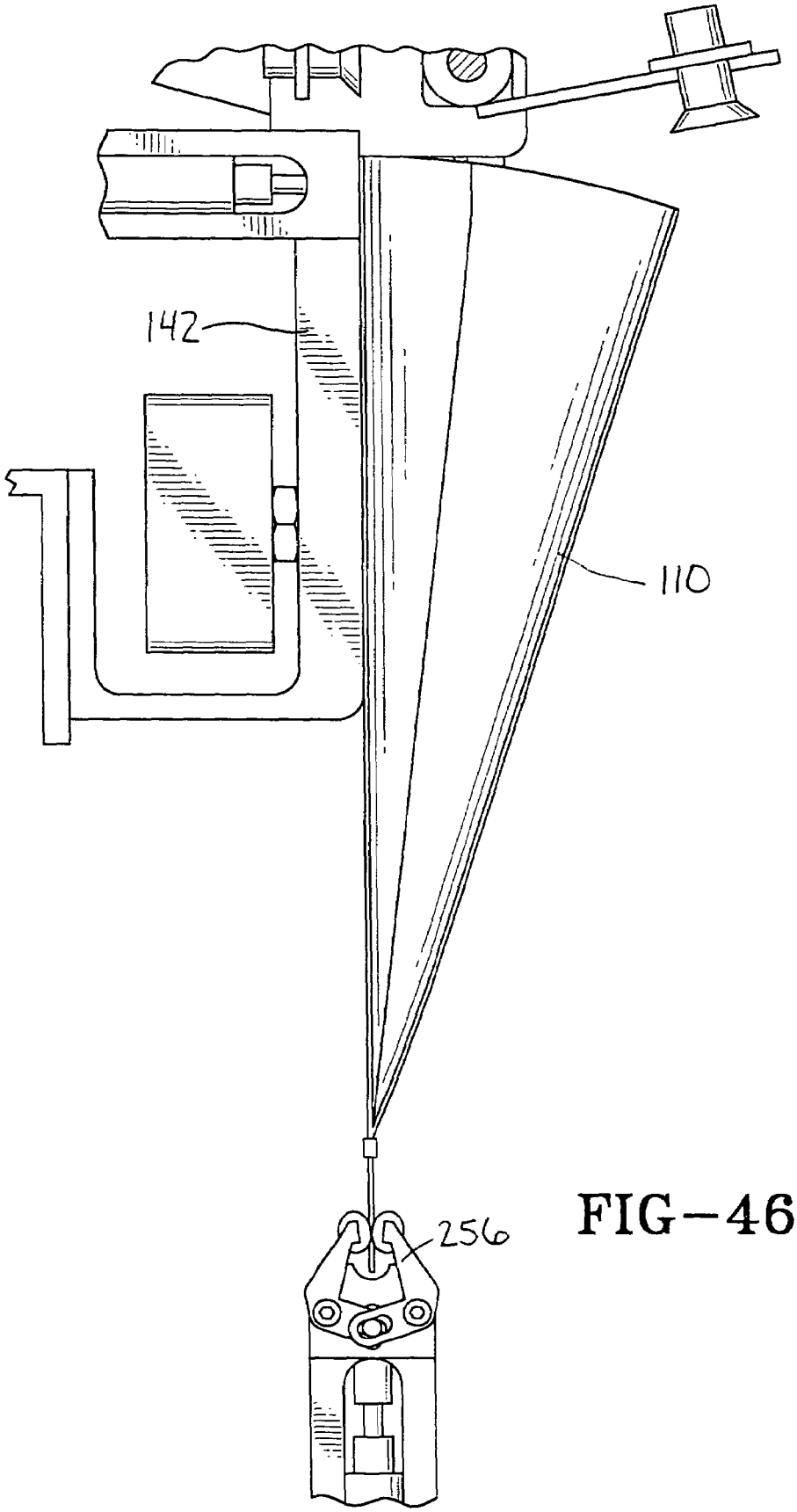

FIG. 46 is a view similar to FIG. 43.

Figure 21:
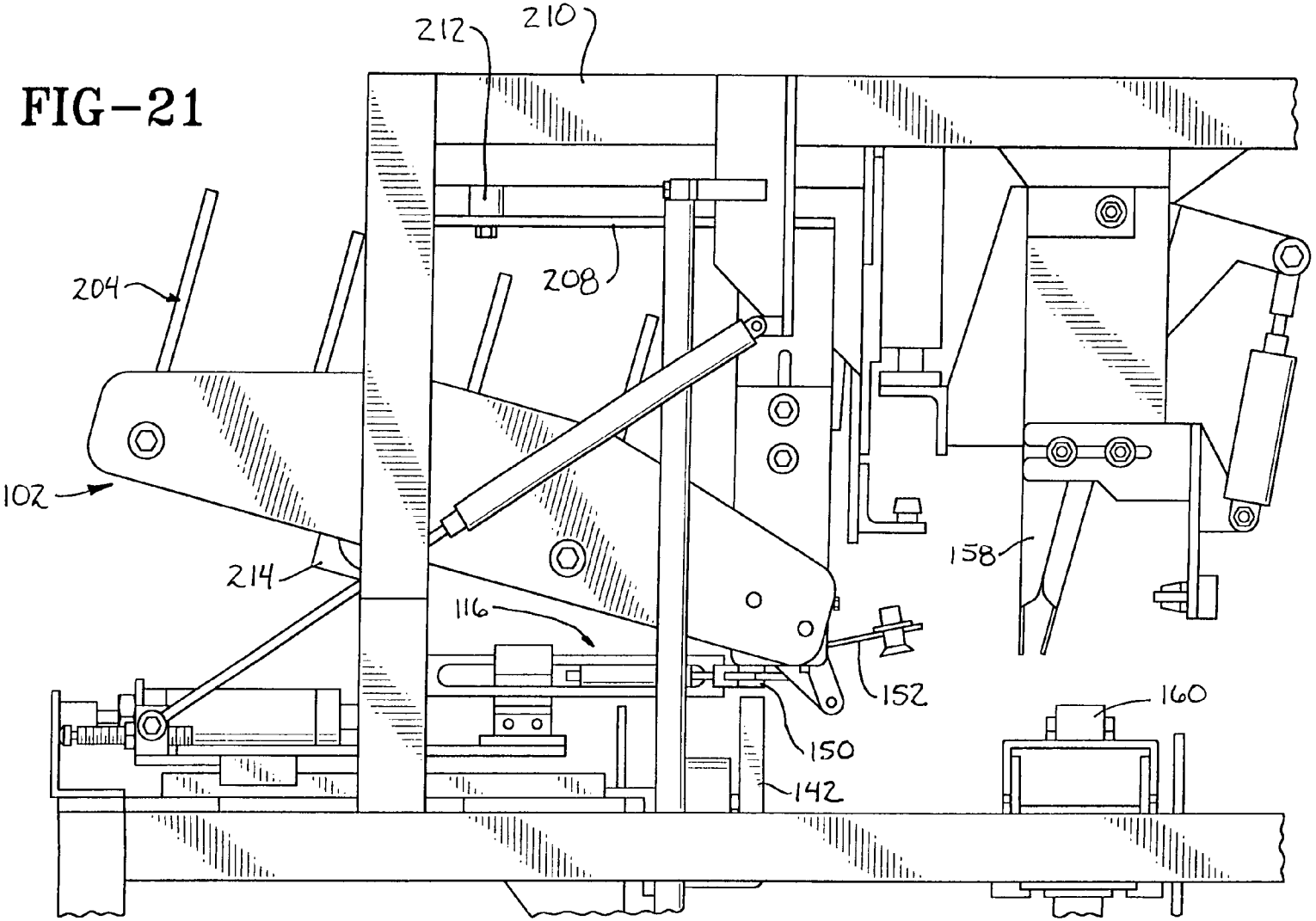
FIG. 21 is a side view of the pouch magazine, the pouch shuttle, and the loading device.
Figure 47:
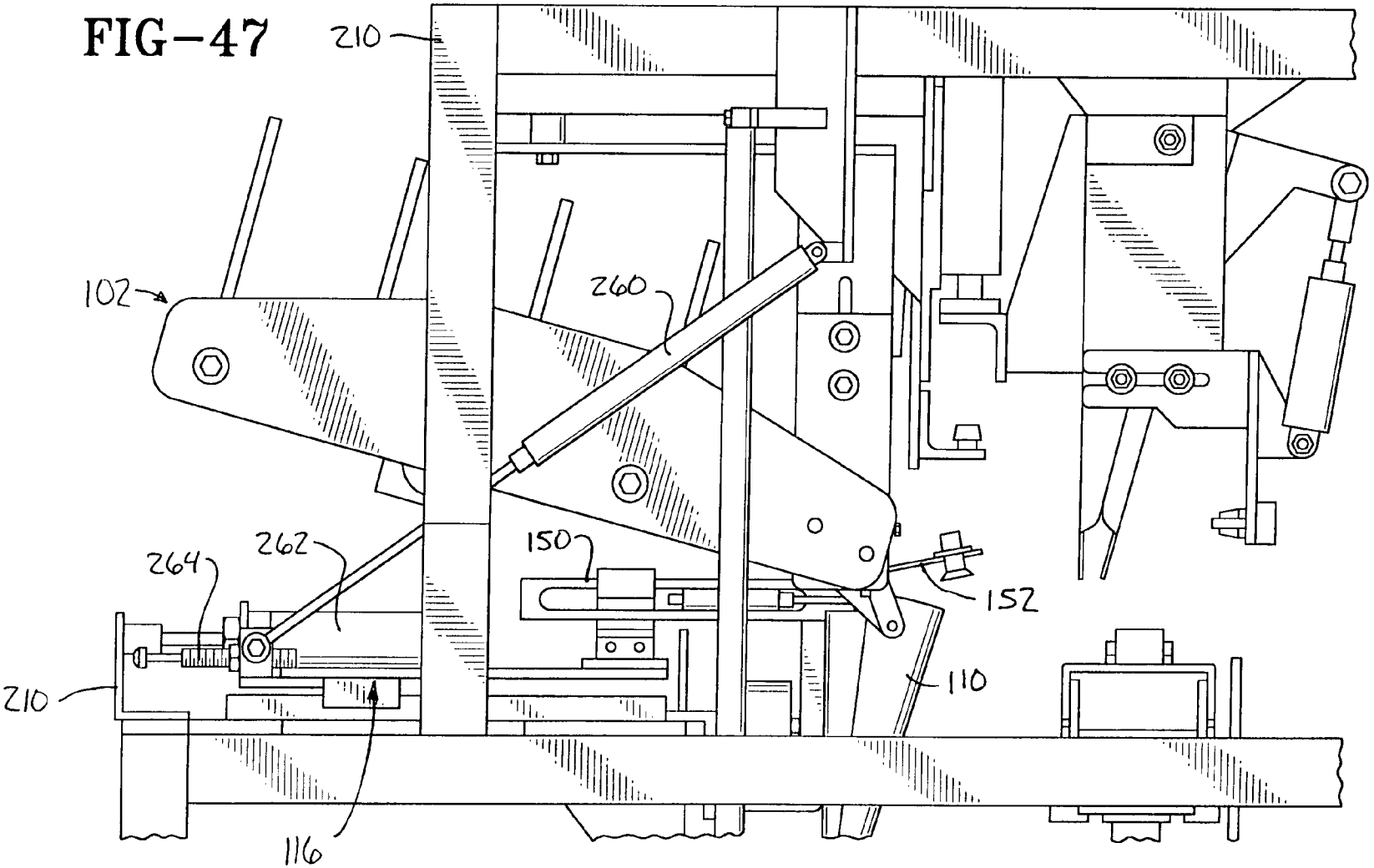

FIG. 47 is a view similar to FIG. 21 showing the fist pouch opened and held by the shuttle.

Figure 48:
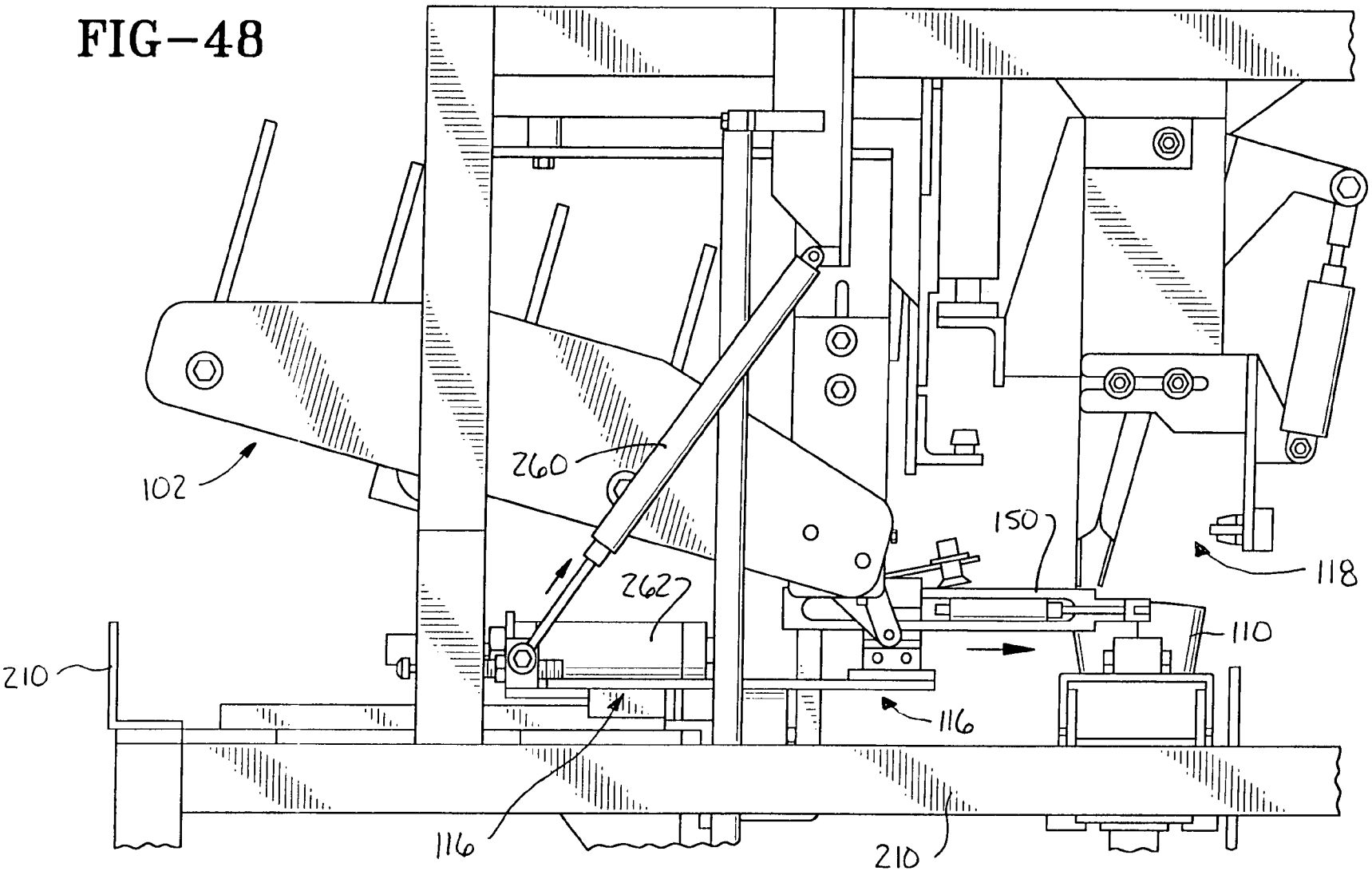

FIG. 48 shows the opened first pouch being moved to the loading position.

Figure 49:
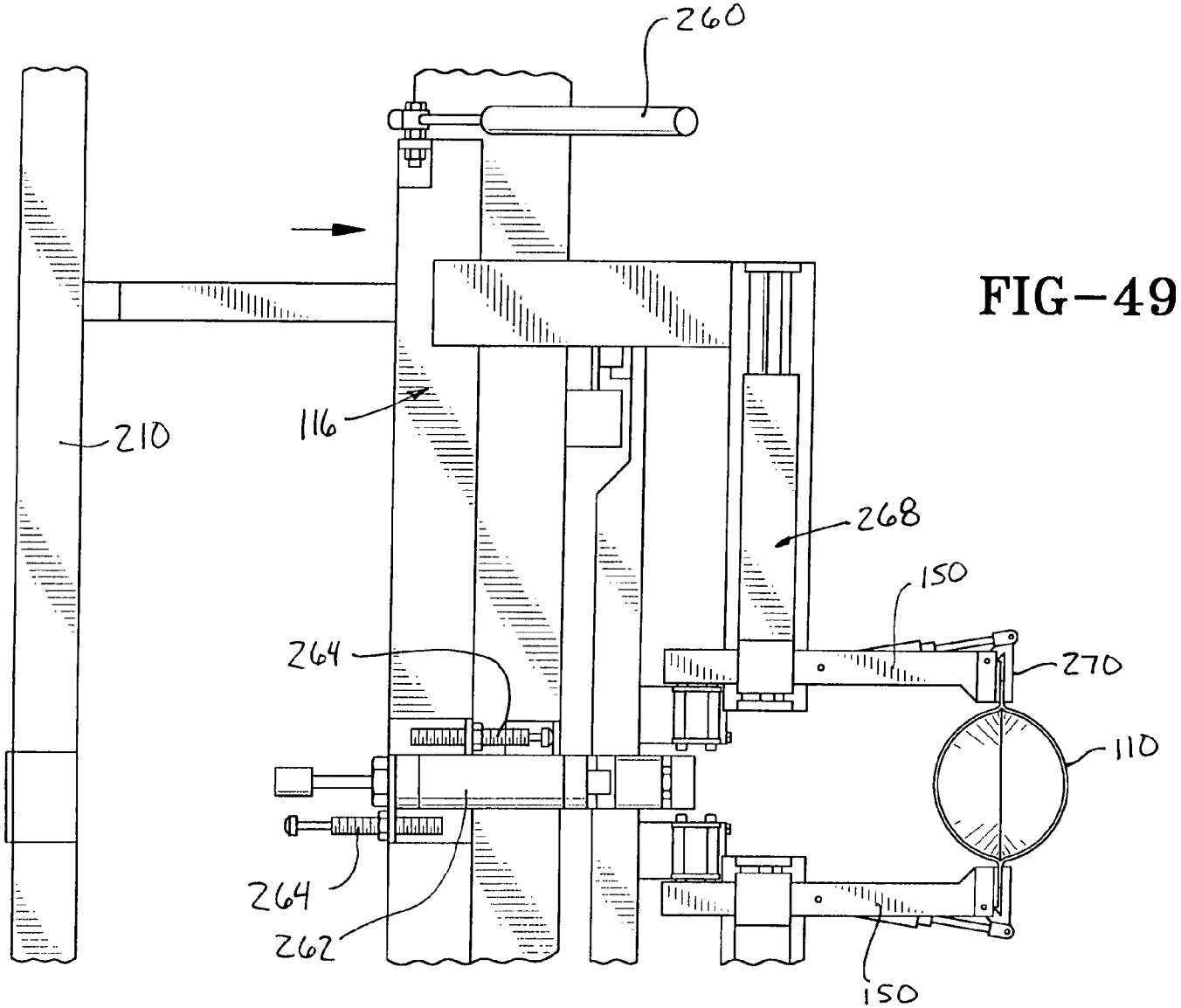

FIG. 49 shows the opened first pouch being moved to the loading position.

Figure 50:
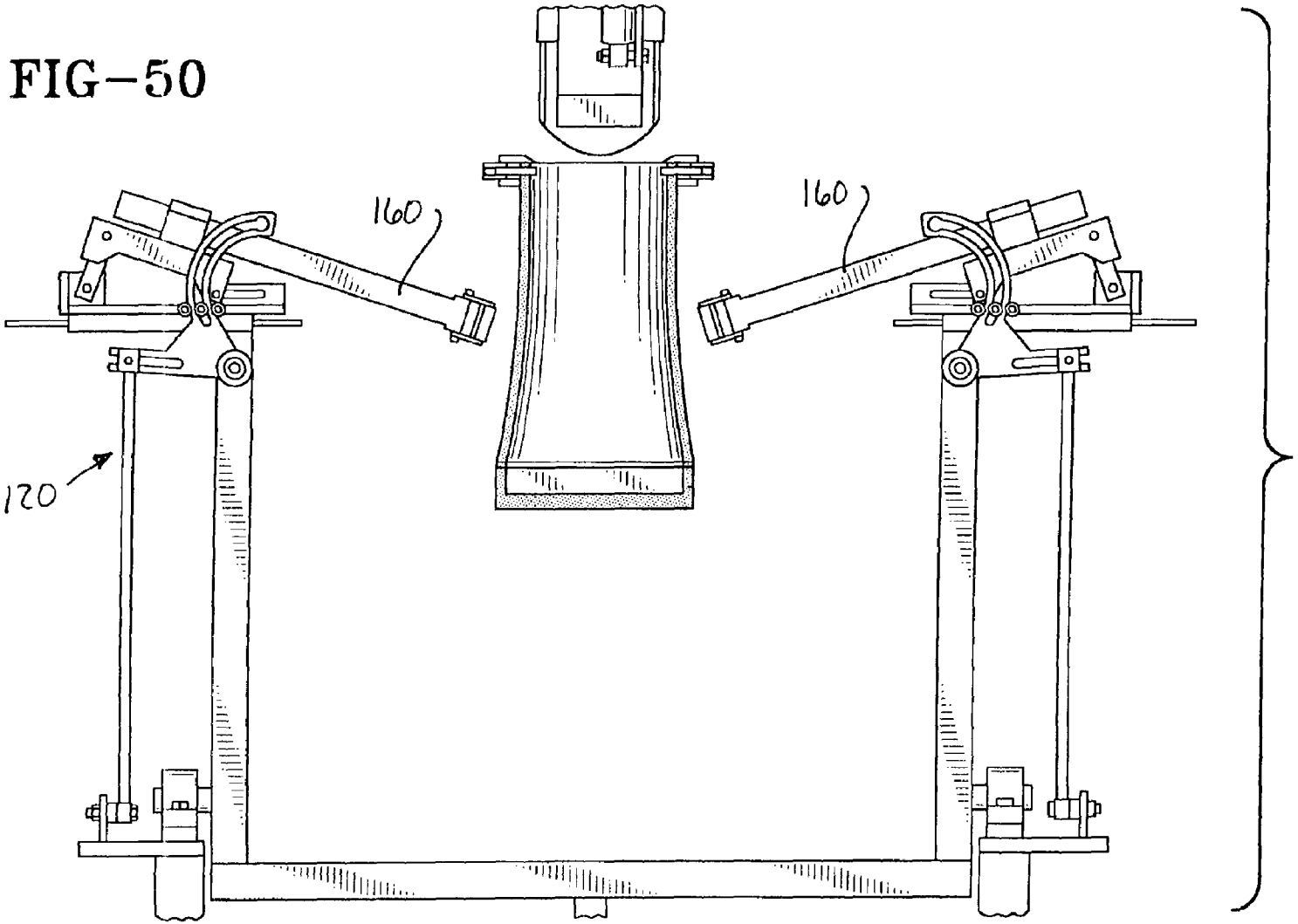

FIG. 50 shows the first pouch at the loading position with the transfer arms in their first position.

Figure 51:
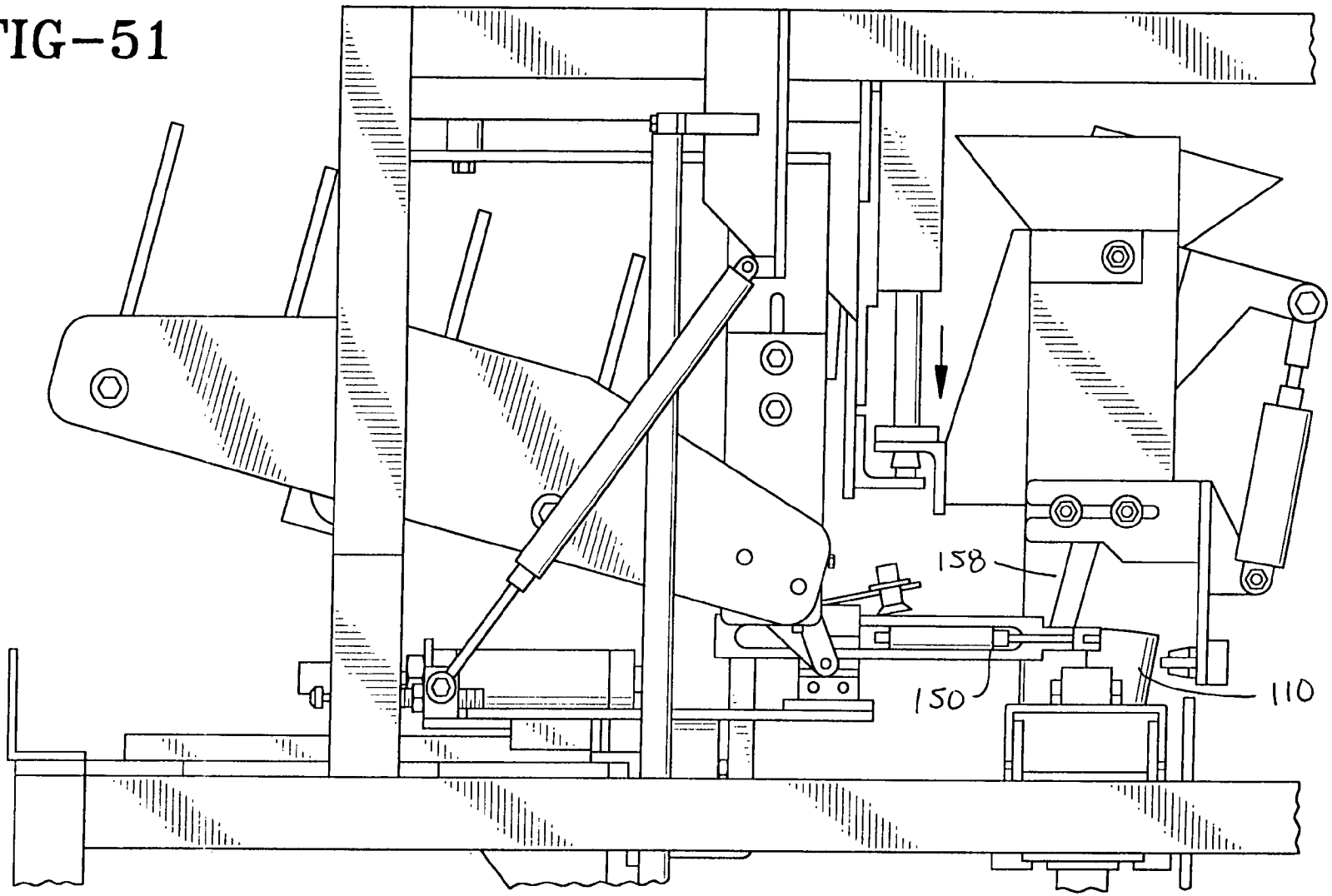

FIG. 51 shows the funnel moved into its loading position.

Figure 52:
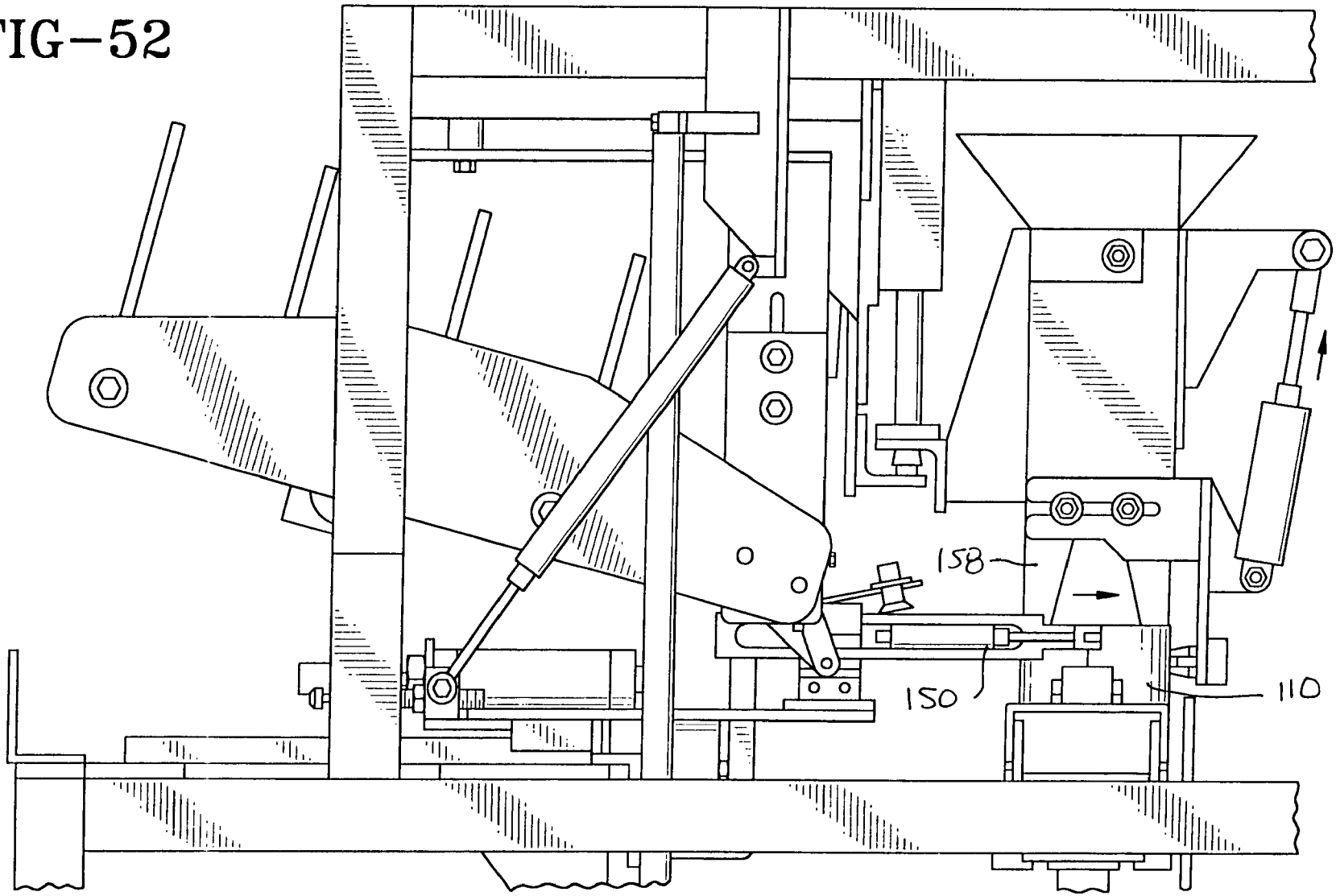

FIG. 52 shows the funnel being opened.

Figure 53:
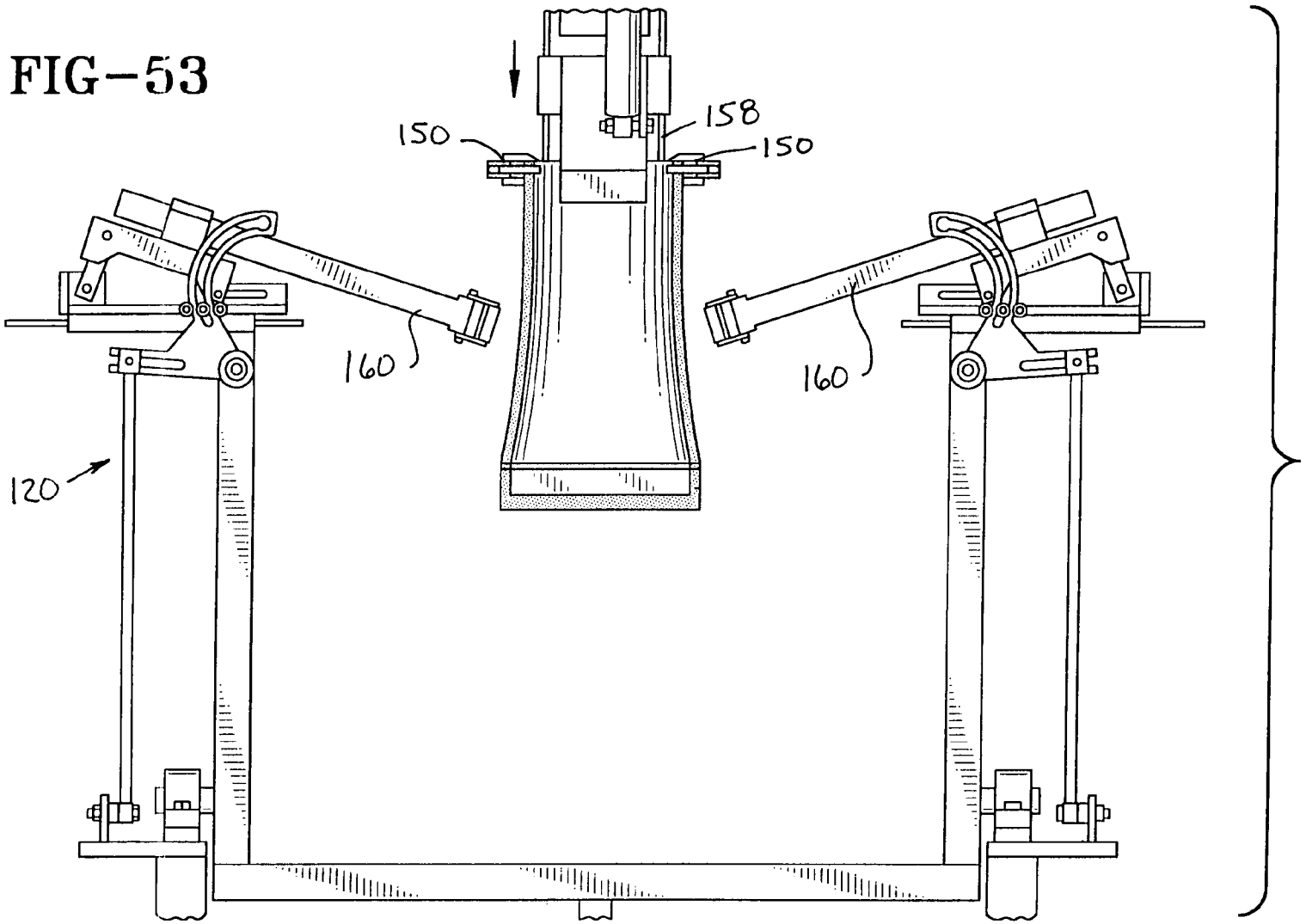

FIG. 53 shows the funnel being moved down into the first pouch.

Figure 53A:
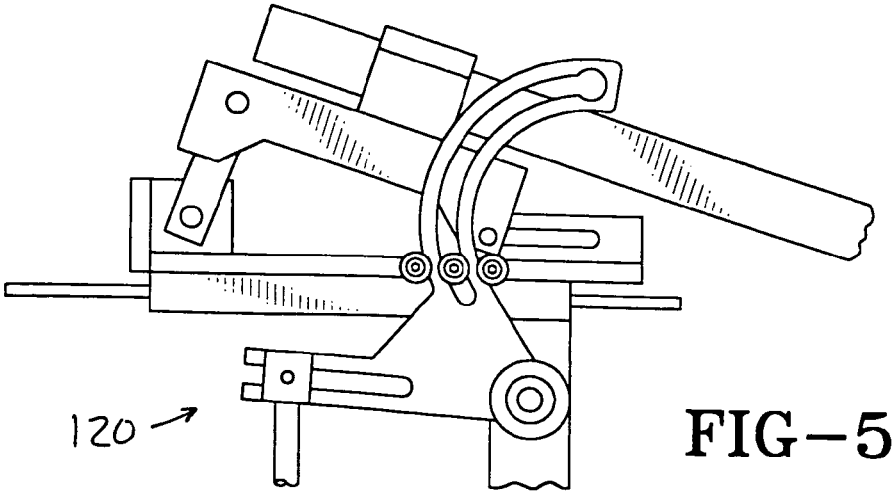

FIG. 53A shows the transfer arm mechanism.

Figure 54A:
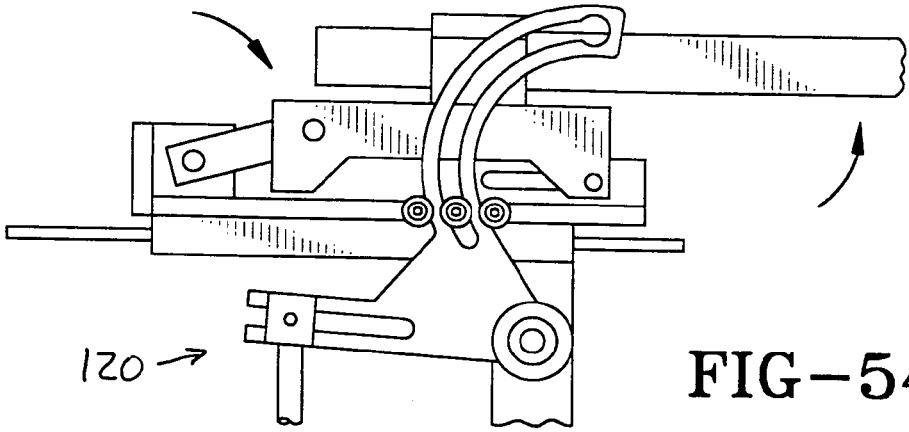
Figure 54:
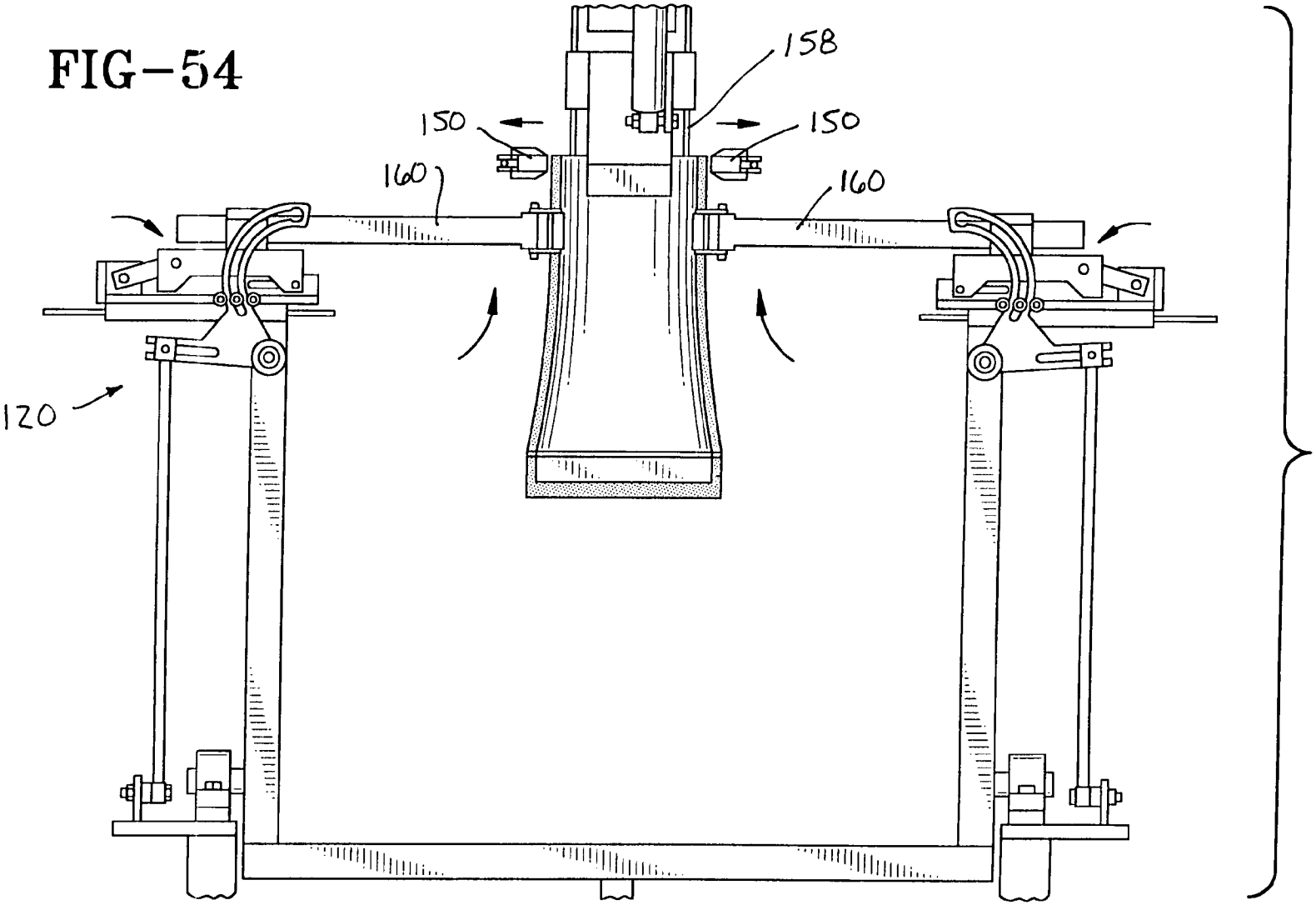

FIG. 54 shows the transfer arms moved up to engage the first pouch.

FIG. 54A shows the transfer arm mechanism being moved.

Figure 55:
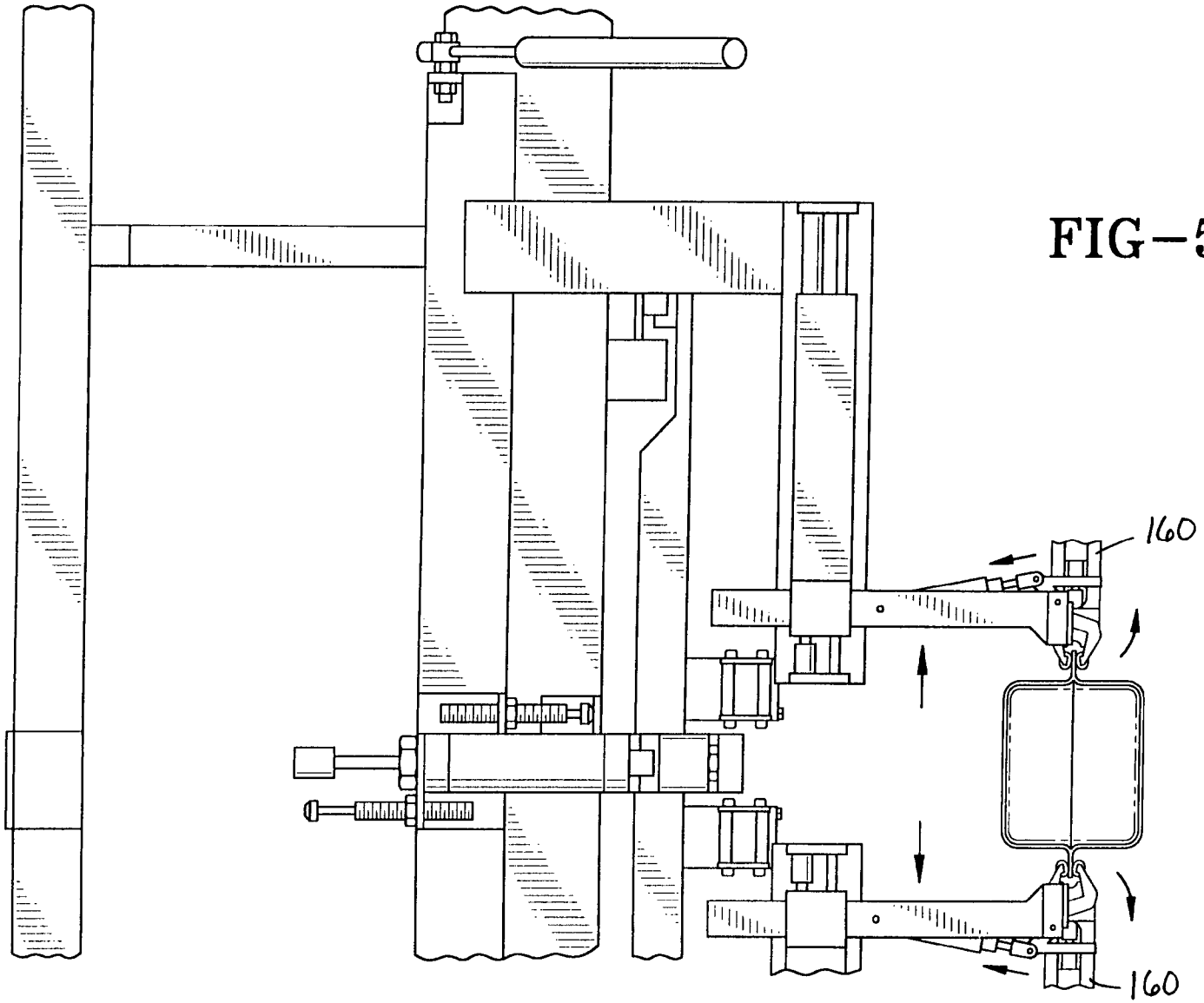

FIG. 55 is a top view of the shuttle and the transfer arms holding the first pouch.

Figure 56:
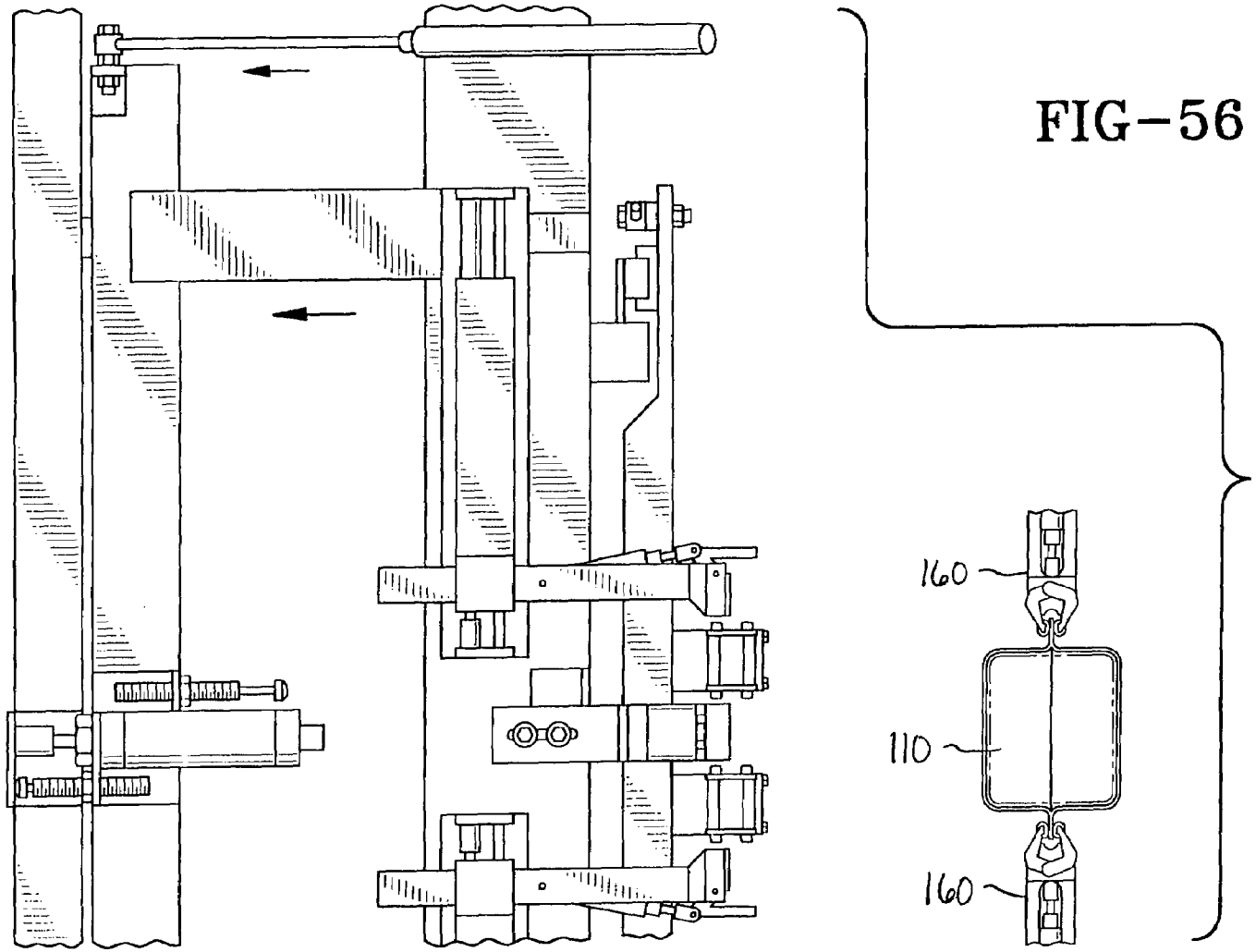

FIG. 56 is a top view showing the shuttle released from the first pouch.

Figure 57:
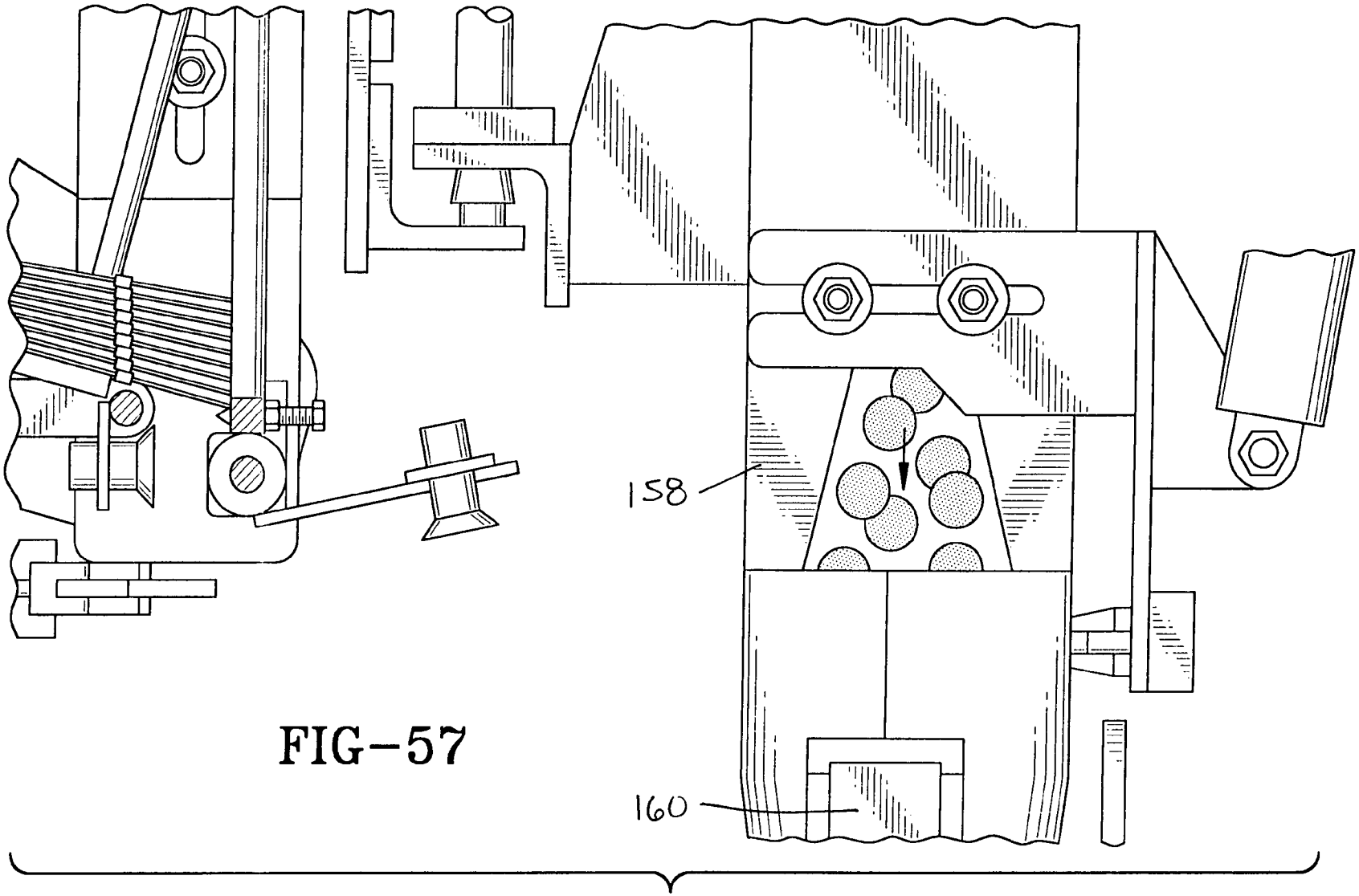

FIG. 57 is a side view showing the first pouch being filled. In an alternative embodiment, the second pouch would be being pulled down or would be being opened at this stage to increase throughput.

Figure 58:
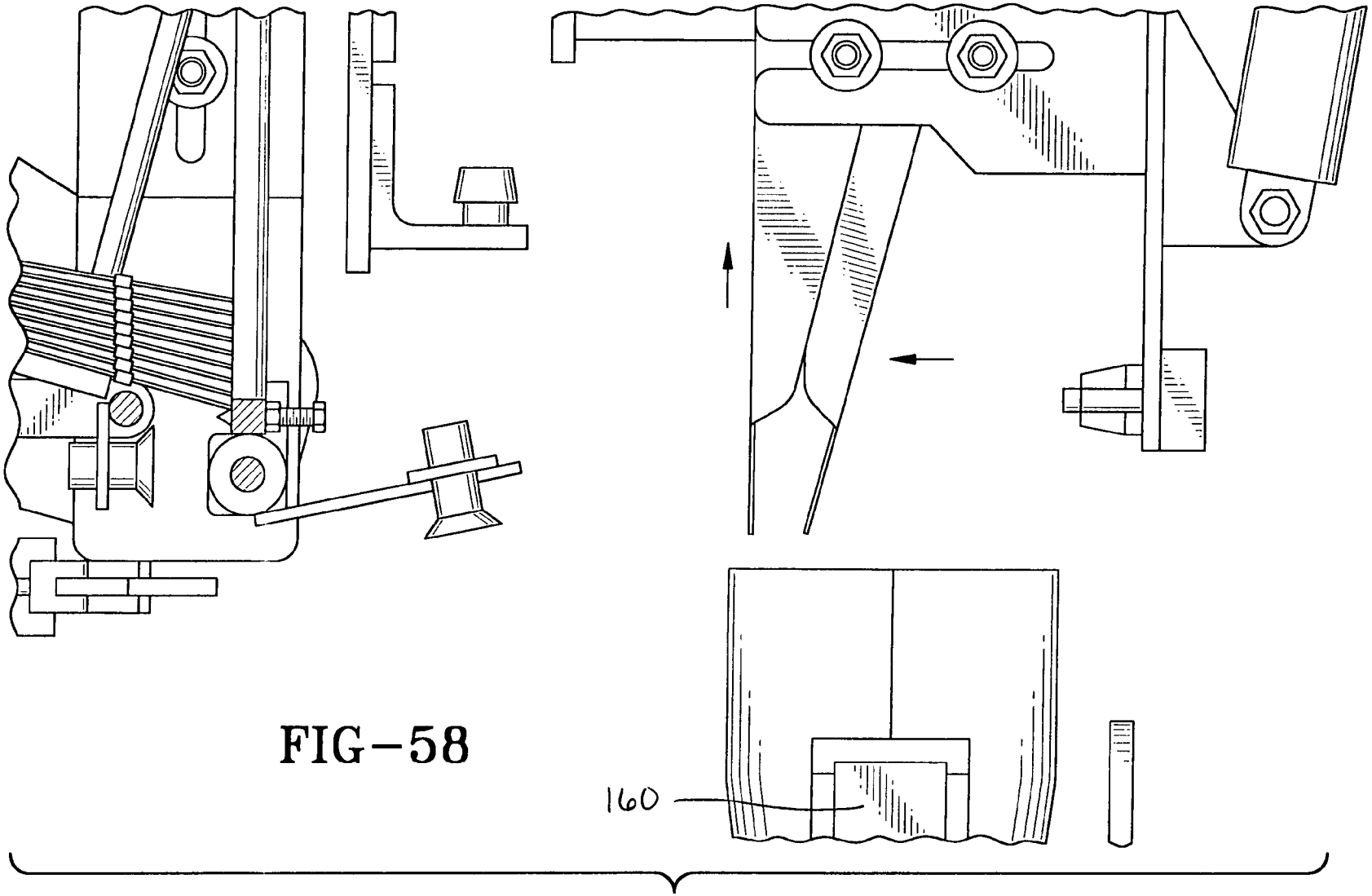

FIG. 58 shows the funnel being disengage from the first pouch.

Figure 59:
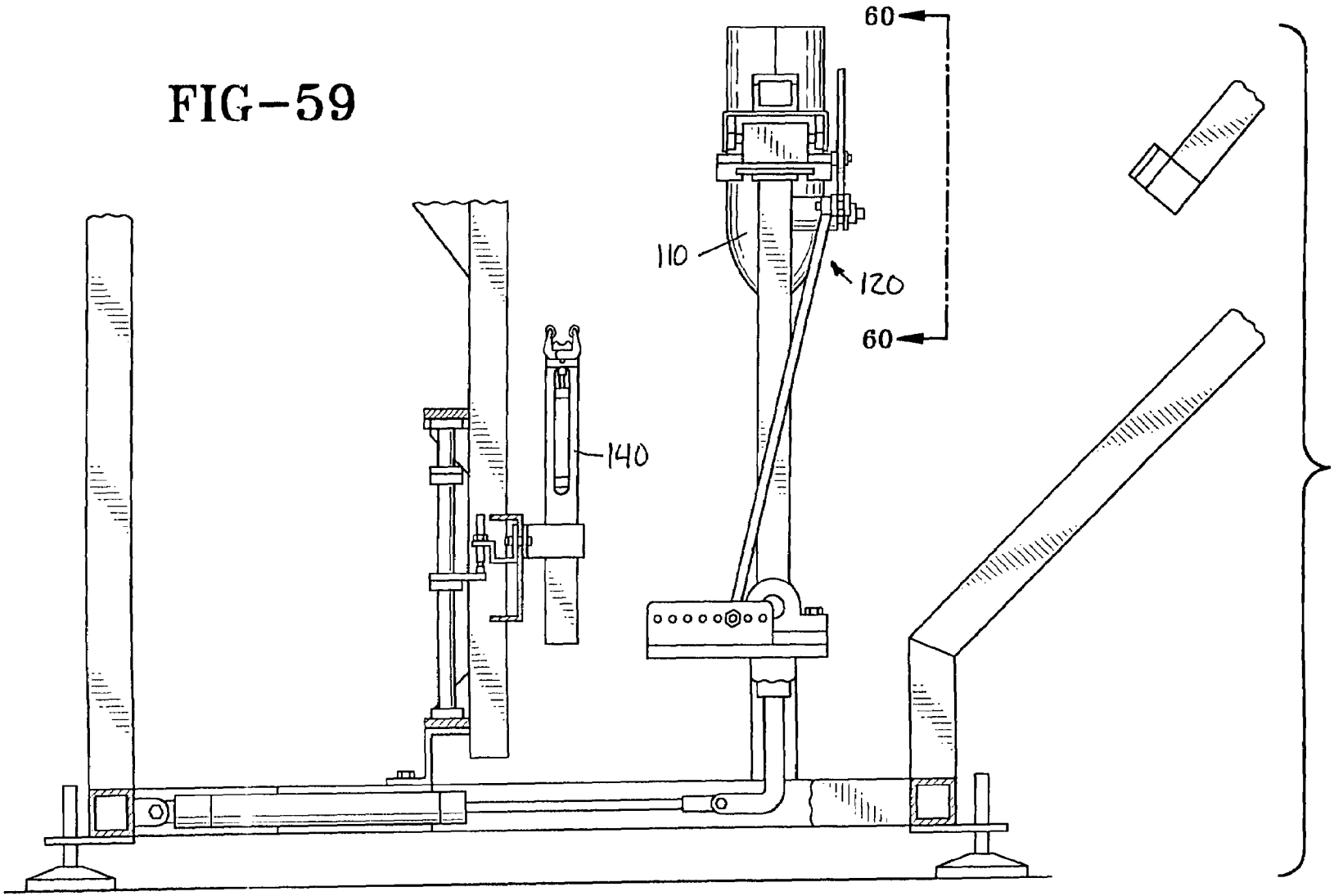

FIG. 59 is a side view of the transfer mechanism.

Figure 60:
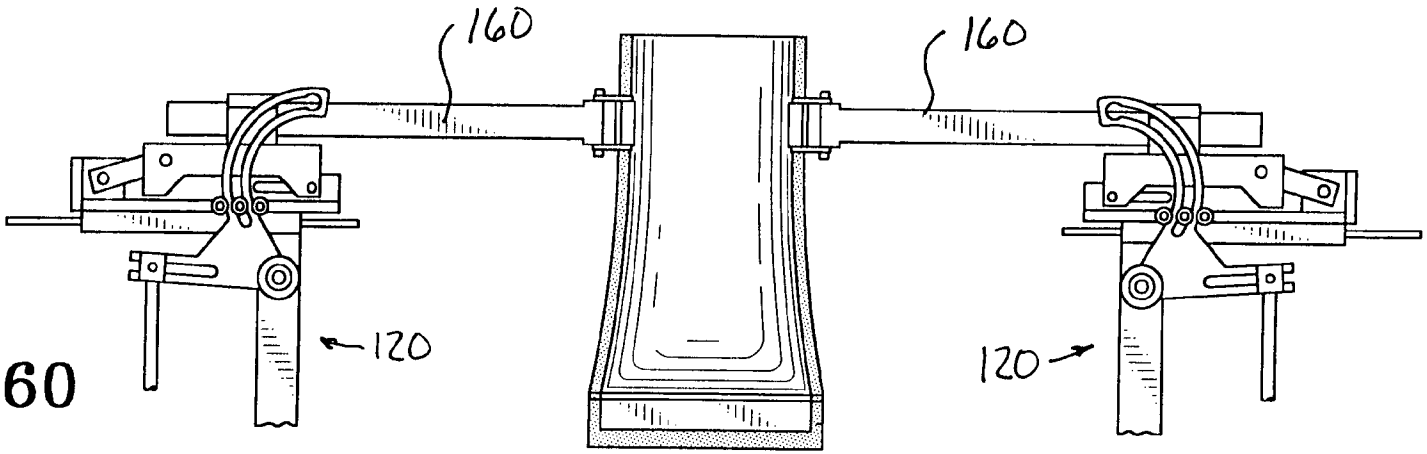
Figure 62:
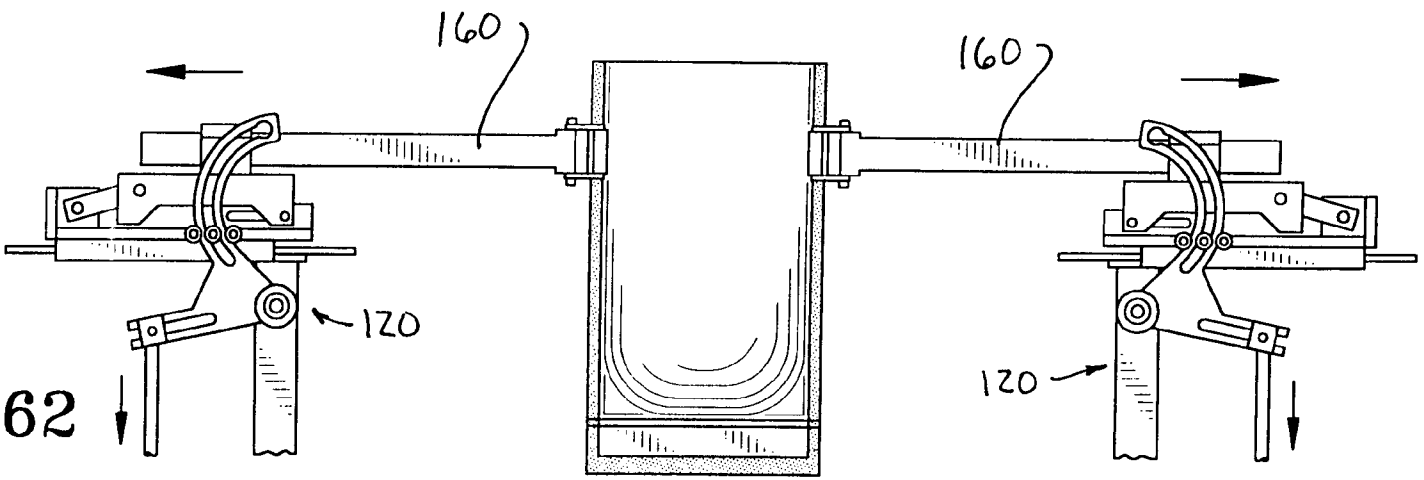
Figure 61:
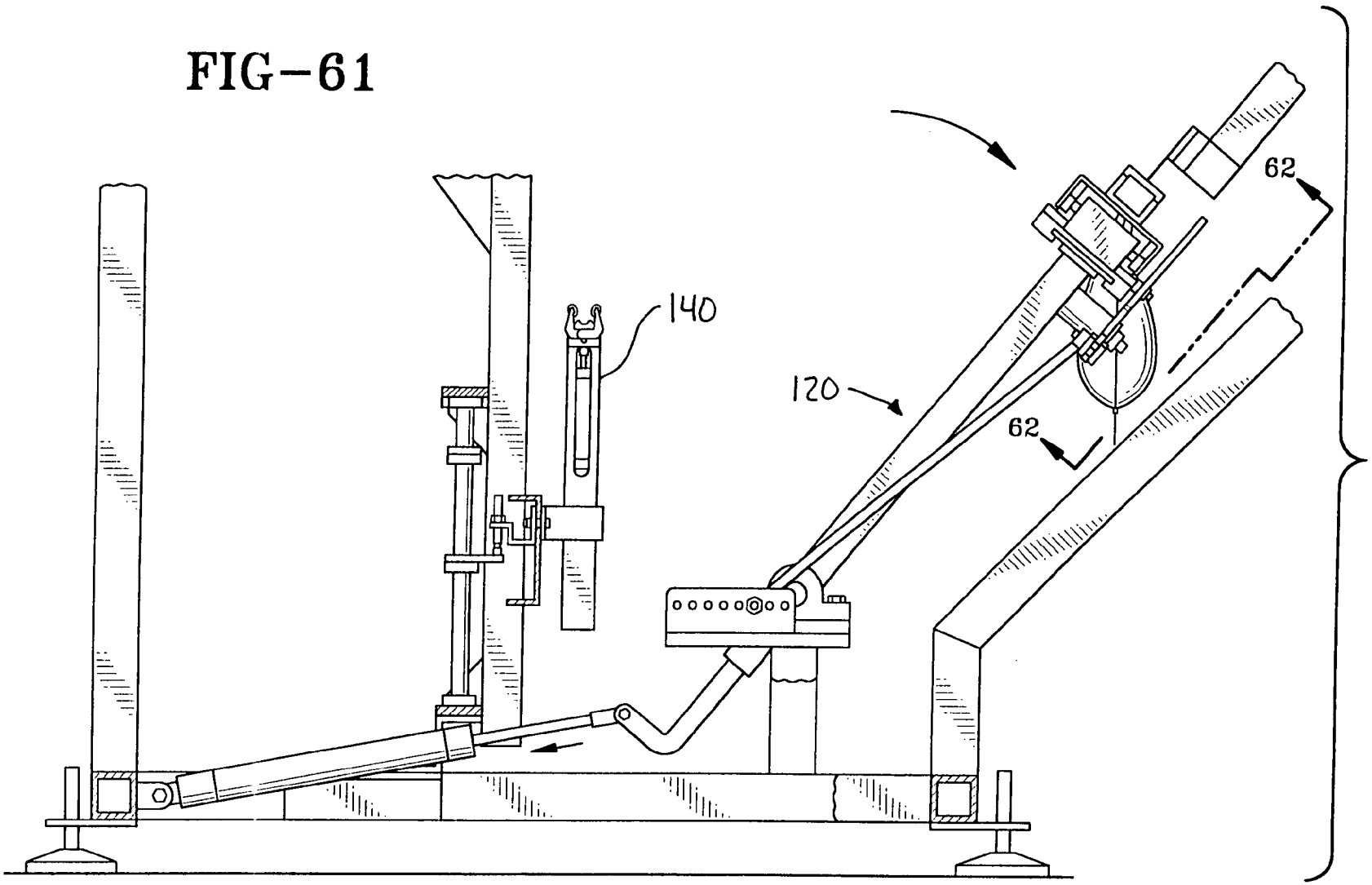
Figure 63:
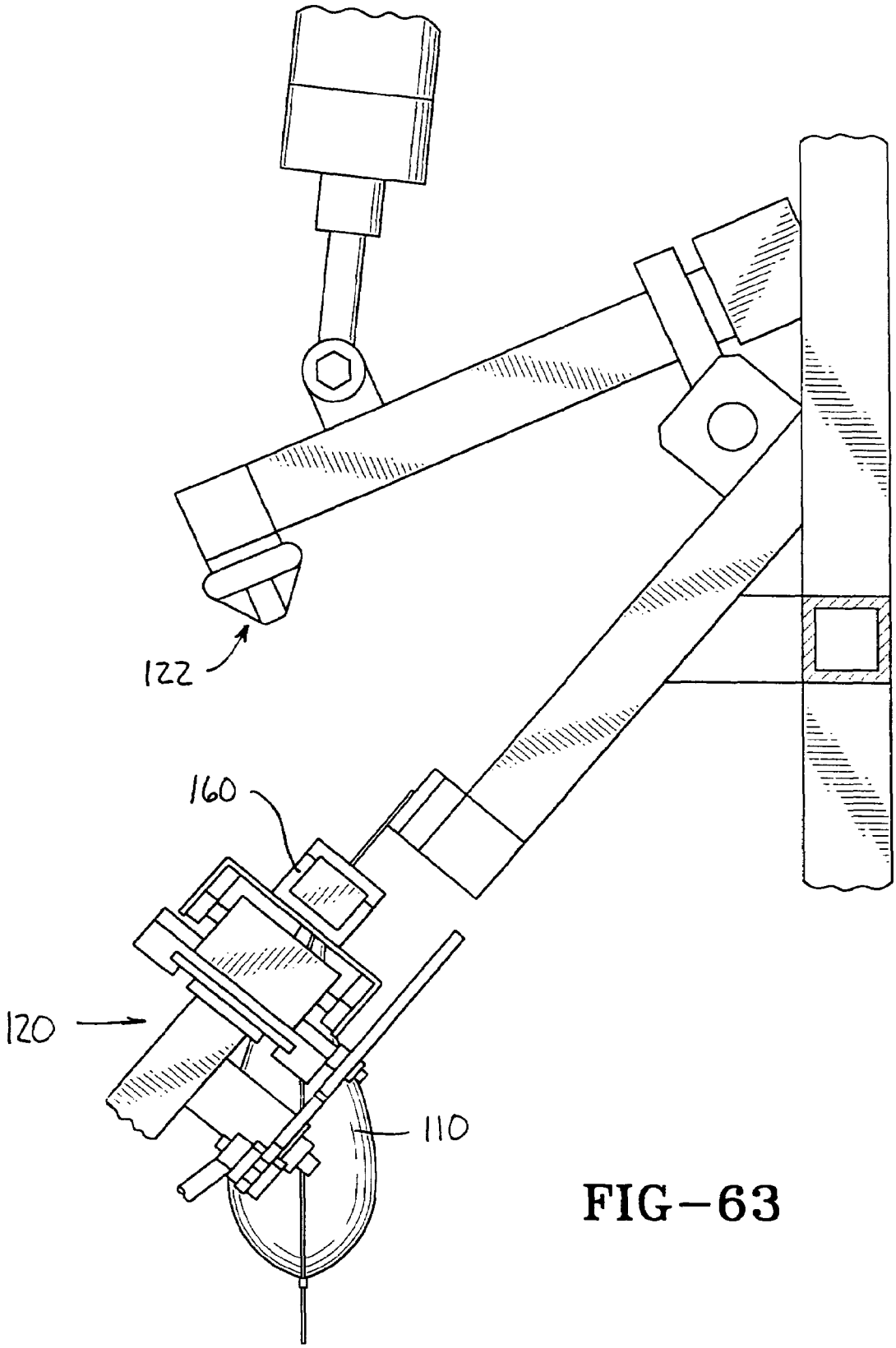
Figure 64:
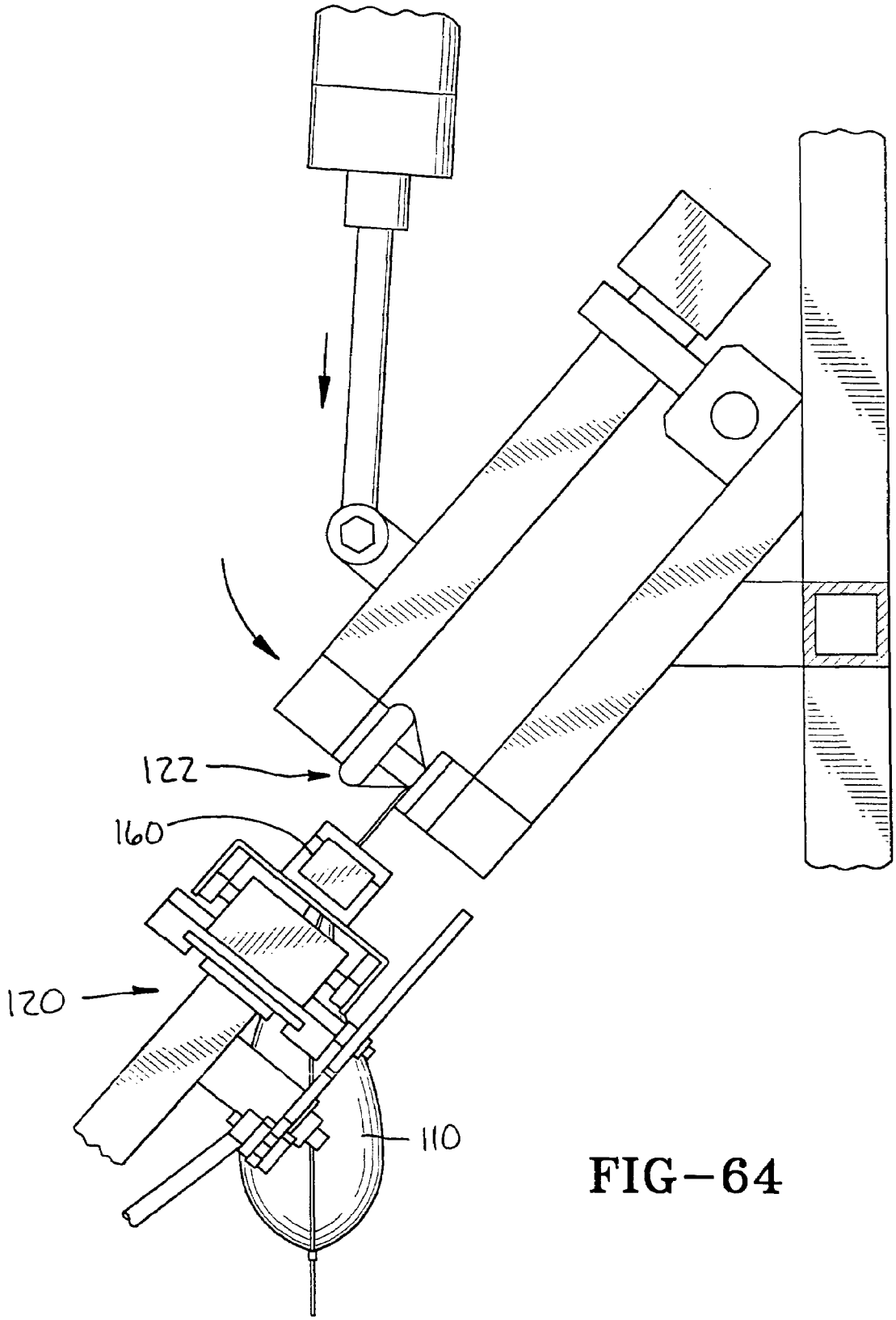

FIG. 60 is a view taken along line 60-60 of FIG. 59.

FIGS. 61-64 show the process of transferring the first pouch to the sealer and sealing the first pouch.

Figure 62A:
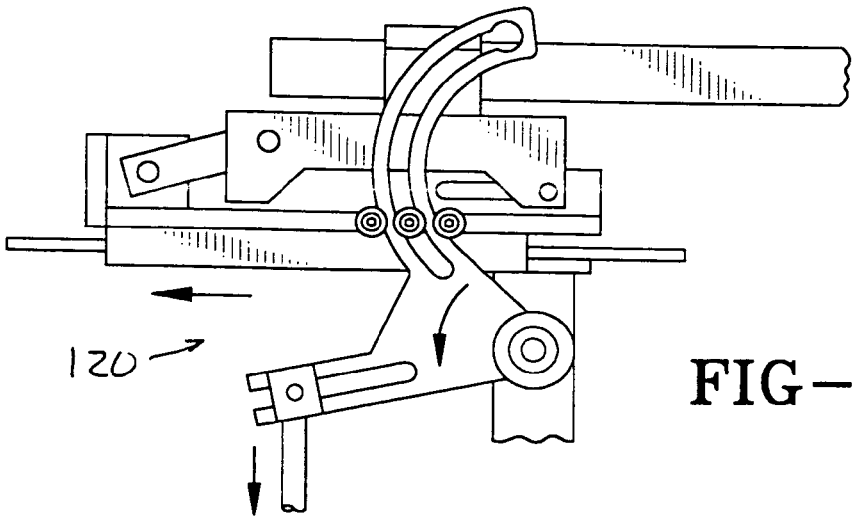

FIG. 62A shows the transfer arm mechanism moving back.

Figure 65:
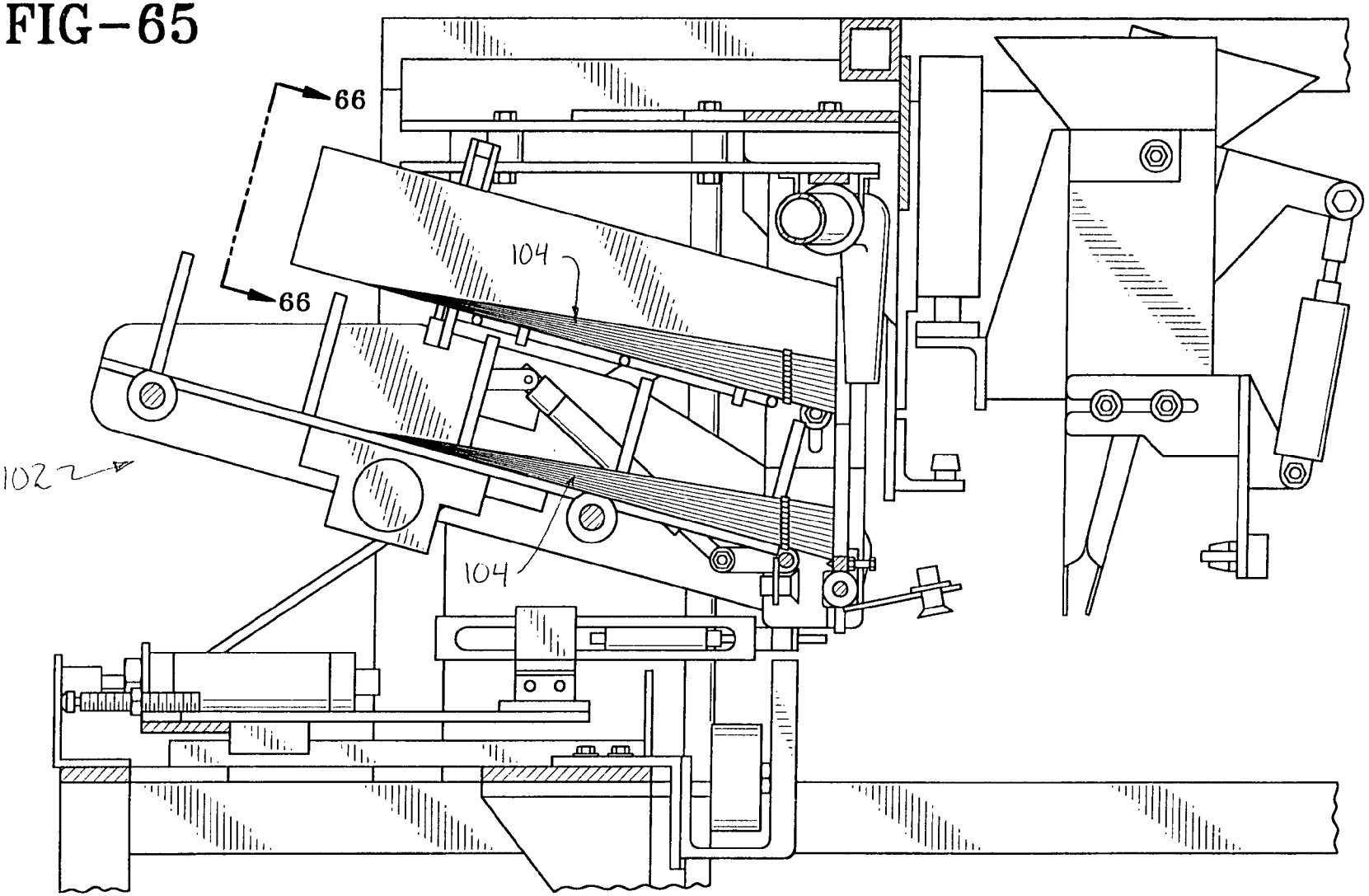
Figure 66:
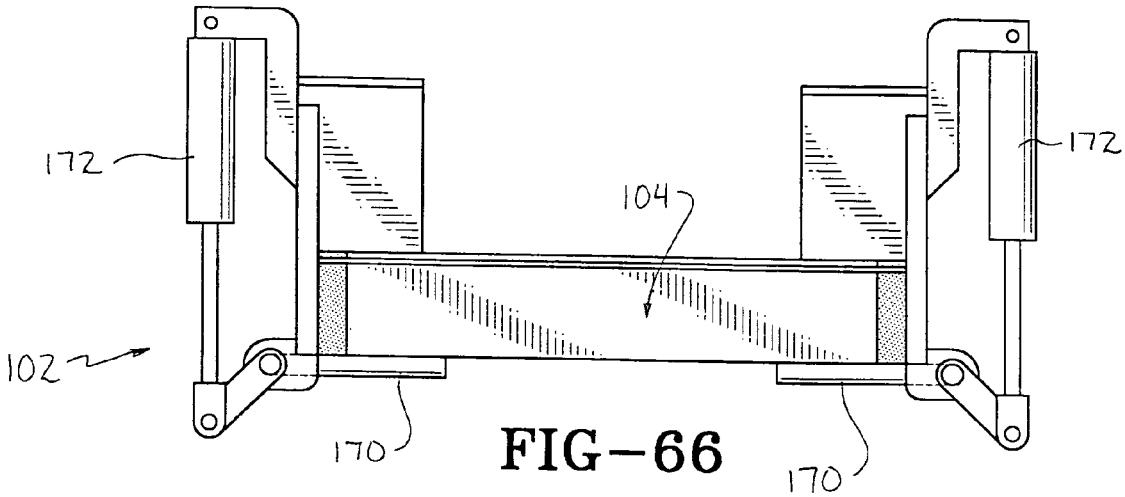
Figure 67:
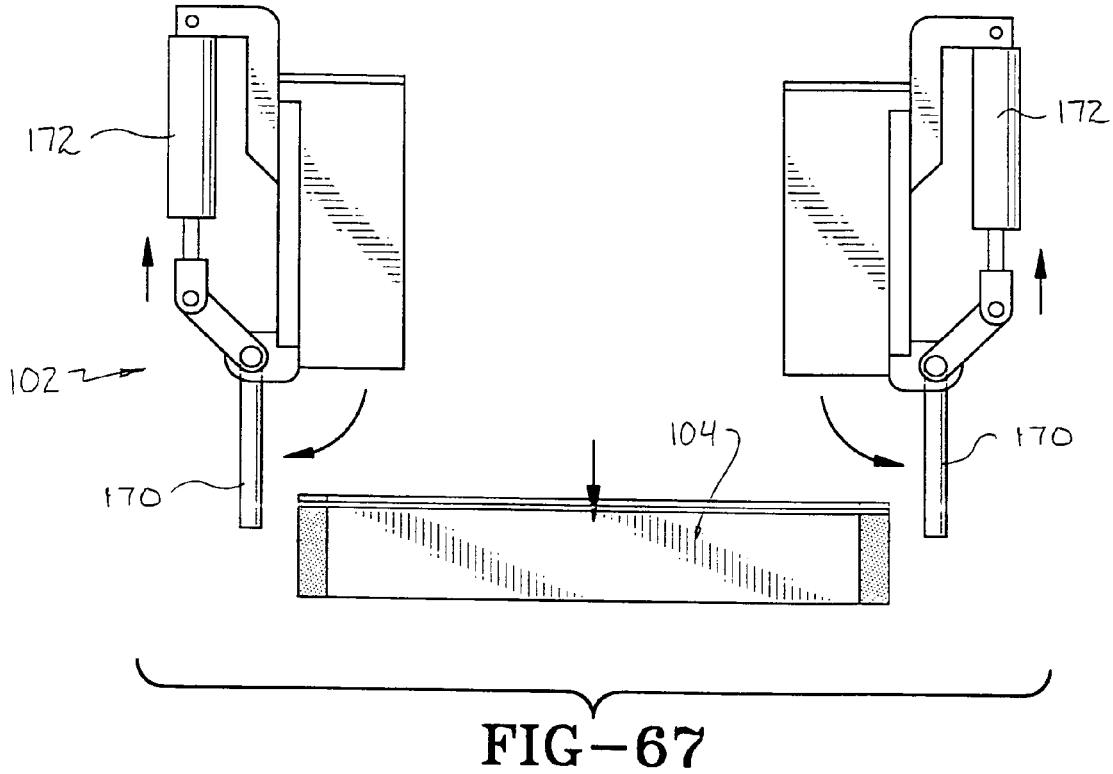
Figure 68:
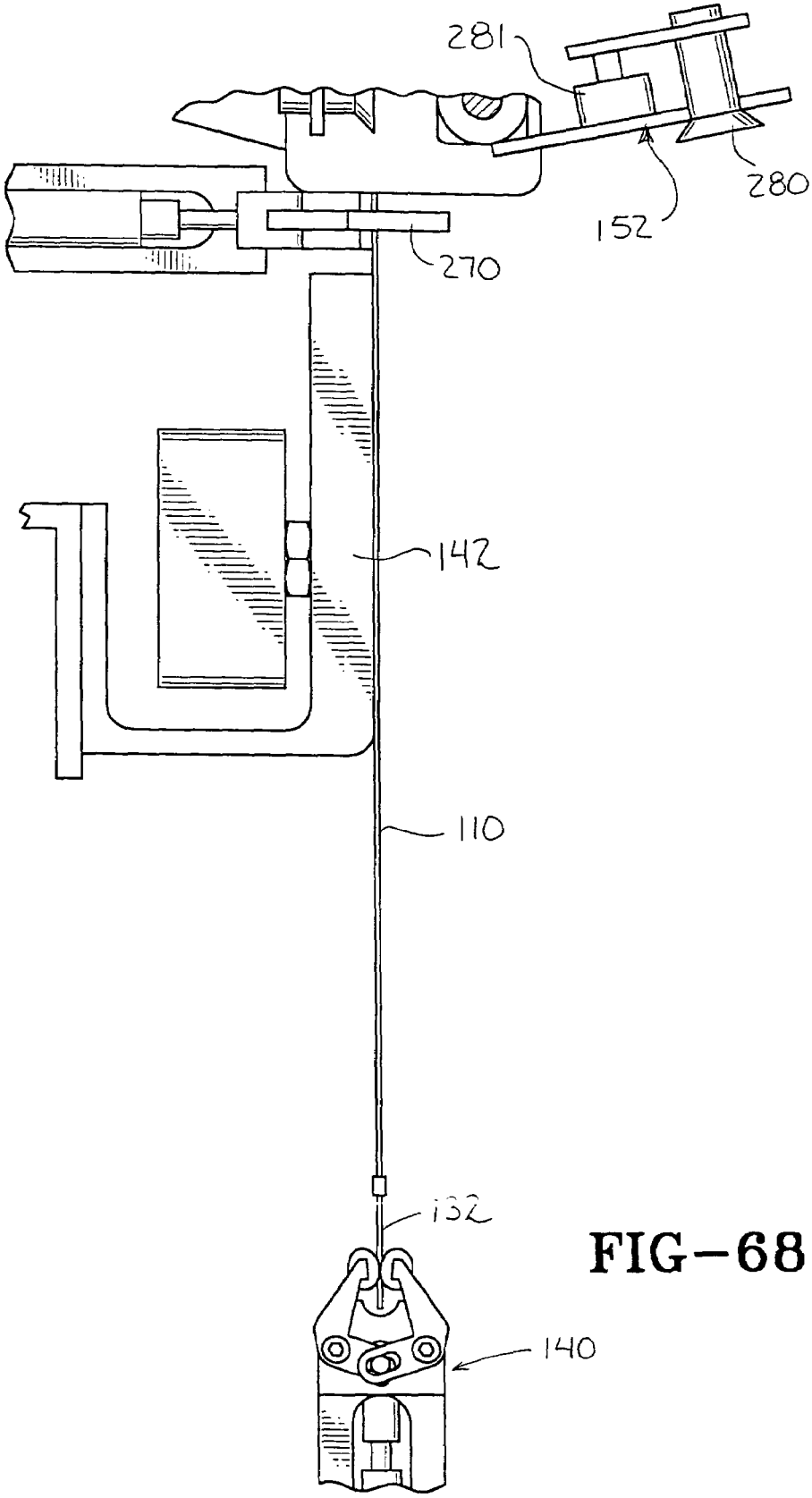
Figure 69:
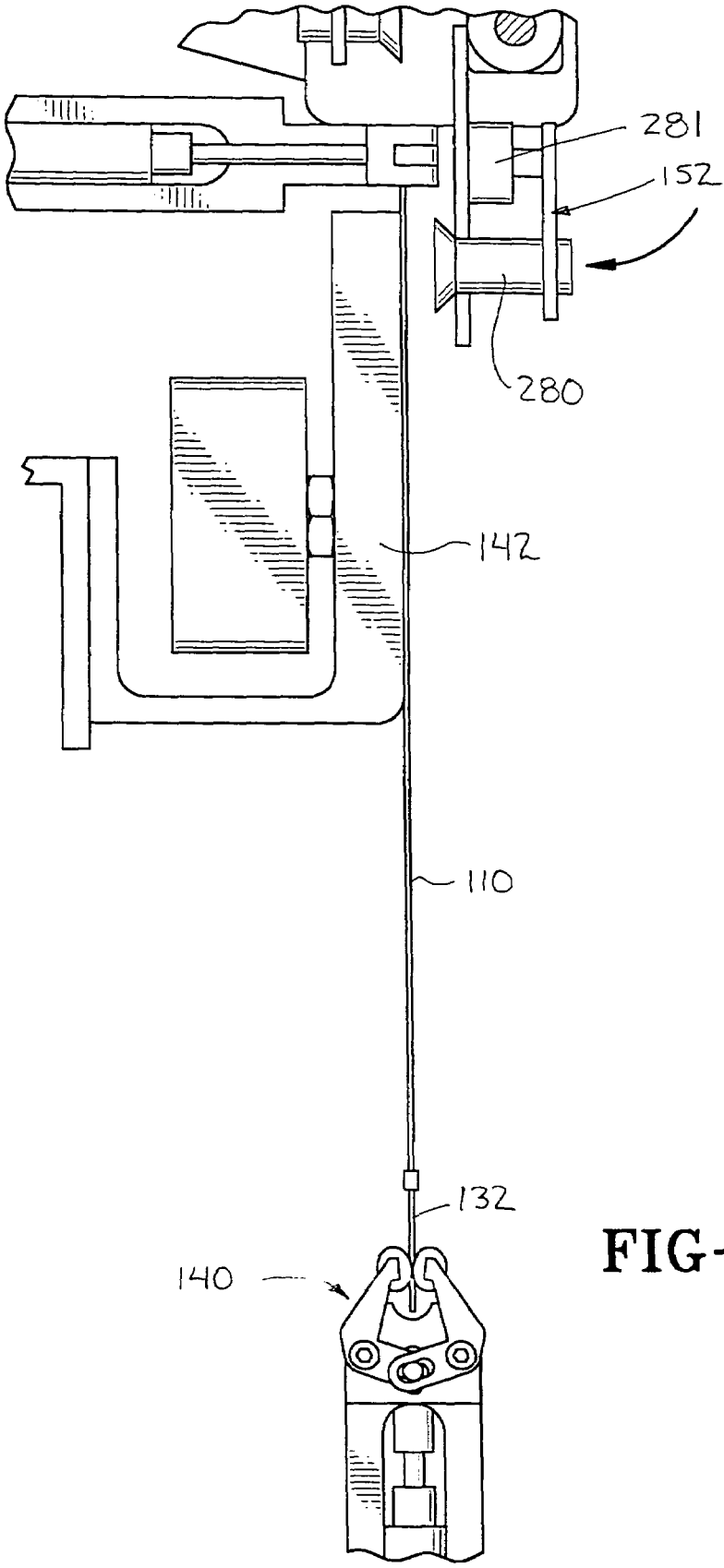

FIGS. 65-67 show a new pouch magazine showing first and second pluralities of adjacent pouches wherein the second plurality of adjacent pouches drop down to the first position after all of the first pouches are used.

FIGS. 68-71 show an alternative suction device used to open the top of the pouch.

FIGS. 72-78 show an alternative method used to increase throughput by pulling the second pouch down to the ready position while the first pouch is being opened and filled.

Similar numerals refer to similar parts throughout the drawings.

DETAILED DESCRIPTION OF THE PREFERRED EMBODIMENT

The pouch handling apparatus of the present invention is indicated generally by the numeral 100 in the accompanying drawings. Apparatus 100 provides an exemplary apparatus of how the apparatus and methods of the present invention may be used in combination. Other apparatus may also be used to perform the methods described and claimed in this application. The exemplary apparatus 100 generally includes a pouch magazine 102 that holds a plurality of adjacent pouches (a stack of pouches) 104 in a ready position. These pouches do not necessarily include wicket rod holes and the pouches are stacked on top of each other when delivered to the location where each pouch will be filled and sealed. Plurality of adjacent pouches 104 is wedge-shaped when the pouches include a closure device 106. Apparatus 100 also includes a pouch separator 108 that cooperates with magazine 102 to remove only the first pouch 110 from plurality of adjacent pouches 104 without upsetting the position of the second pouch 112 so that second pouch 112 may be properly positioned as the first pouch for the next pouch separation action of separator 108. Apparatus 100 further includes a pouch opener 114 and a shuttle 116 that moves pouches to a filling station 118 and a transfer arm mechanism 120 that moves filled pouches to a sealer 122.

Figure 1:
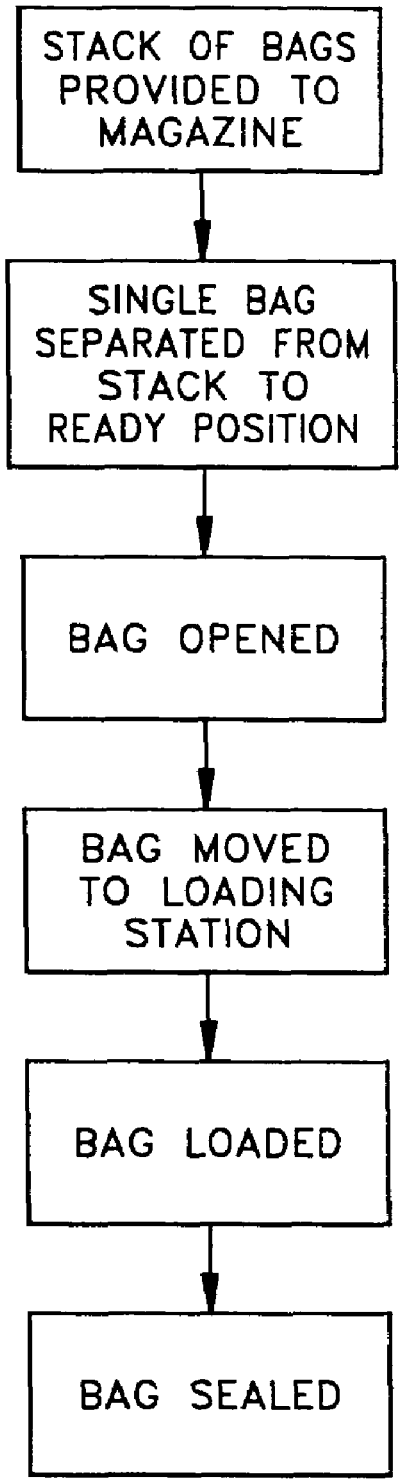
FIG. 1 is a flow chart showing the general steps performed by one embodiment of the apparatus of the invention.
Figure 2:
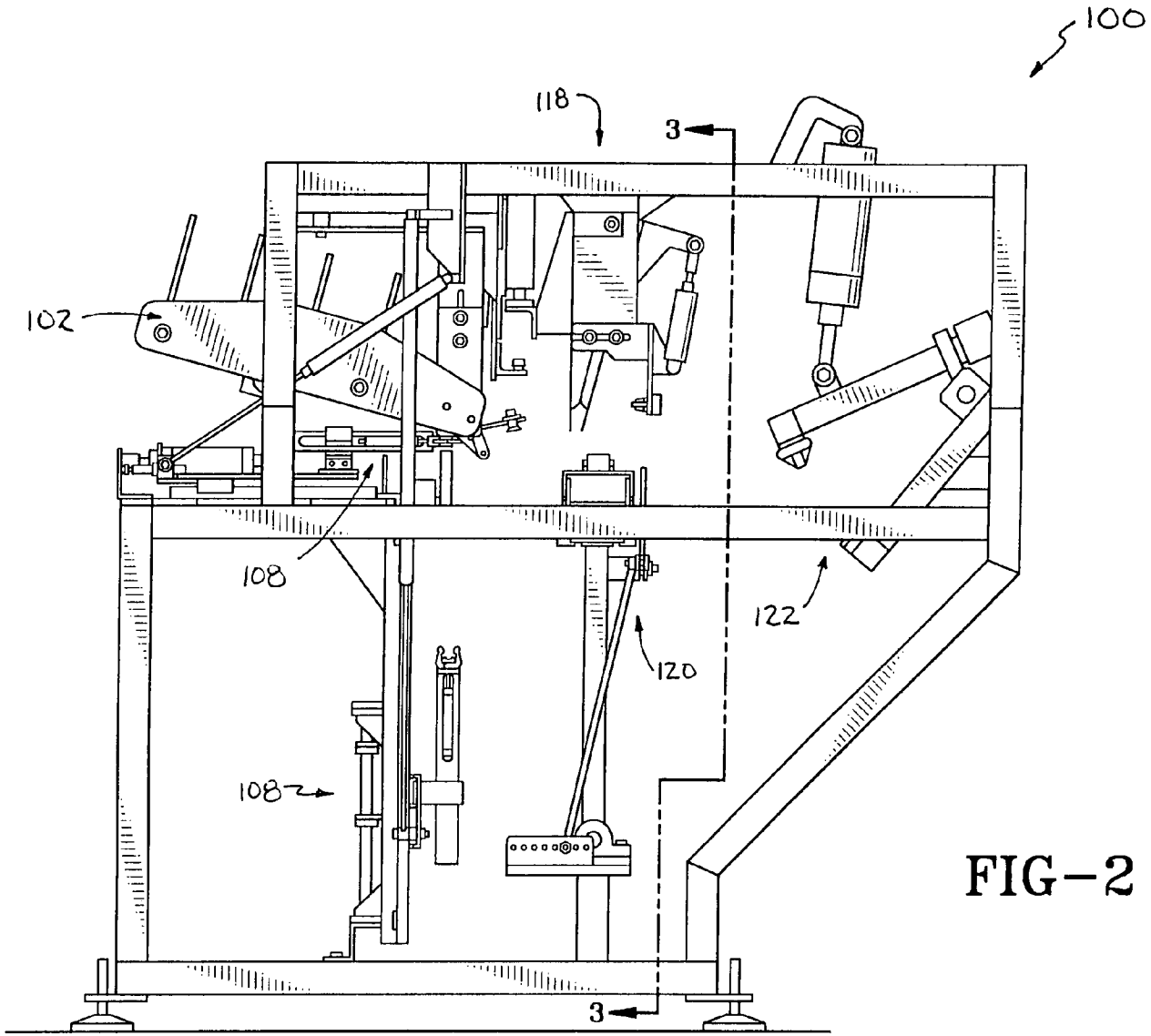
FIG. 2 is side elevation view of one embodiment of the apparatus of the present invention.
Figure 3:
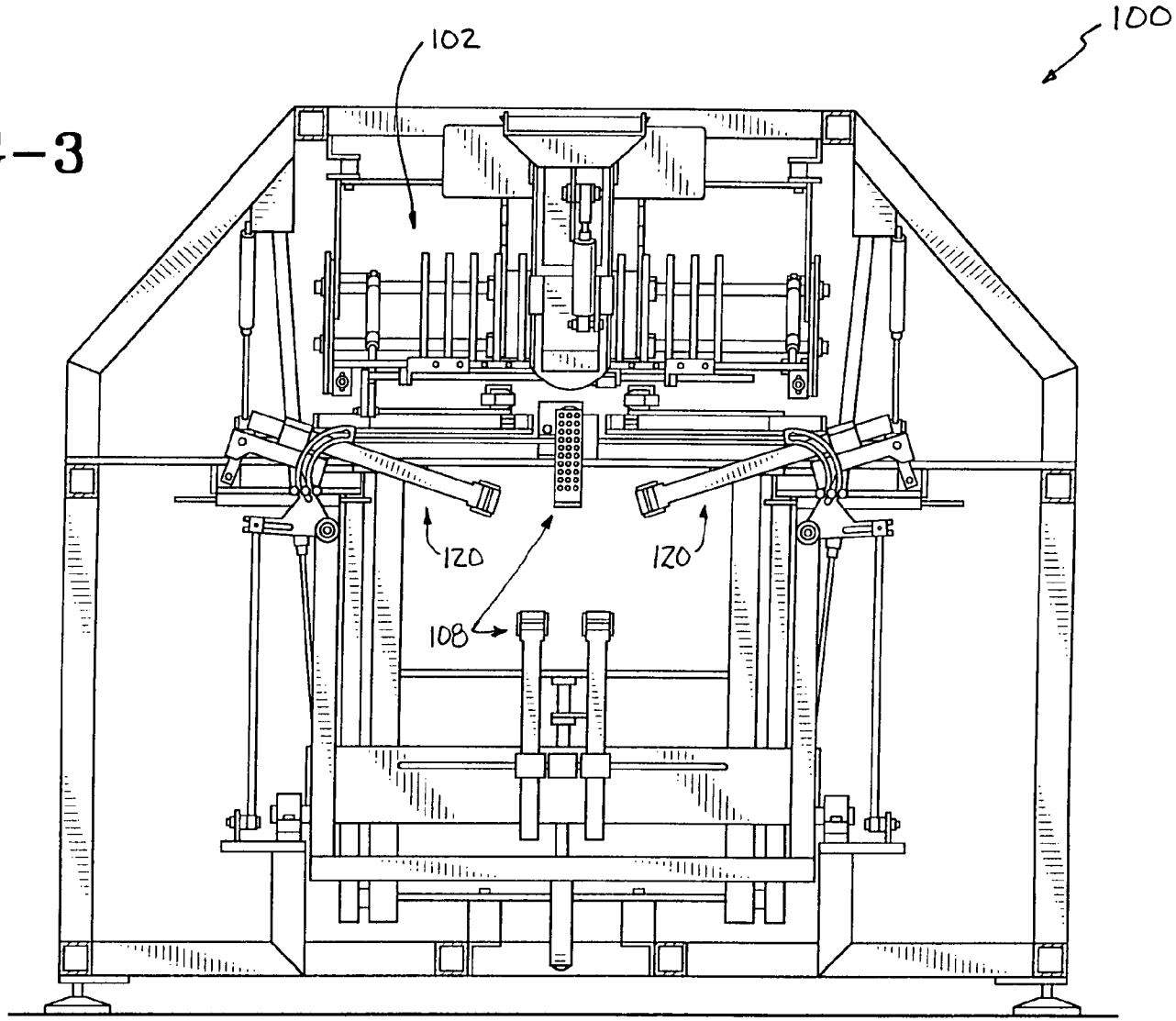
FIG. 3 is a rear elevation view shown from the right side of FIG. 2.
Figure 4:
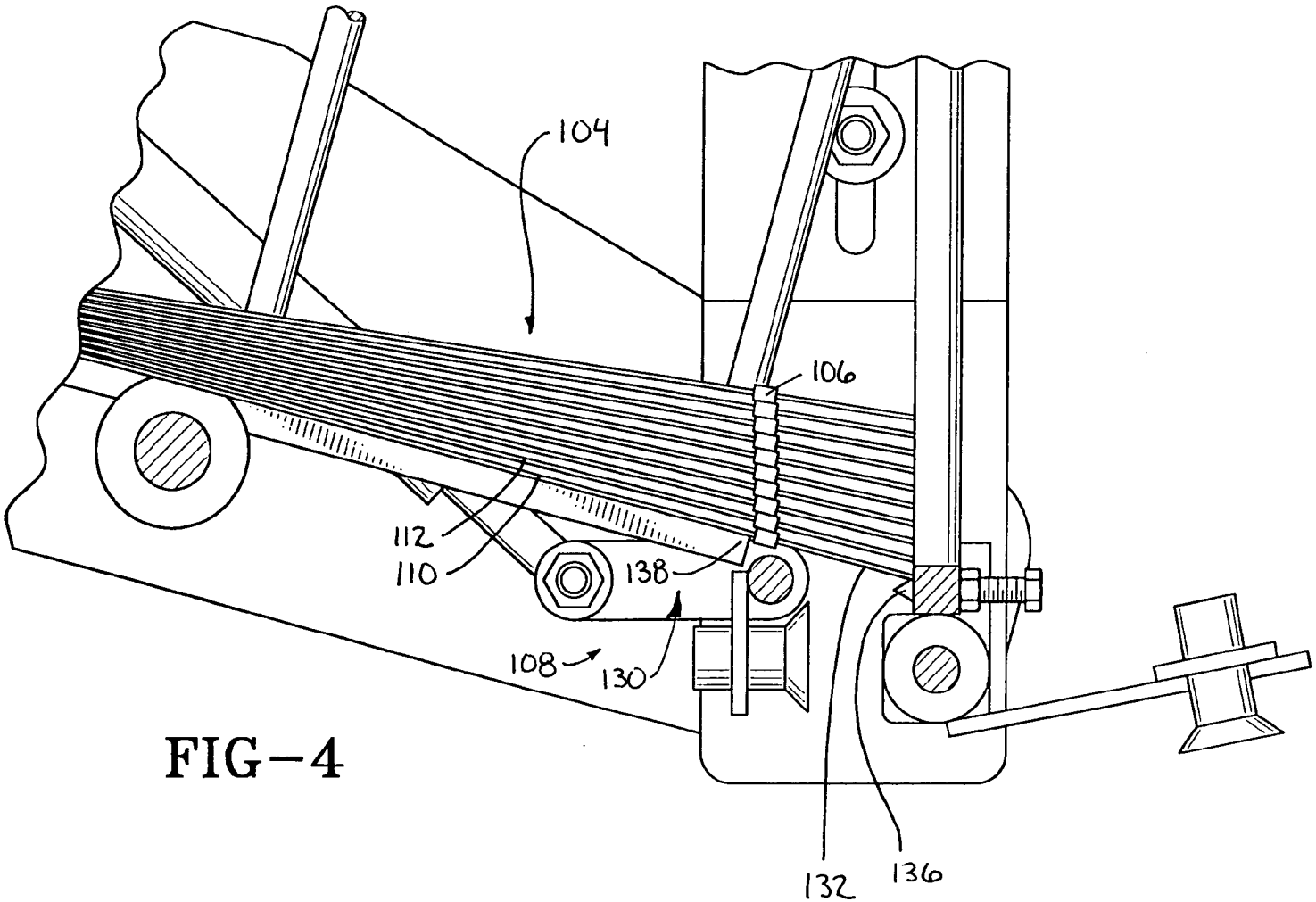
FIG. 4 is side view of the front of the pouch magazine with the pouch separation arm in a first position.
Figure 5:
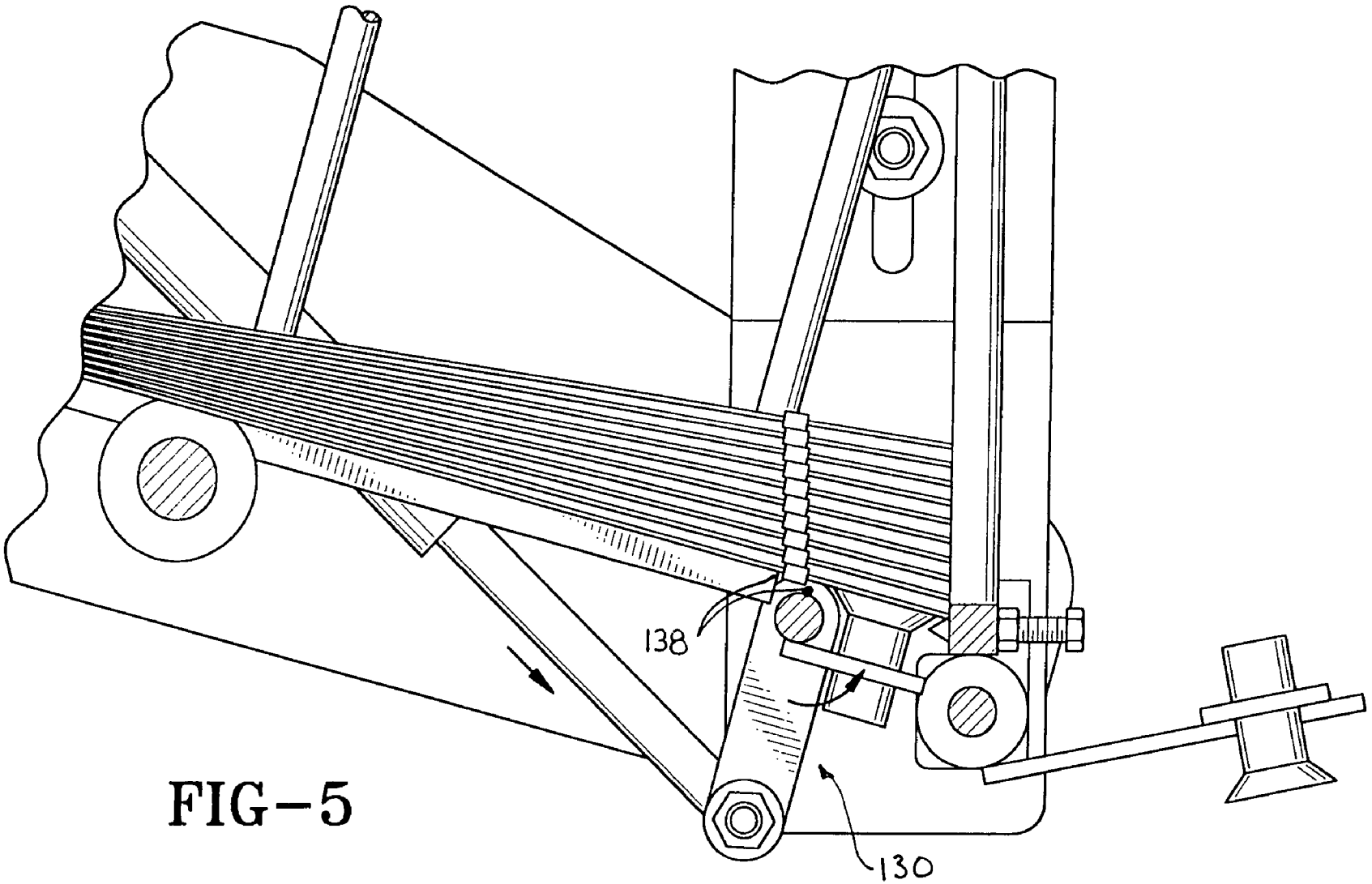
FIG. 5 is a view similar to FIG. 4 with the pouch separation arm in a second position.
Figure 6:
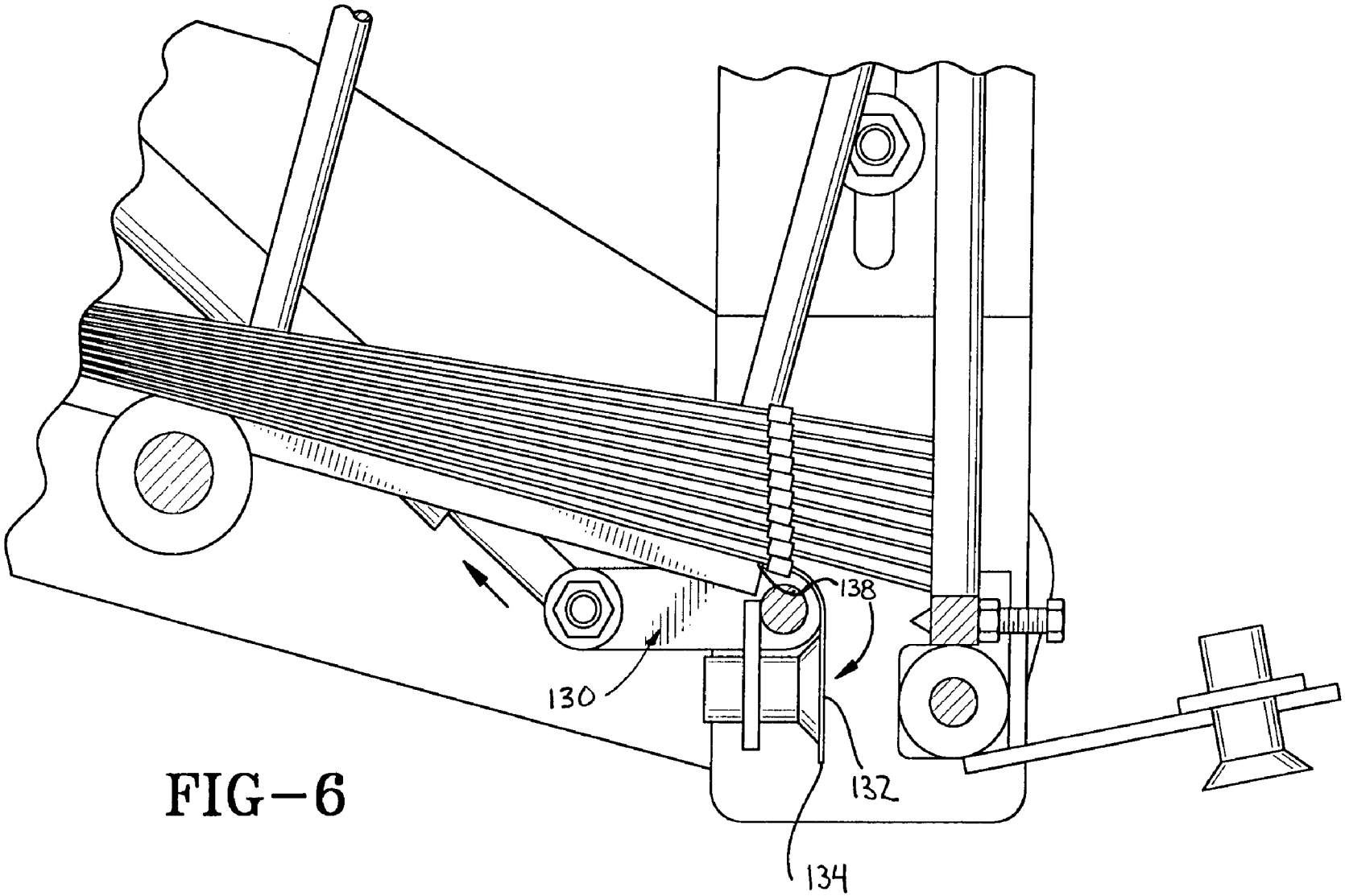
FIG. 6 is a view similar to FIG. 4 with the pouch separation arm back in the first position having separated a pouch from the stack of pouches.

The method for removing first pouch 110 from plurality of adjacent pouches 104 is generally described with reference to FIGS. 4-9. FIGS. 4 and 5 show a separation arm 130 that engages a first body portion such as an edge 132 of first pouch 110 in order to pivot or bend the first body portion away from second pouch 112 about an axis as shown in FIG. 6. The axis is disposed intermediate the outer edges of the second pouch. For the purpose of separating the pouches, edge 132 may be any of the edges of the pouches. In the exemplary apparatus 100, edge 132 is adjacent closure 106 opposite from the open end of the pouch that is used to fill pouch. Bending this edge allows the spacing created by closure 106 to help separate the pouches. Bending edge 132 away from the reference plane defined by second pouch 112 allows most joining (e.g. static, cohesion, intermolecular) forces between first 110 and second 112 pouches to be overcome without significant movement or manipulation of second pouch 112. This method is also described as peeling edge 132 of first pouch 110 from second pouch 112. The axis about which the edge is bent is disposed parallel to the reference plane. In one configuration, edge 132 should be bent at least 30 degrees from the reference plane of second pouch 112 to ensure good separation. The leading end 134 of first pouch 110 may be pulled over a static stop 136 that helps prevent second pouch 112 from bending with first pouch 110 to the bent position of FIG. 6. Applying a vibrational force to magazine 102 may also help position pouches 110 and 112 within magazine 102.

Figure 7:
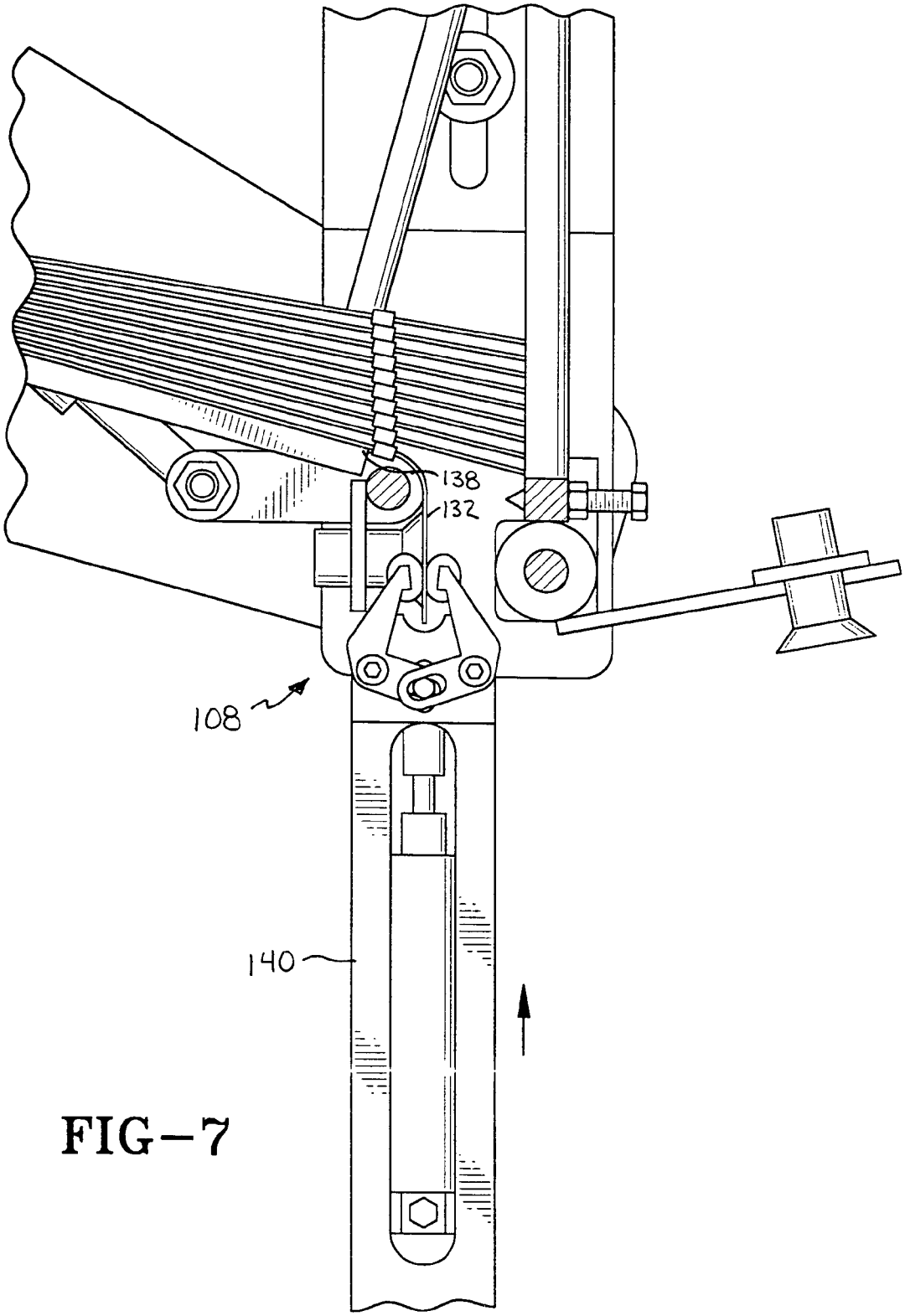
FIG. 7 is a view similar to FIG. 4 showing a pouch removal arm in a second position grabbing the separated pouch.
Figure 8:
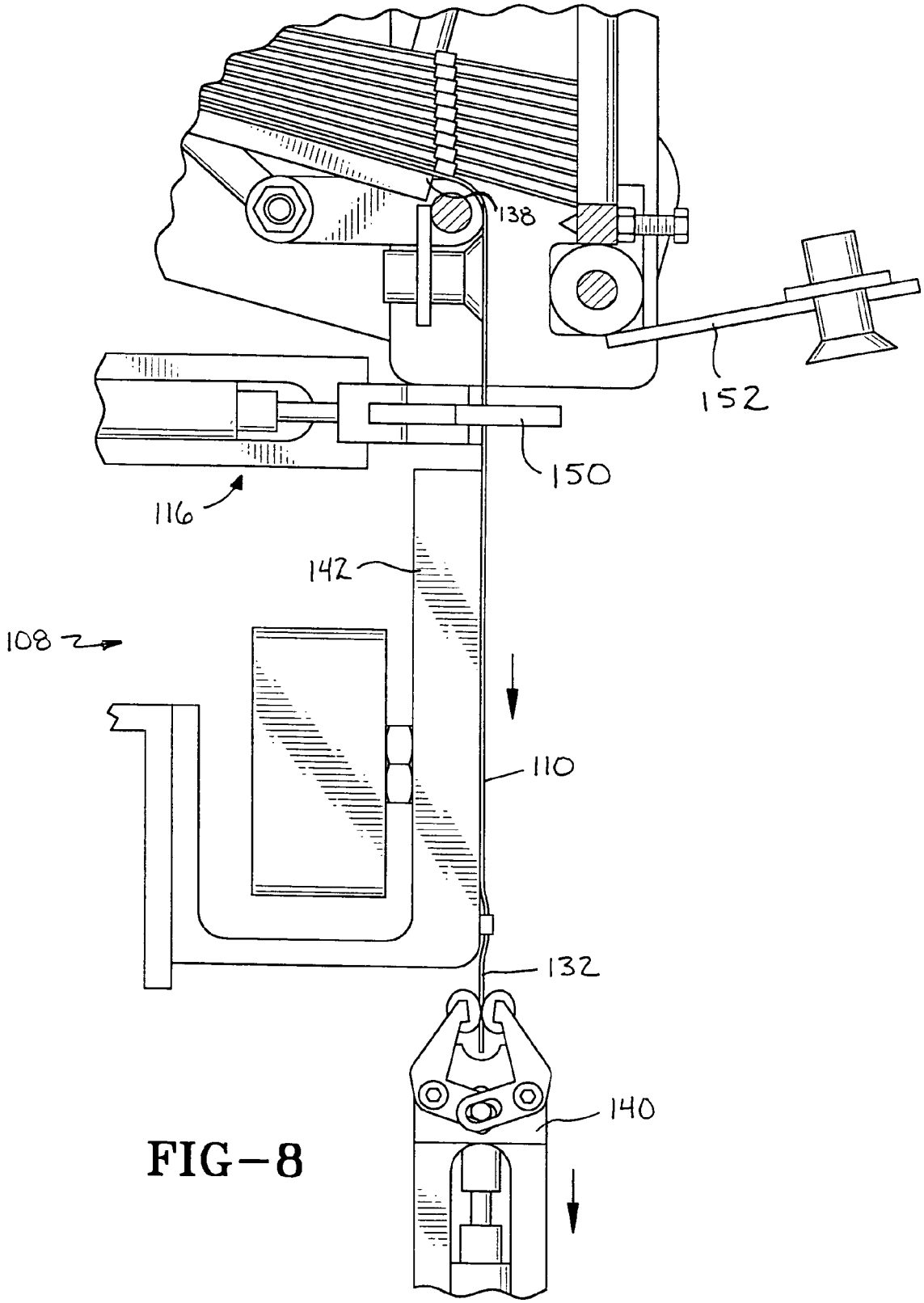
FIG. 8 is a side view showing the pouch removal arm moving from the second position toward its first position to pull the pouch to a pouch holder.
Figure 9:
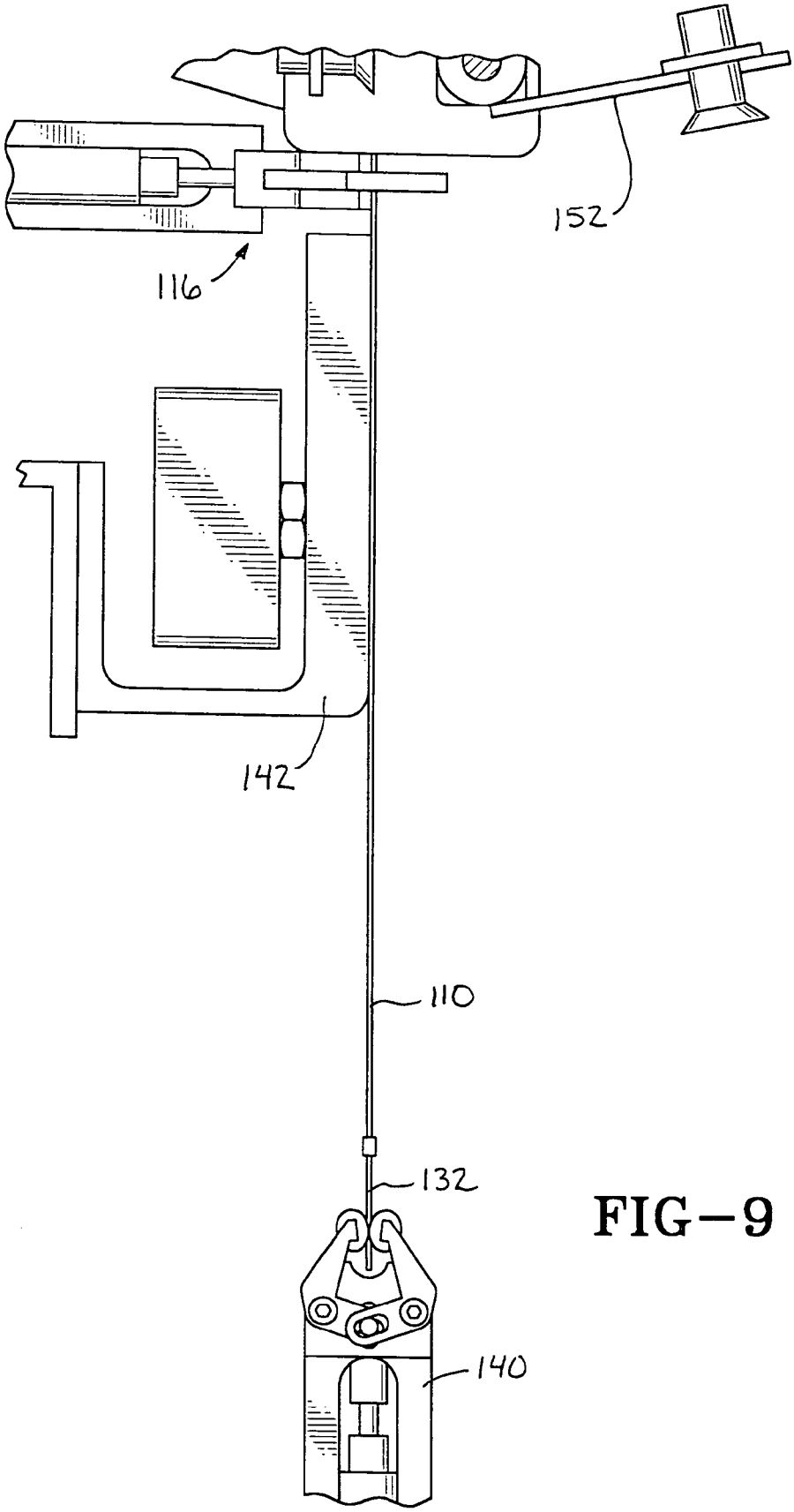
FIG. 9 is a view similar to FIG. 8 showing the pouch completely removed from the pouch stack and held by the pouch holder.

FIGS. 7-9 show the next step wherein first pouch is pulled out from under second pouch 112 by a pouch removal arm 140 that pulls pouch 110 in a direction nonparallel to the reference plane of the second pouch. As first pouch 110 is pulled out of magazine 102, the body of pouch 110 remains in its own reference plane until the body reaches the edge 138 (edge 138 may be a curved mandrel or a portion of separation arm 130) over which edge 132 is bent. Any forces imparted to second pouch 112 during the removal of first pouch 110 are counteracted by the supports of magazine 102 which are disposed around the sides of second pouch 112 to hold it in position. As first pouch 110 is pulled from magazine 102, it slides over a pouch holder 142 that helps maintain the upright configuration of first pouch 110 so that it may be engaged by shuttle 116. Holder 142 may hold pouch 110 in its upright position by applying a vacuum flow to first pouch 110.

Figure 10:
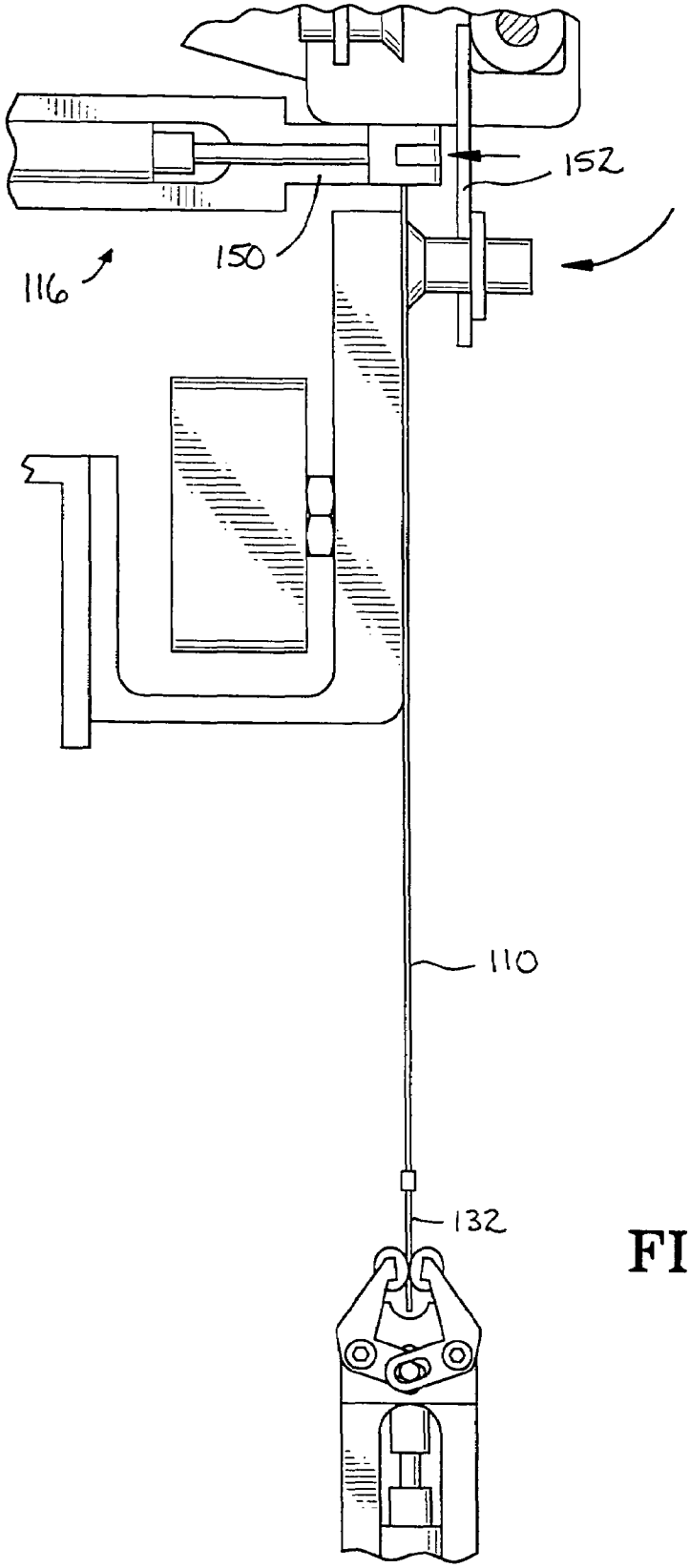
FIG. 10 is a view similar to FIG. 9 showing an opening arm moved to its second position to engage the pouch.
Figure 11:
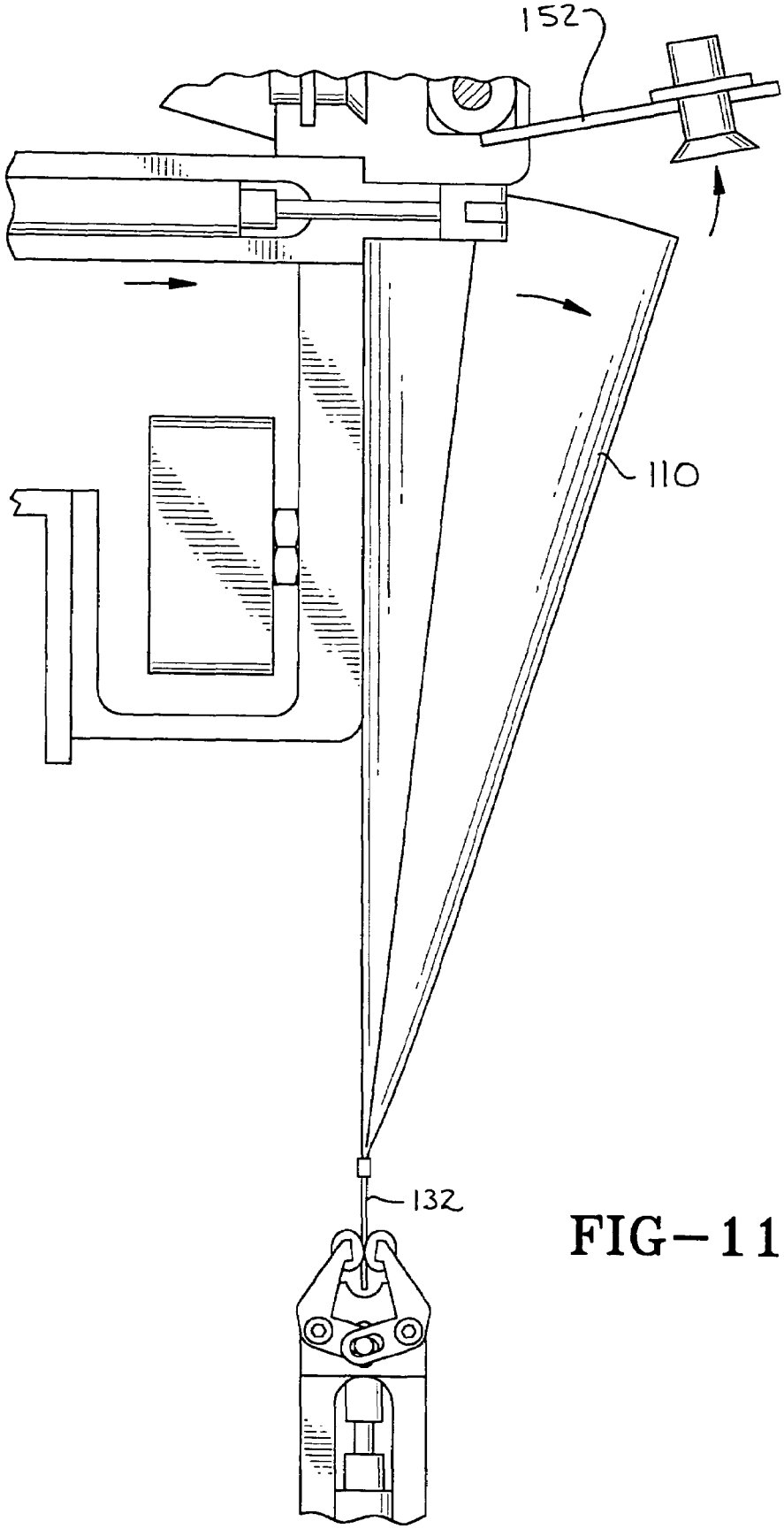
FIG. 11 shows the pouch being opened with the opening arm.
Figure 12:
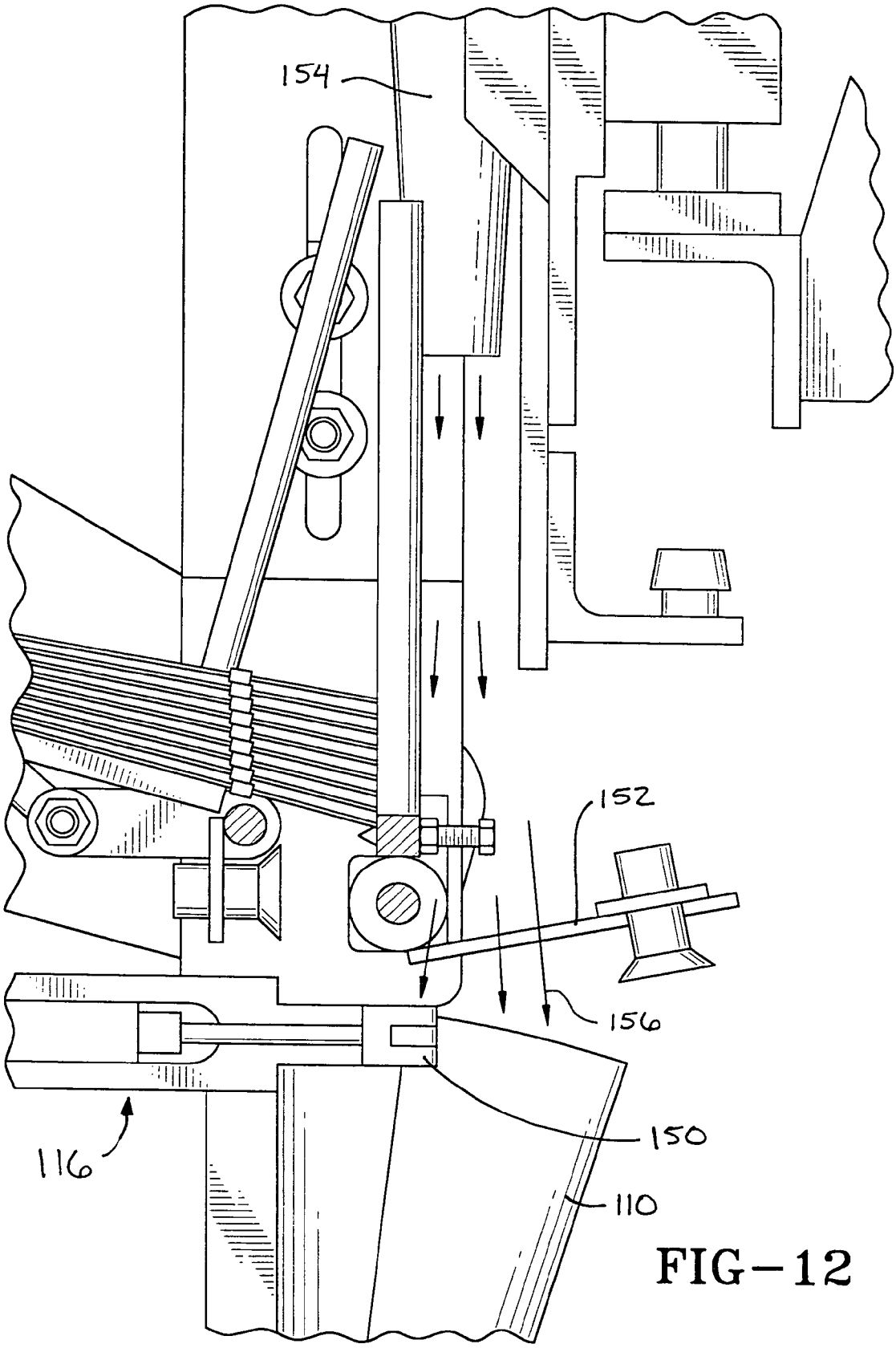
FIG. 12 shows the pouch being opened with air.
Figure 13:
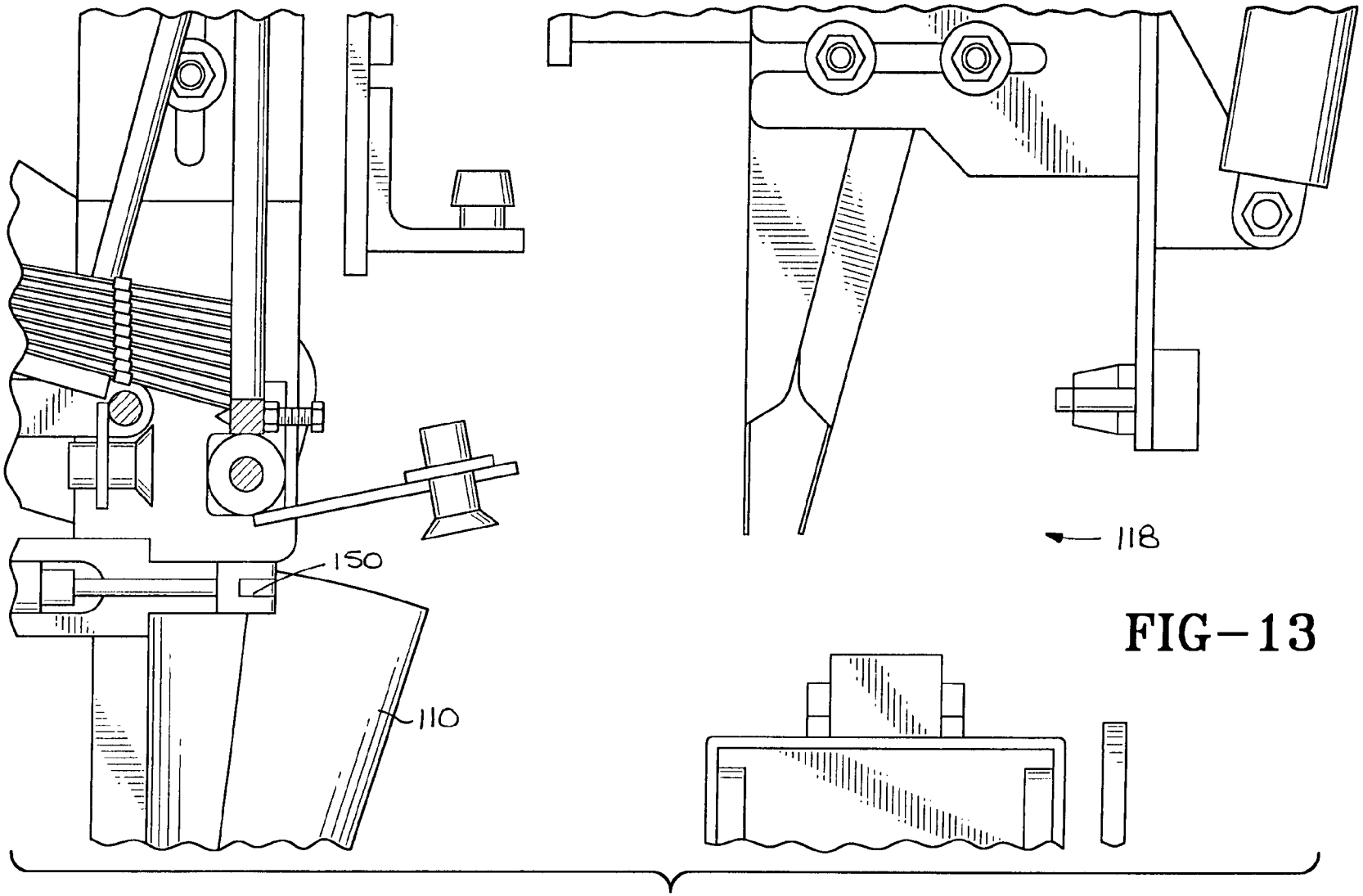
FIG. 13 is a side view showing the loading funnel.

FIGS. 10-12 show pouch 110 being opened. Opposite portions of pouch 110 are first engaged by shuttle arms 150. An opening arm 152 then engages the front of pouch 110 as shown in FIG. 10 and moves away from pouch 110 as shown in FIG. 11 to pull open pouch 110. Opening arm 152 may apply a vacuum force to pull pouch 110 open. In addition, an air knife 154 may direct a burst of air 156 (FIG. 12) to help open pouch 110. While moving away, arm 152 releases pouch 110 and moves out of the way so that open pouch 110 may be transferred to filling station 118. Arms 150 may move out from their initial position as shown in FIG. 12 to help open pouch 110. These opening steps may occur directly below the pull down location for pouch 110 that is shown in the drawings. In an alternative embodiment, pouch 110 is moved forward from the pull down location with arms 150 so that second pouch 112 may be pulled down by arm 140 while pouch 110 is being opened and filled.

Figure 14:
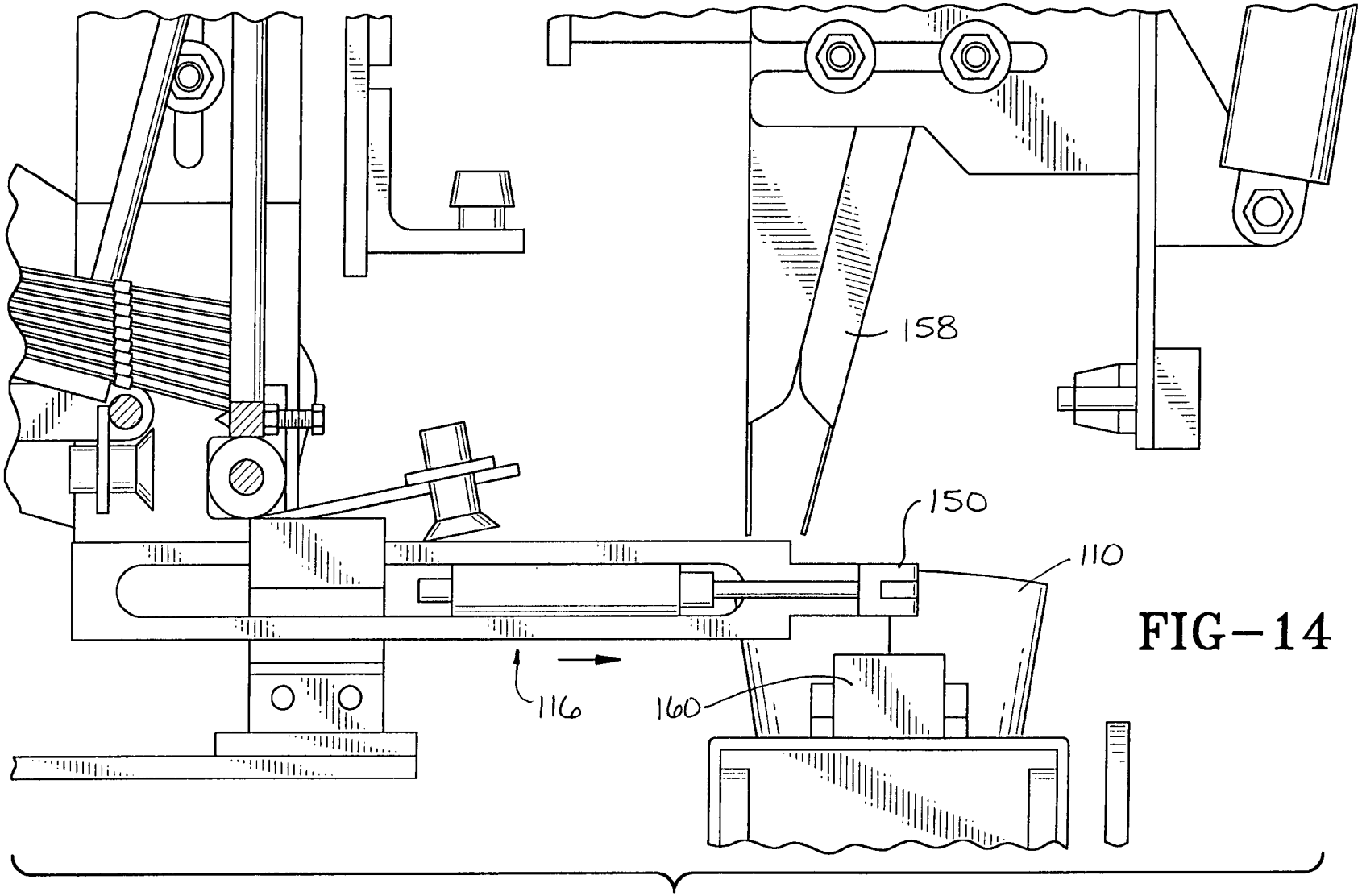
FIG. 14 is a side view showing the opened pouch presented to the loading funnel.
Figure 15:
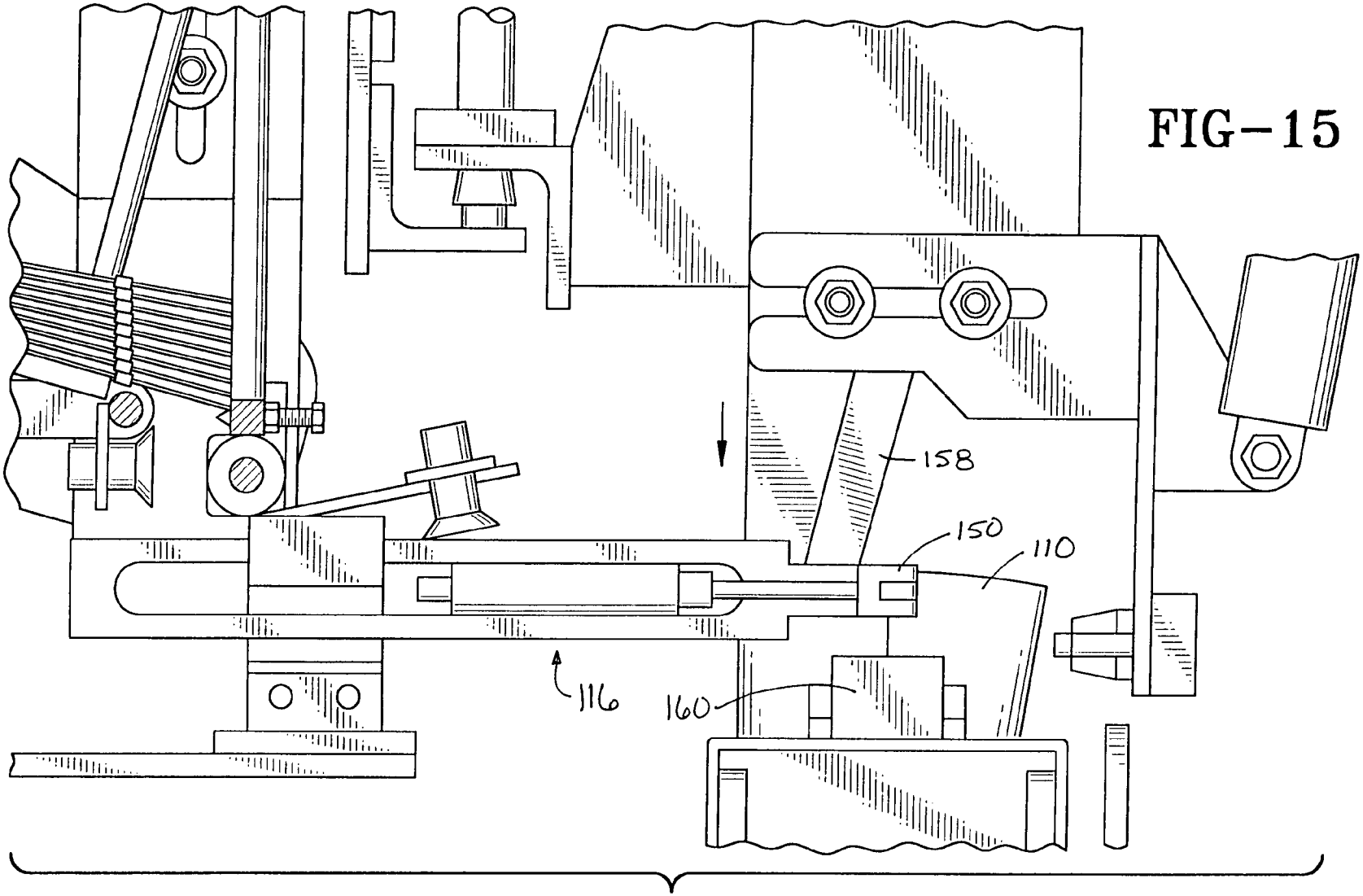
FIG. 15 is a side view showing the loading funnel inserted in the pouch while the pouch is still held by the pouch holder.
Figure 16:
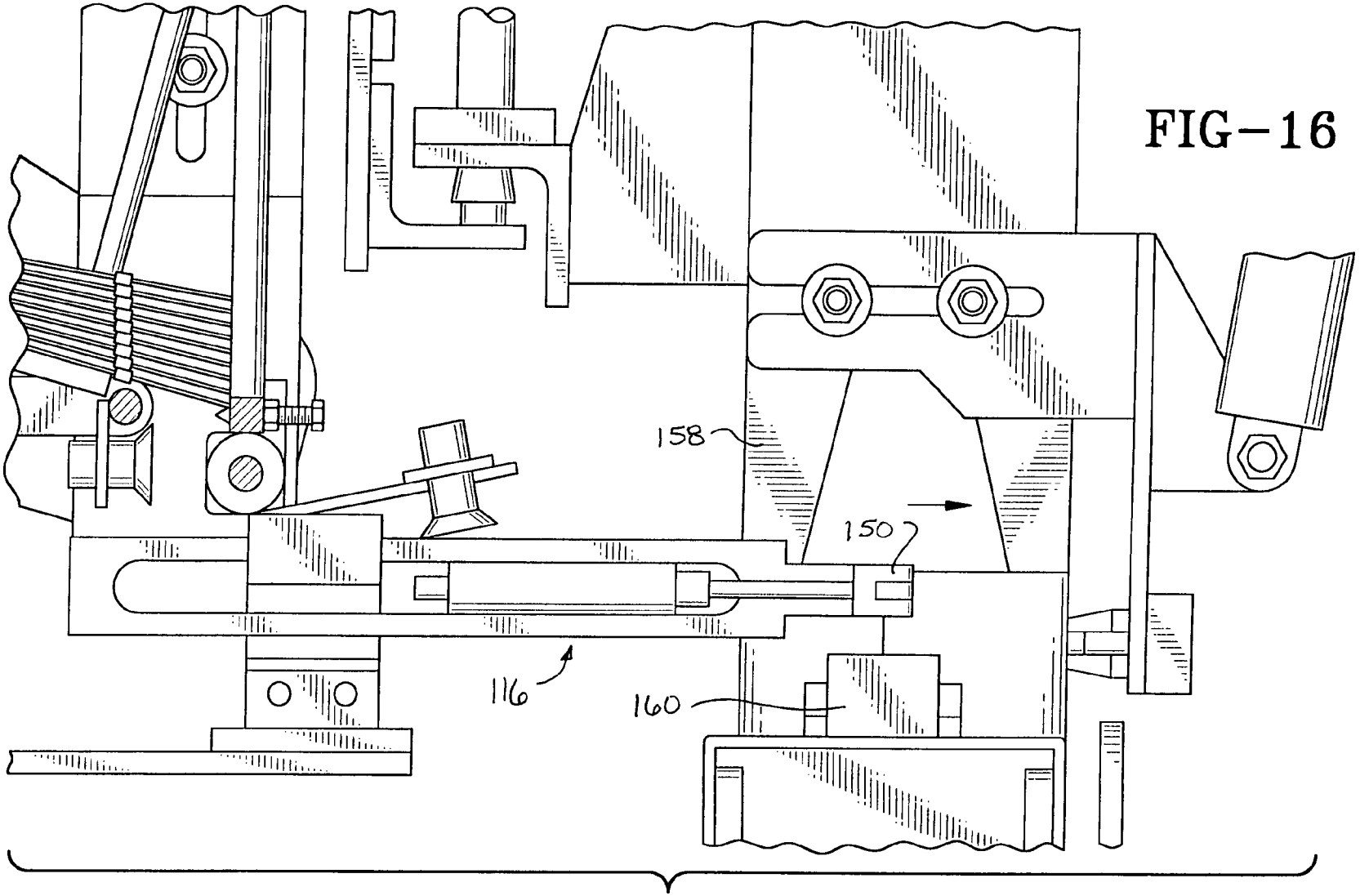
FIG. 16 is a side view showing the loading funnel opened in the pouch while the pouch is still held by the pouch holder.
Figure 17:
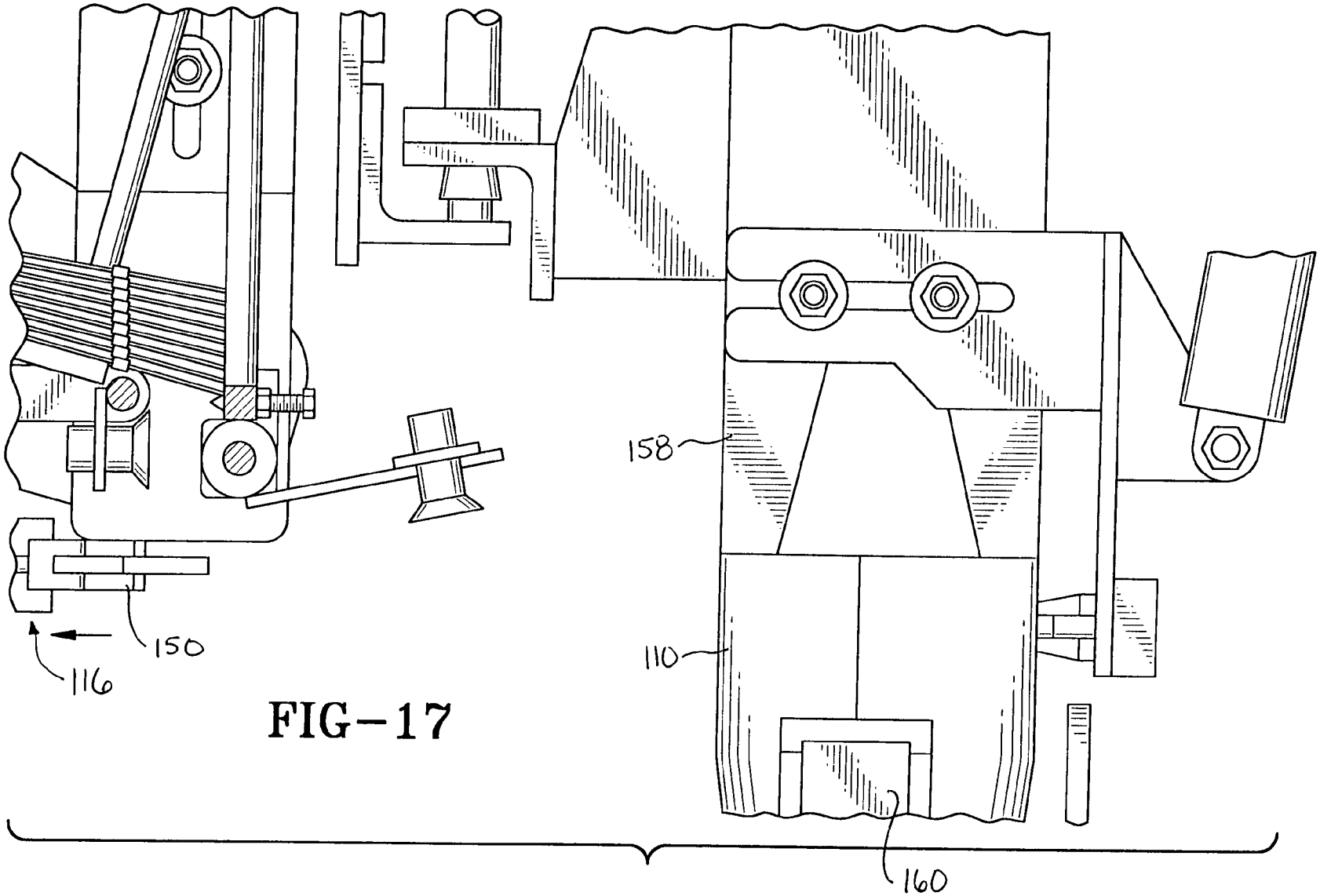
FIG. 17 shows the retraction of the pouch holder.

FIGS. 13-18 show one configuration of how pouch 110 is moved to filling station 118 and filled with the product that is being placed in pouch 110. In other configurations, pouch 110 may be moved laterally to the configuration depicted in the exemplary drawings. Shuttle 116 moves open pouch 110 to a location below a funnel 158 disposed at filling station 118. A pair of transfer arms 160 move in and engage opposite portions of pouch 110 while pouch 110 is still engaged by shuttle arms 150 as shown in FIG. 14. Funnel 158 then moves into open pouch 110, pivots open, and product is loaded into pouch 110. Once pouch 110 is held by both funnel 158 and arms 160, shuttle 116 releases pouch 110 and moves back to pick up second pouch 112 as shown in FIG. 17. In the alternative embodiment, second pouch 112 has been pulled down from magazine 102 and is ready to be engaged by shuttle 116.

Figure 18:
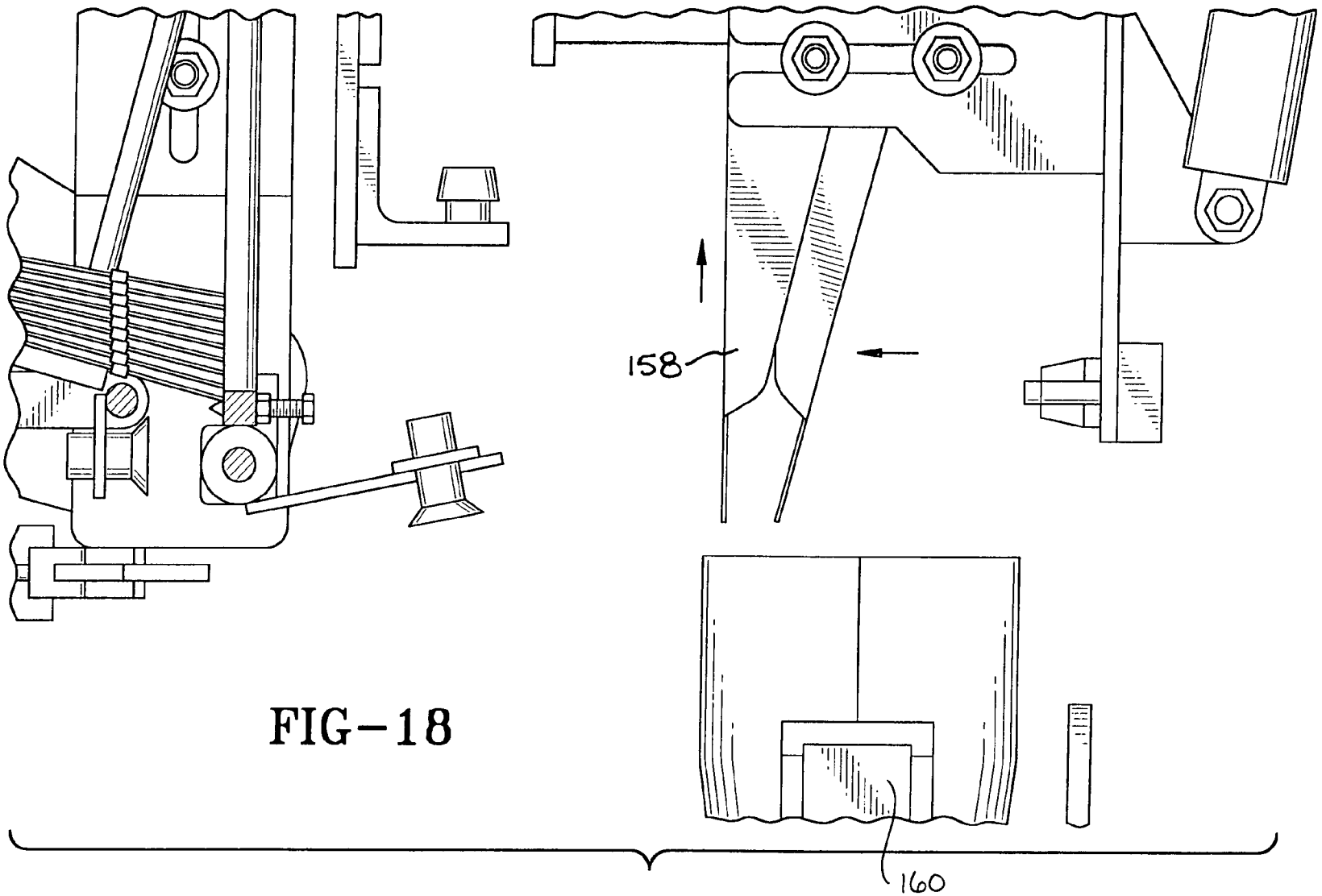
FIG. 18 shows the retraction of the loading funnel.
Figure 19:
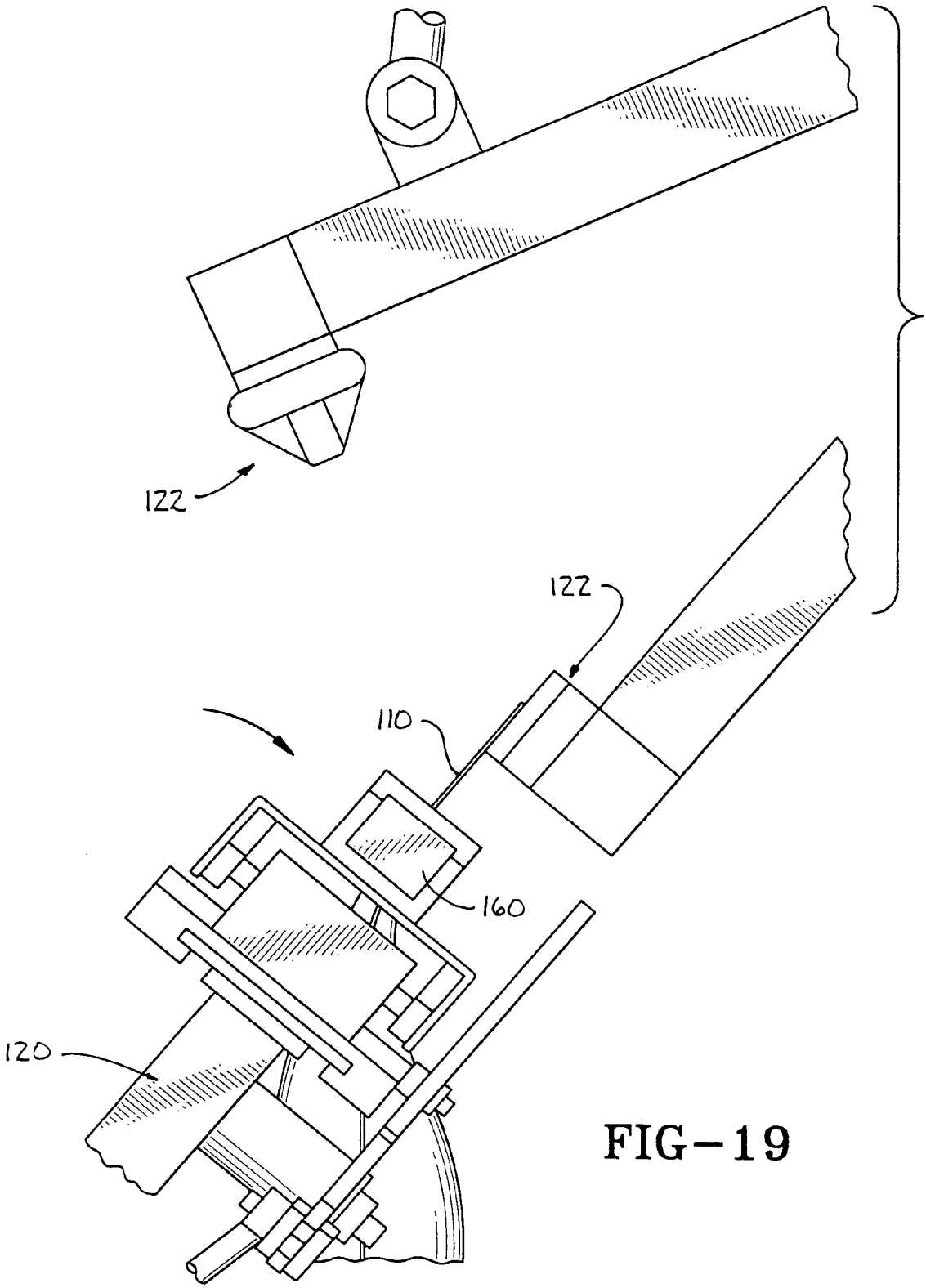
FIG. 19 shows the delivery of the loaded pouch to the sealer.
Figure 20:
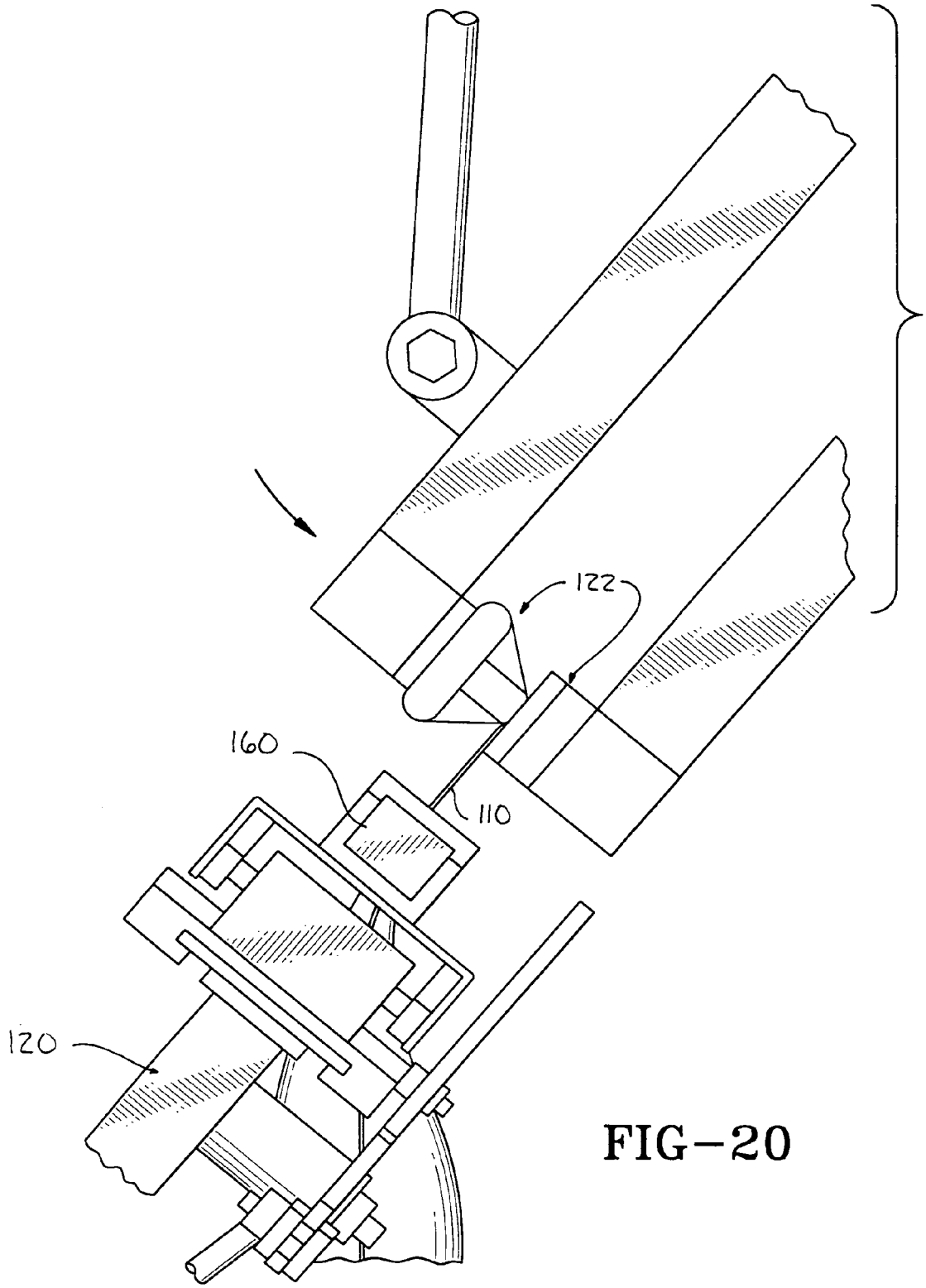
FIG. 20 shows the loaded pouch being sealed.

As shown in FIGS. 18-20, funnel 158 is then removed from pouch 110 and transfer arm mechanism 120 moves filled pouch 110 to sealer 122 wherein pouch 110 is sealed.

Figure 22:
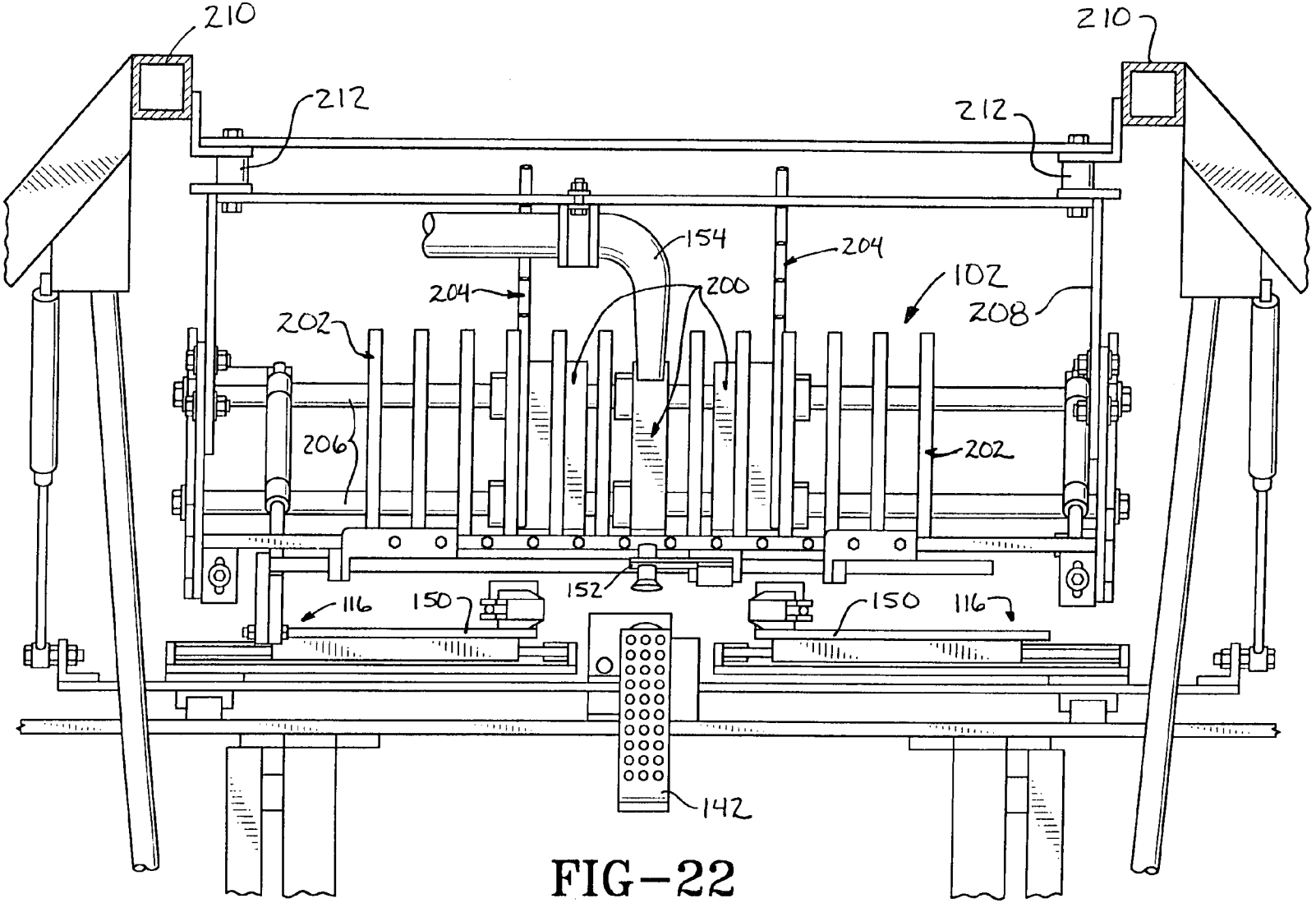
FIG. 22 is a front view of the pouch magazine.
Figure 23:
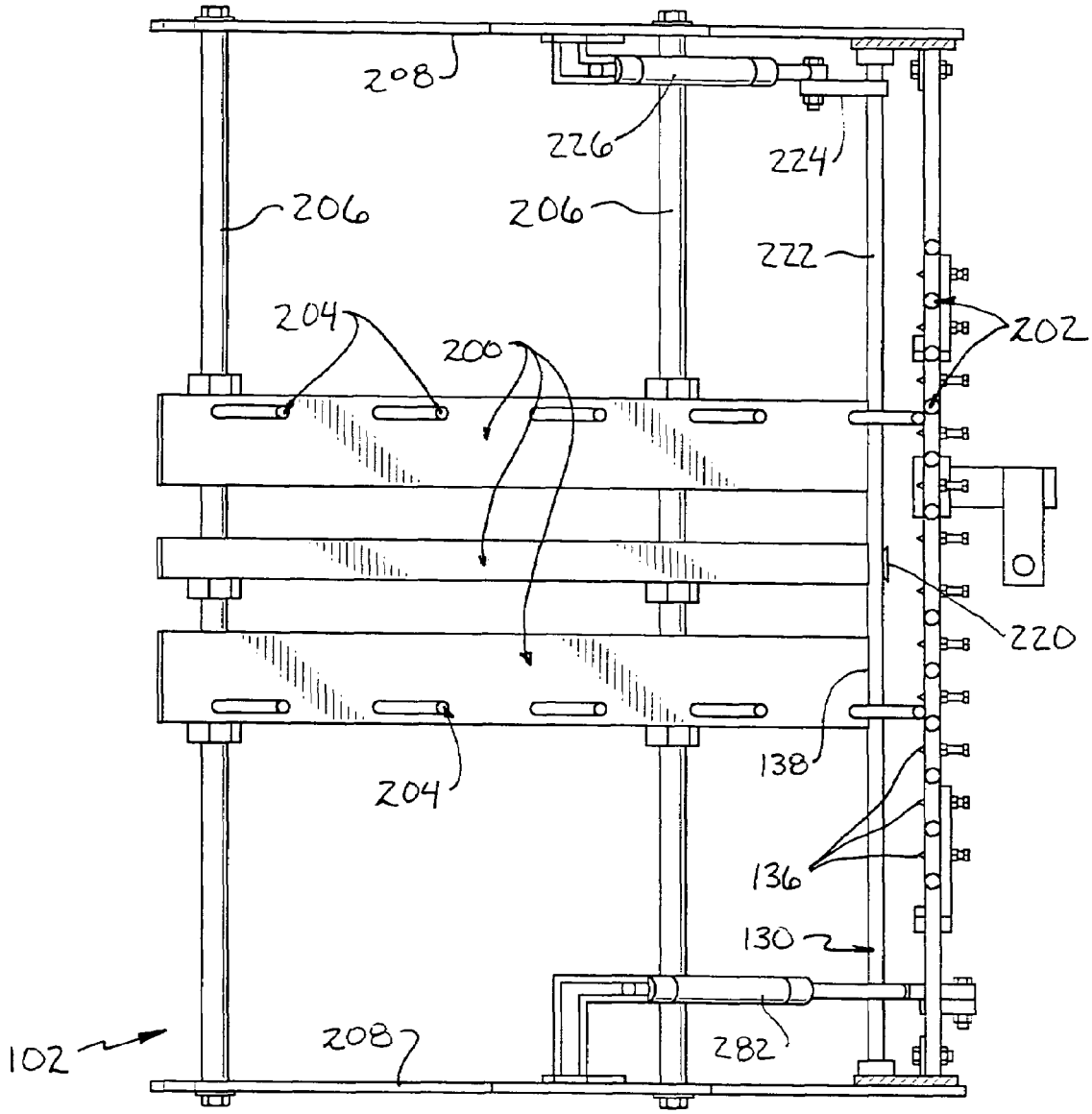
FIG. 23 is a top view of the pouch magazine shown adjusted for a first size pouch.
Figure 23A:
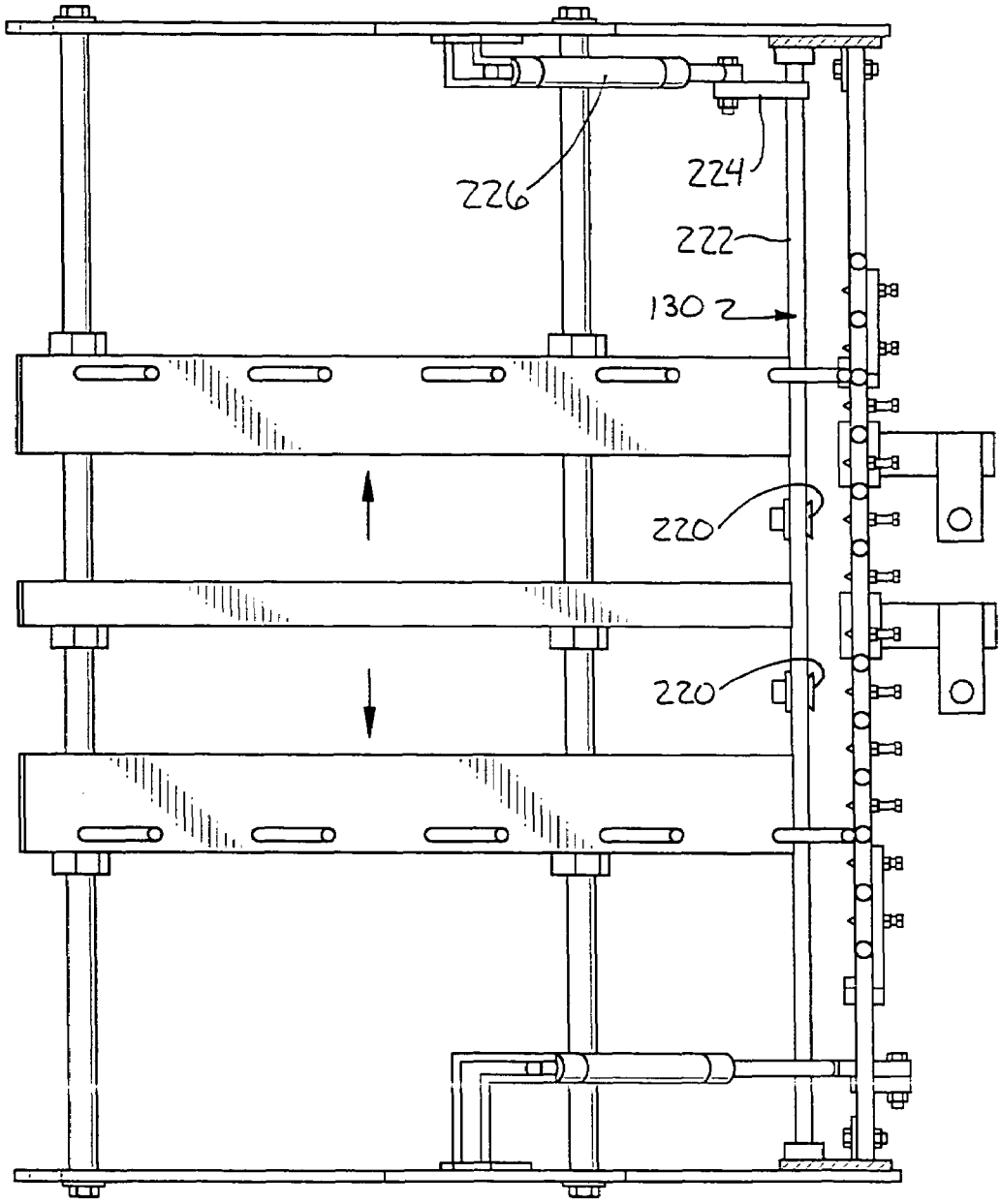
FIG. 23A is a top view of the pouch magazine shown being adjusted for a second size pouch that is wider than the first size.
Figure 24:
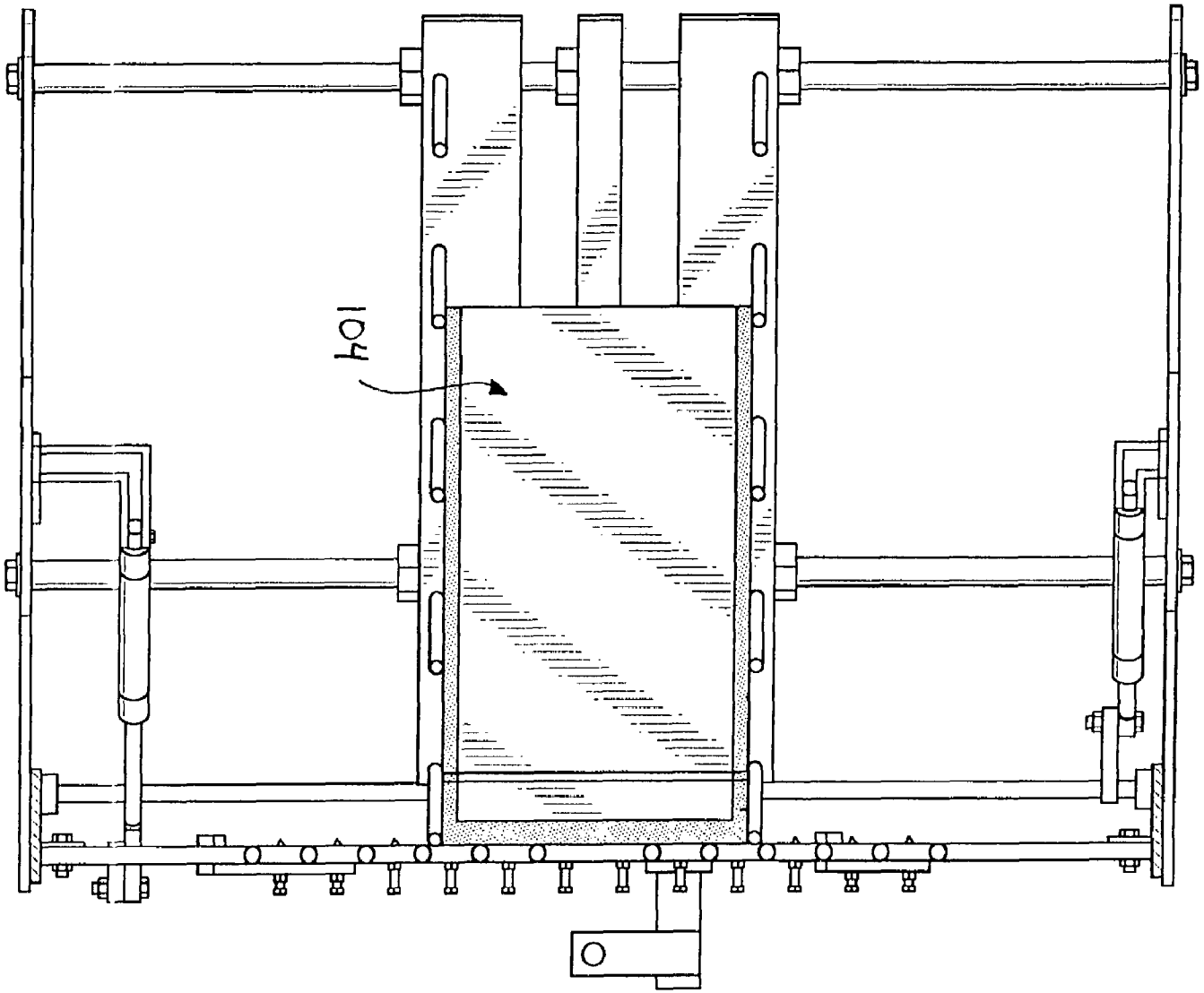
FIG. 24 is a top view of the pouch magazine shown with a plurality of pouches loaded into the magazine.
Figure 25:
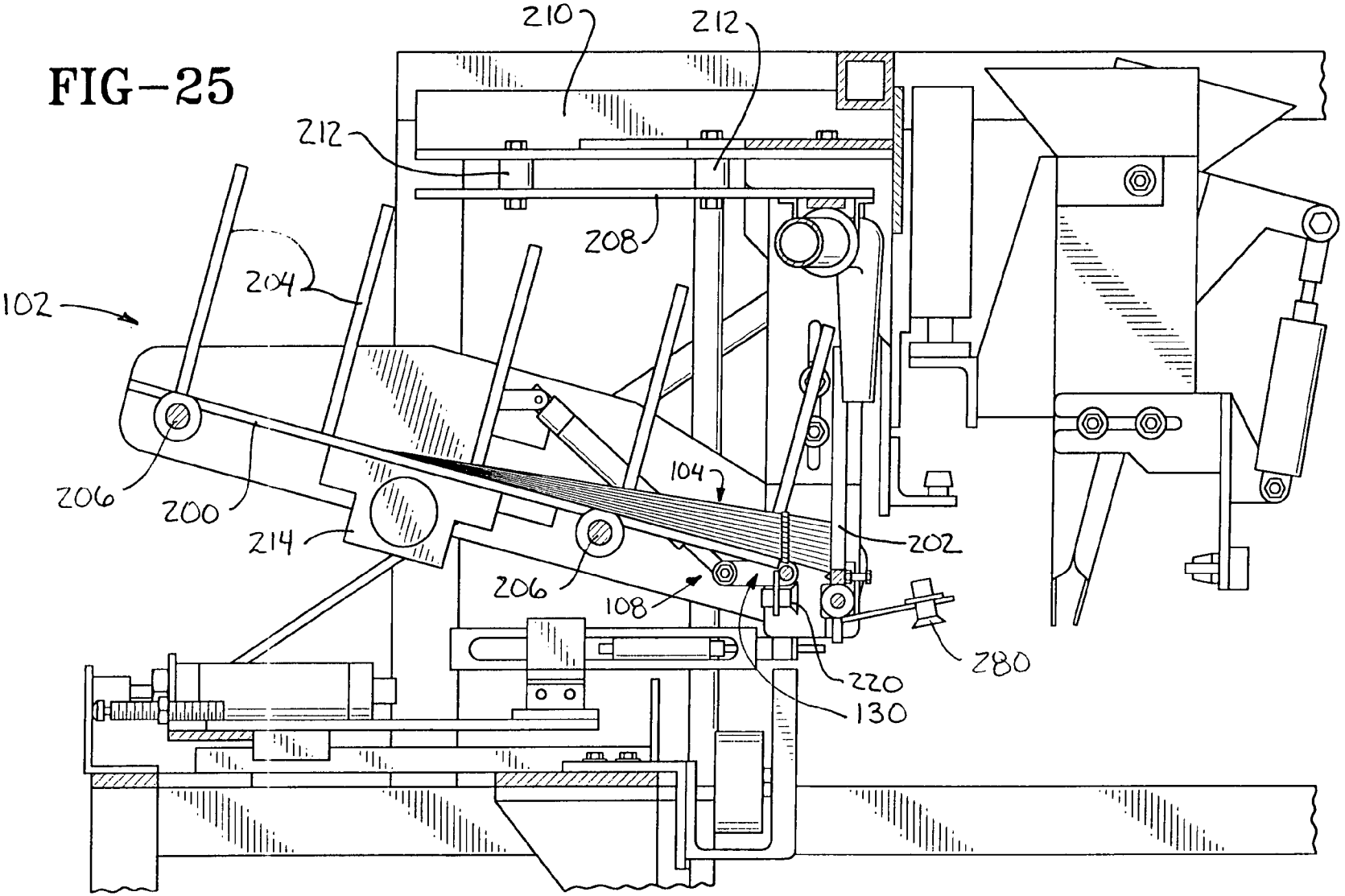
FIG. 25 is a side view similar to FIG. 21 showing the plurality of adjacent pouches loaded into the pouch magazine.
Figure 26:
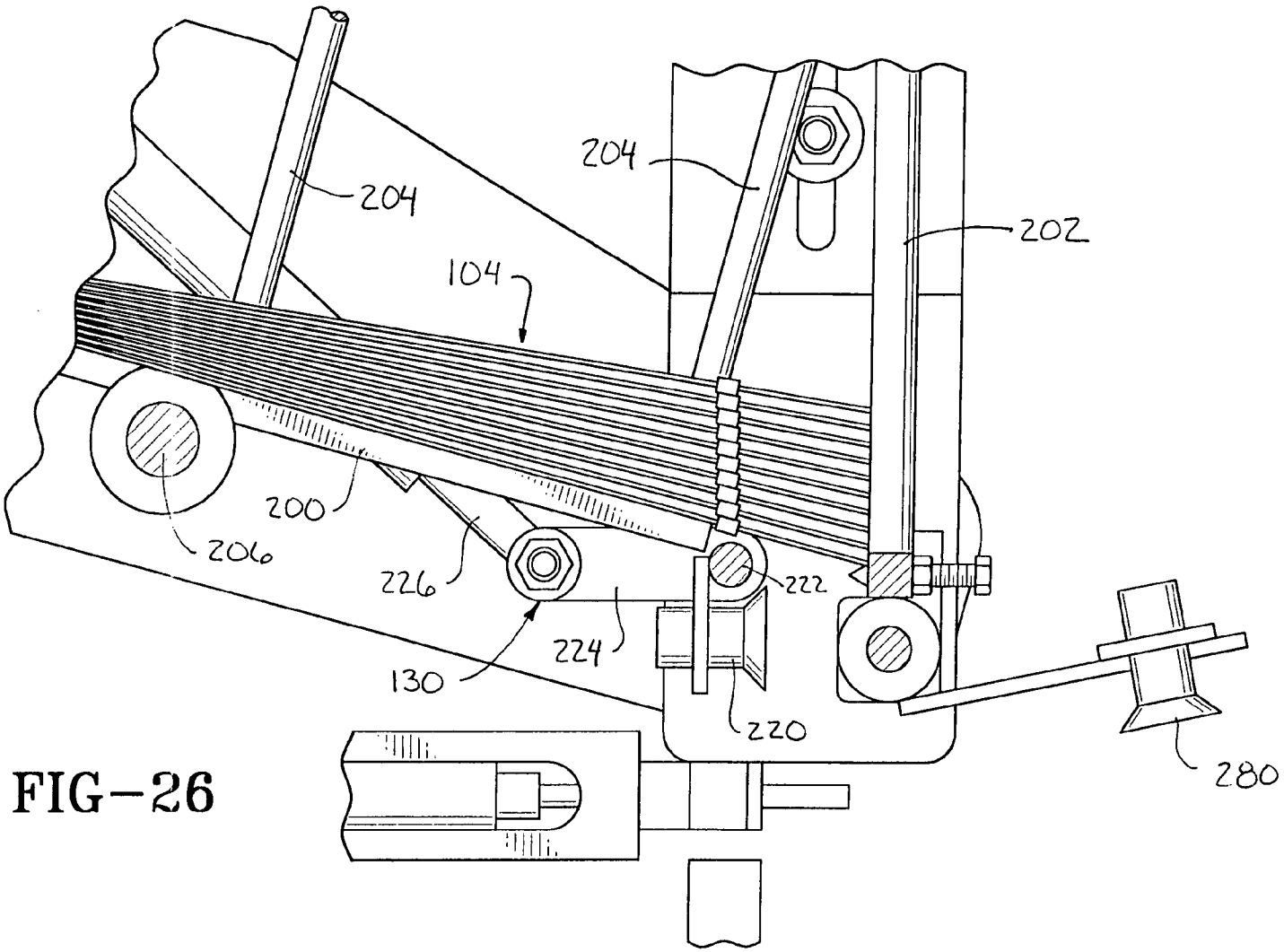
FIG. 26 is an enlarged side view of the front of the pouch magazine showing the first pouch engaging the static stop.
Figure 27:
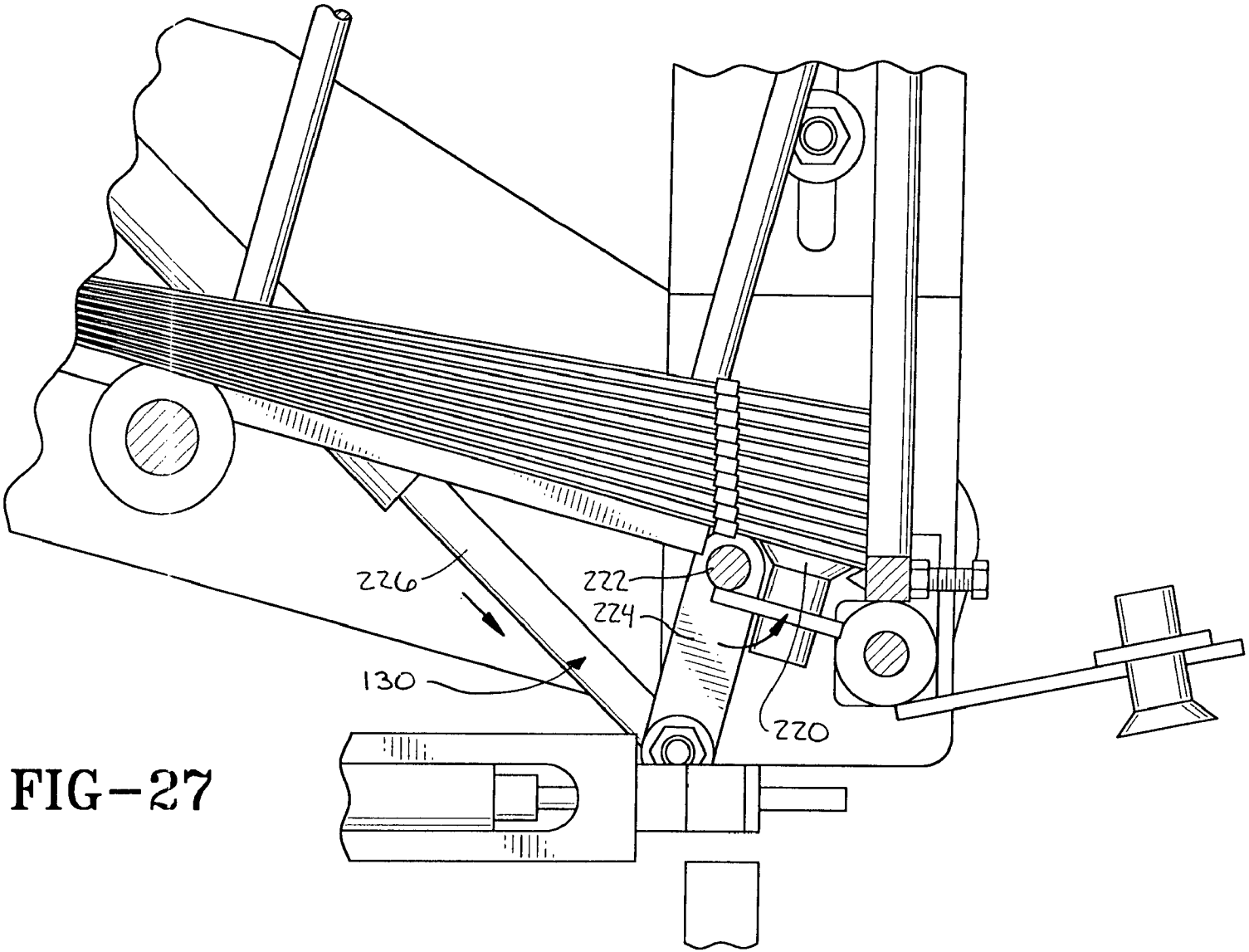
FIG. 27 is an enlarged side view of the front of the pouch magazine showing the separation device engaging the first pouch.

FIGS. 21-25 show the structure of magazine 102 and how magazine 102 may be adjusted to hold different-size pouches. As shown in FIG. 22, magazine 102 includes a lower support 200, a front support 202, and a pair of lateral supports 204. Each support 200, 202, and 204 may include a plurality of spaced support elements that minimize friction between pouches 104 and magazine 102 while also allowing a user's fingers to easily access the inside of magazine 102. Lateral supports 204 are adjustable with respect to front support 202 so that magazine 202 may be adjusted from different-size pouches as shown in FIG. 23A. Lateral supports 204 may be selectively, slidably supported on rods 206 that are, in turn, supported by a magazine frame 208. Rods 206 may include markings or stops that allow a user to readily set up magazine 102 for a pouch size that matches the markings or stops on rods 206. Magazine frame 208 is supported from the frame 210 of apparatus 100 with resilient members 212 that allow frame 208 to vibrate. A vibrator 214 carried by magazine 102 is used to impart the vibrational force to magazine 102. Each lateral support 204 may include a portion of lower support 200 with those portions moving with lateral supports 200 so that the lateral edges of pouches 104 are supported in every adjustment position of magazine 102.

Static stops 136 may be disposed at the lower end of front support 202. The position of each stop 136 is adjustable with respect to front support 202 so that the force required to overcome stops 136 may be tuned for different pouch stiffnesses.

Figure 28:
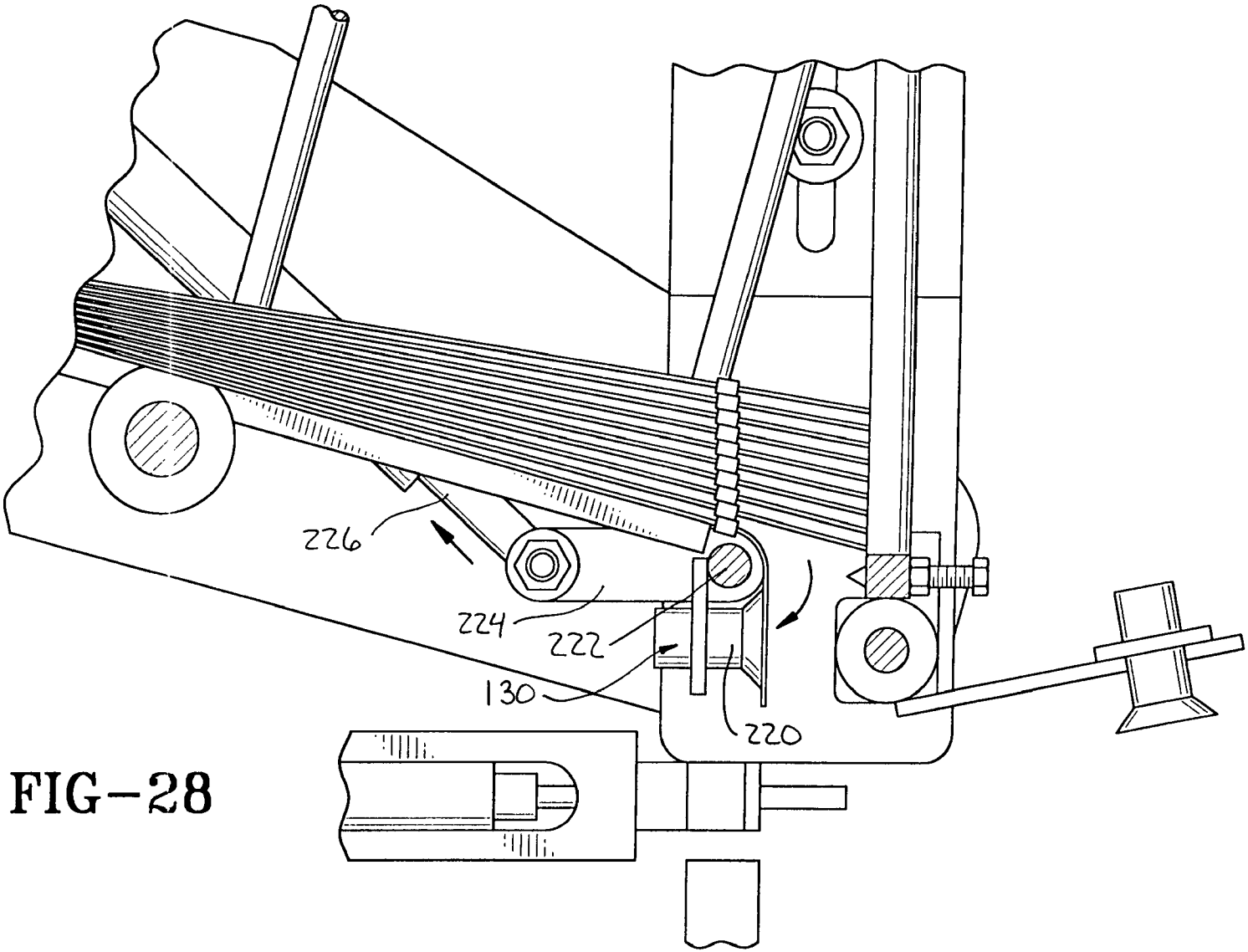
FIG. 28 is an enlarged side view of the front of the pouch magazine showing the separation device bending the front edge of the first pouch over the mandrel to form a bent edge of the first pouch.

The structure and operation of pouch separator 108 is shown in FIGS. 25-28. Exemplary pouch separator 108 includes at least one suction cup 220 carried by a pivot rod 222. Devices other than a suction cup 220 may also be used to bend edge 132 down. Such devices include adhesive pads, fingers that slide over the edge to push the edge down, and pinchers that pinch the edge to bend it down and then pull it down. Rod 222 is driven by a drive arm 224 that is, in turn, connected to a controlled extendable cylinder 226. Extension of cylinder 226 from a first position (FIG. 26) to its second position (FIG. 27) drives suction cup 220 from a resting position (FIG. 26) to an engaged pick up position (FIG. 27) where suction cup is disposed adjacent to or disposed against edge 132 of pouch 110. Each suction cup 220 is connected to a controllable supply of vacuum air flow so that suction cup 220 can engage pouch 110 with sufficient force to bend edge 132 down over stops 136. When cylinder 226 returns to its first position, edge 132 is moved to its bent condition as shown in FIG. 28 where it is ready to be pulled from magazine 102 by pouch removal arm 140. In this embodiment, pouch 110 is bent about pivot rod 222 or edge 138 and the stiffness of pouch 110 may keep it spaced from rod 222 as shown in the drawings.

Figure 29:
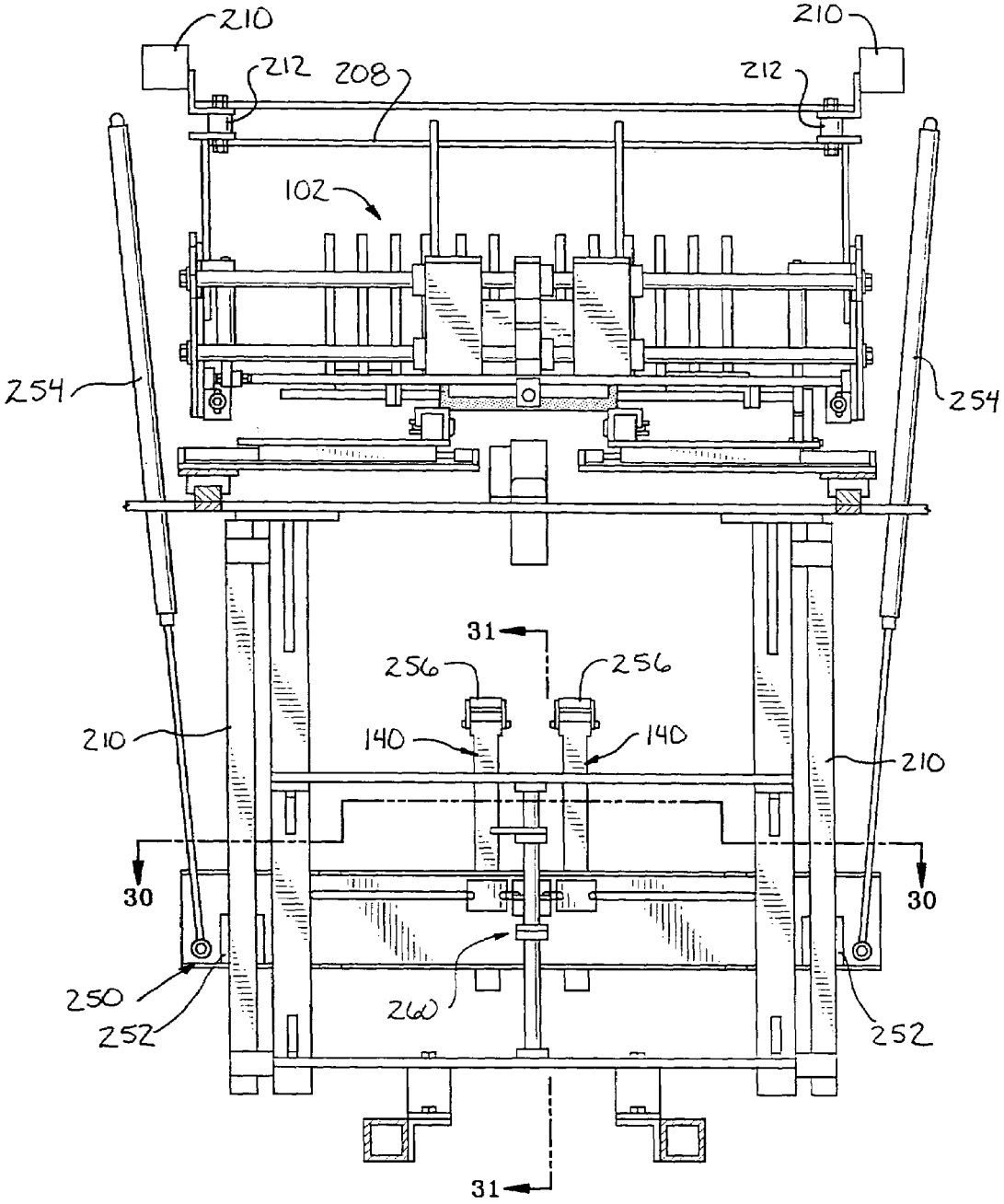
FIG. 29 is a rear view of the apparatus showing the pull down device adjusted for a first size pouch.
Figure 29A:
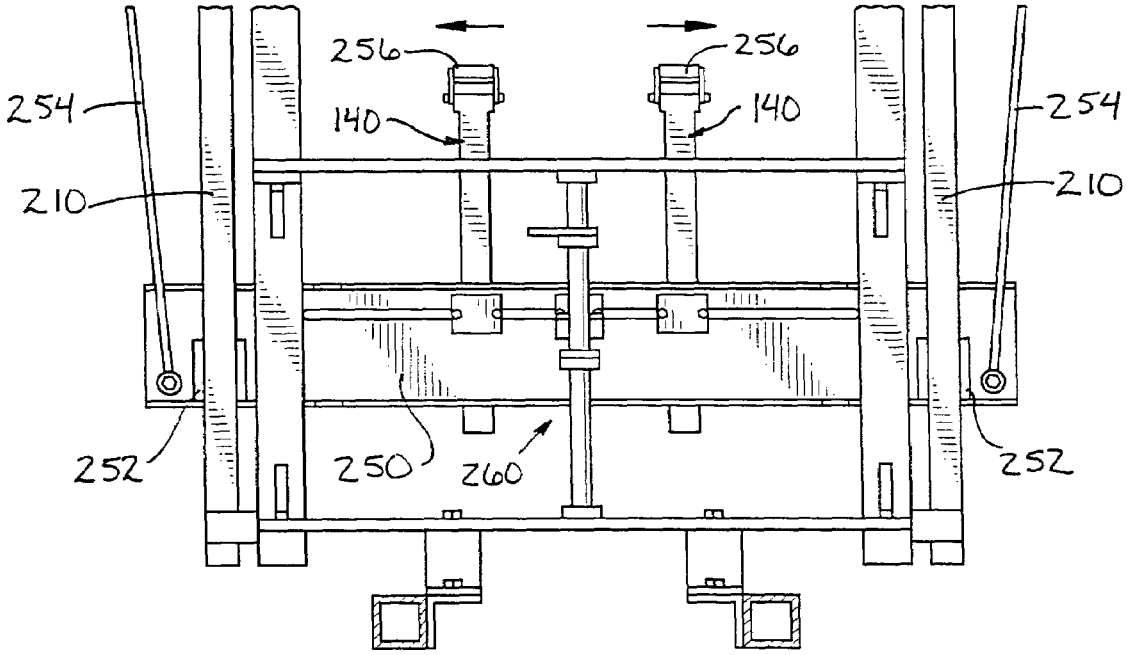
FIG. 29A shows the pull down device being adjusted for a second size pouch wider than the first size pouch.
Figure 30:
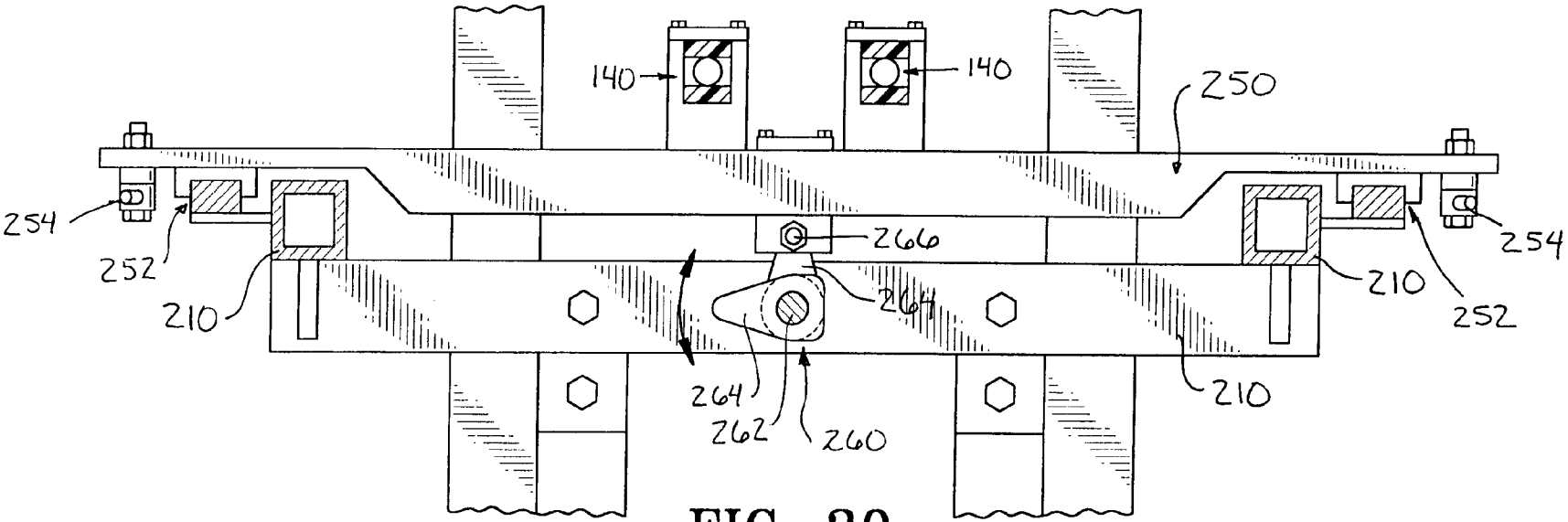
FIG. 30 is a section view taken along line 30-30 of FIG. 29 showing the height adjustment stop than limits how far down the pull down device moves when removing the first pouch from the plurality of adjacent pouches.
Figure 31:
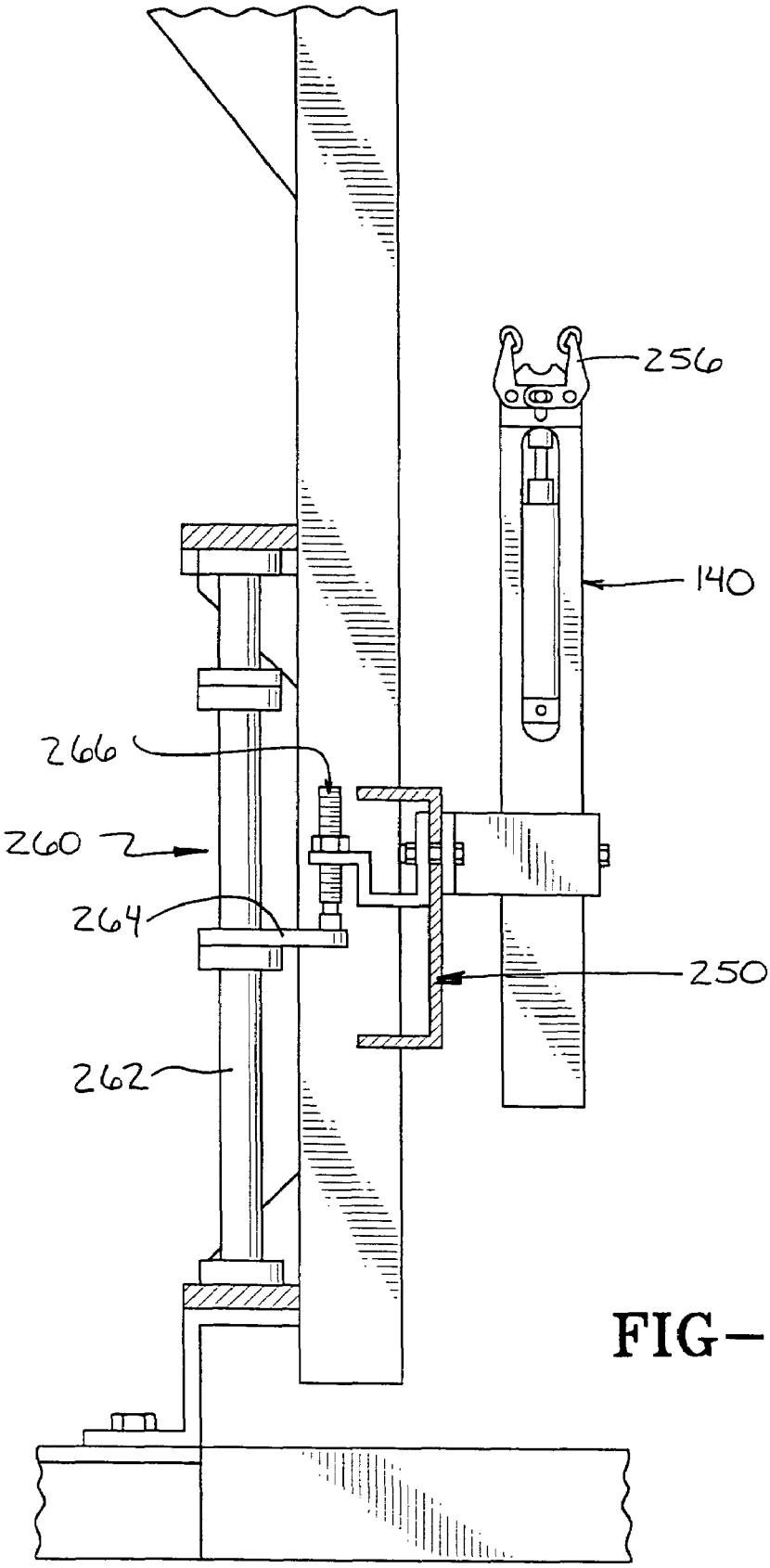
FIG. 31 is a section view taken along line 31-31 of FIG. 29 showing the adjustment stop in a first position for a first size pouch.
Figure 31A:
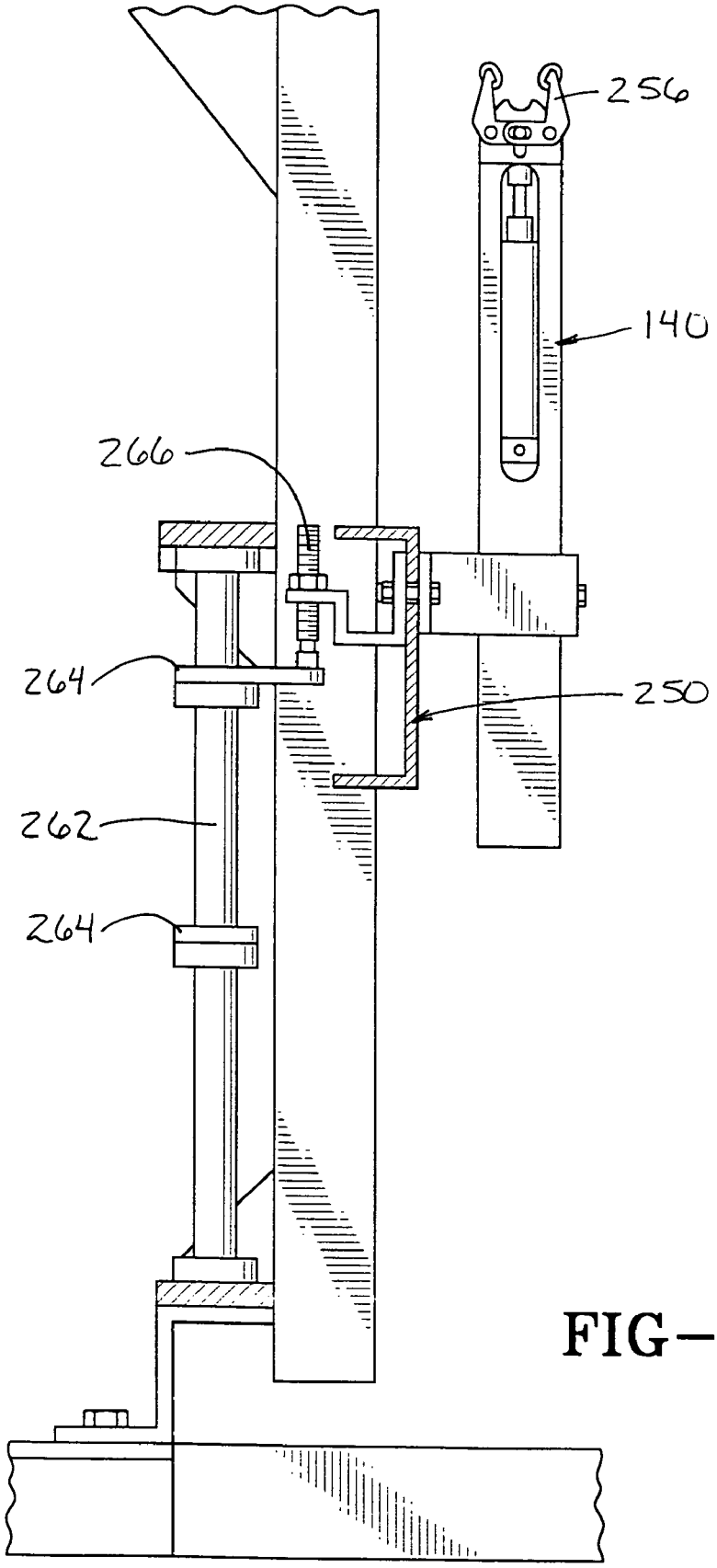
FIG. 31A is a view similar to FIG. 31 showing the adjustment stop in a second position for a second size pouch having a length shorter than the first size pouch.
Figure 32:
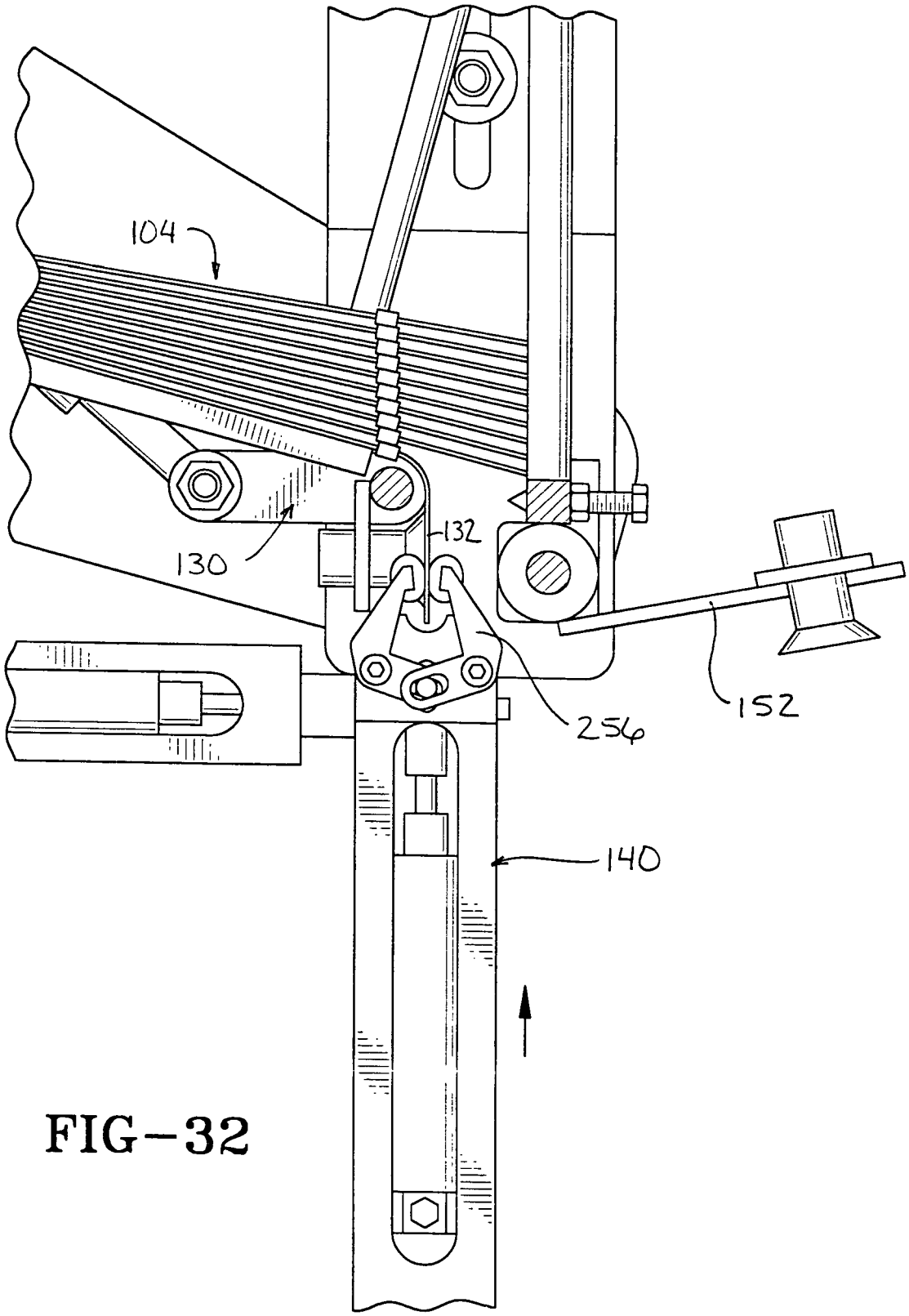
FIG. 32 is a view similar to FIG. 28 showing the pull down device moved up to a first position where it engages the bent edge of the first pouch.
Figure 33:
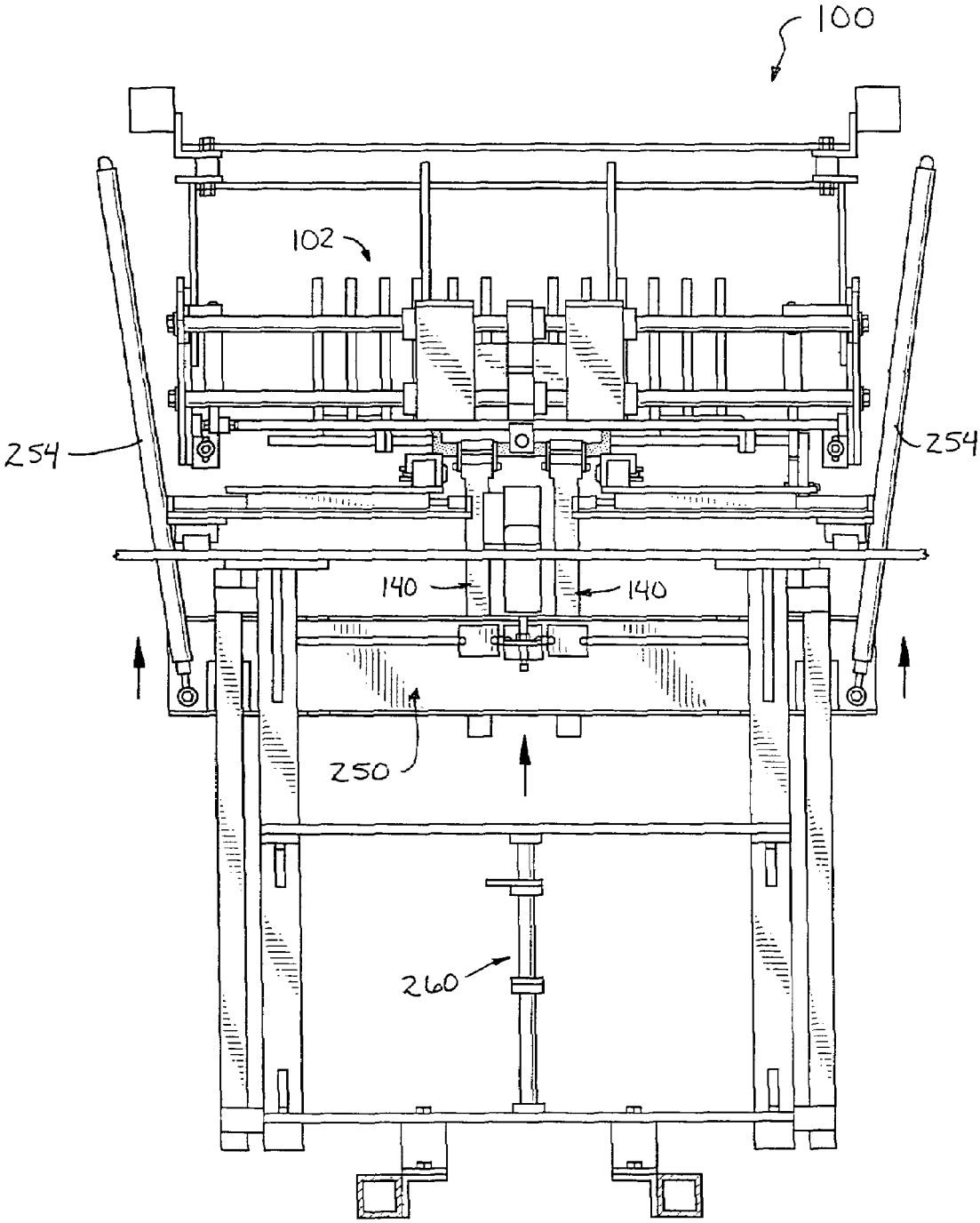
FIG. 33 is a rear view of the pull down device in the first position shown in FIG. 32.
Figure 34:
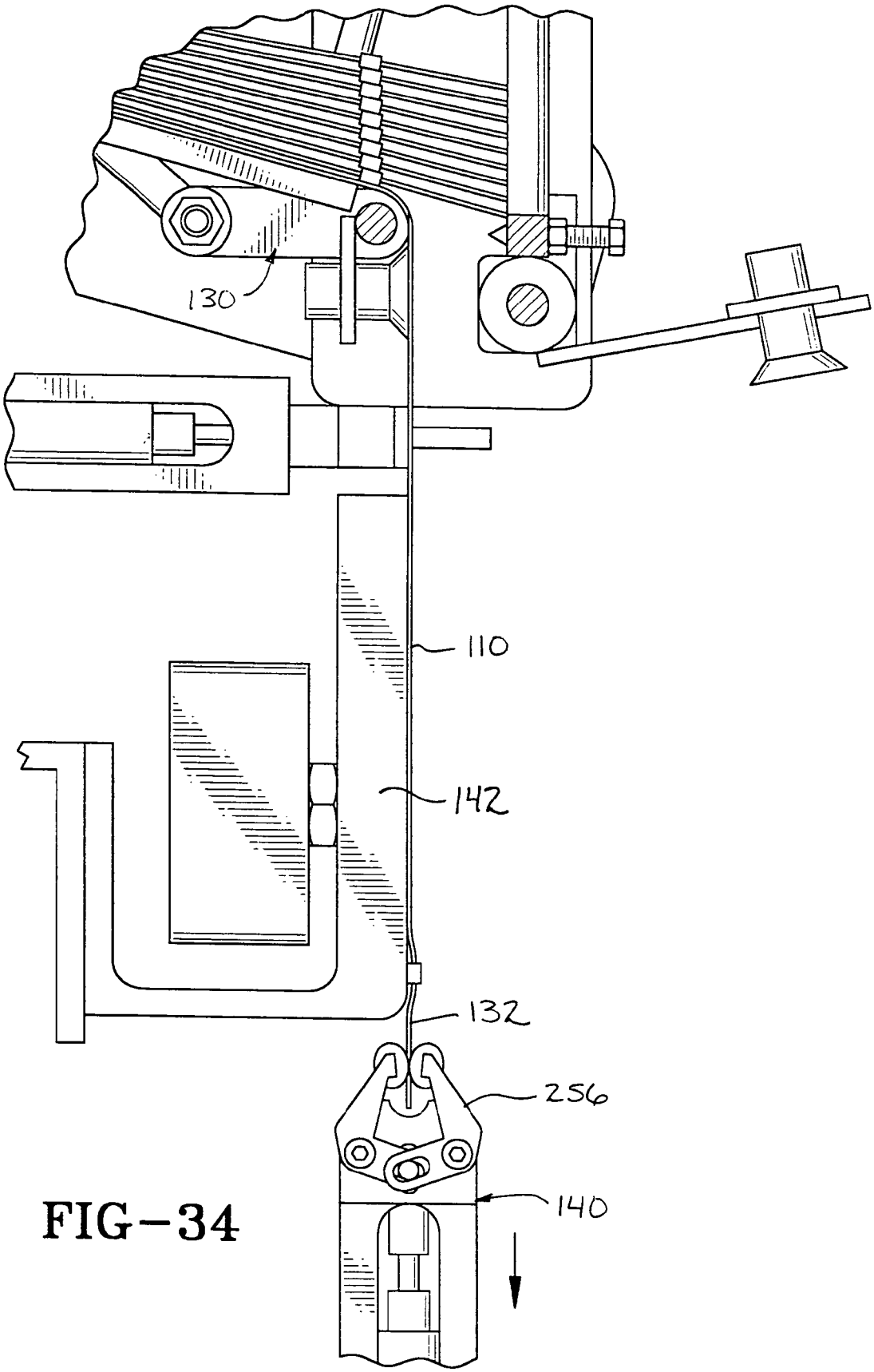
FIG. 34 is a view similar to FIG. 32 showing the first pouch being pulled over the mandrel and the tensioning device to remove the first pouch from the plurality of adjacent pouches.
Figure 35:
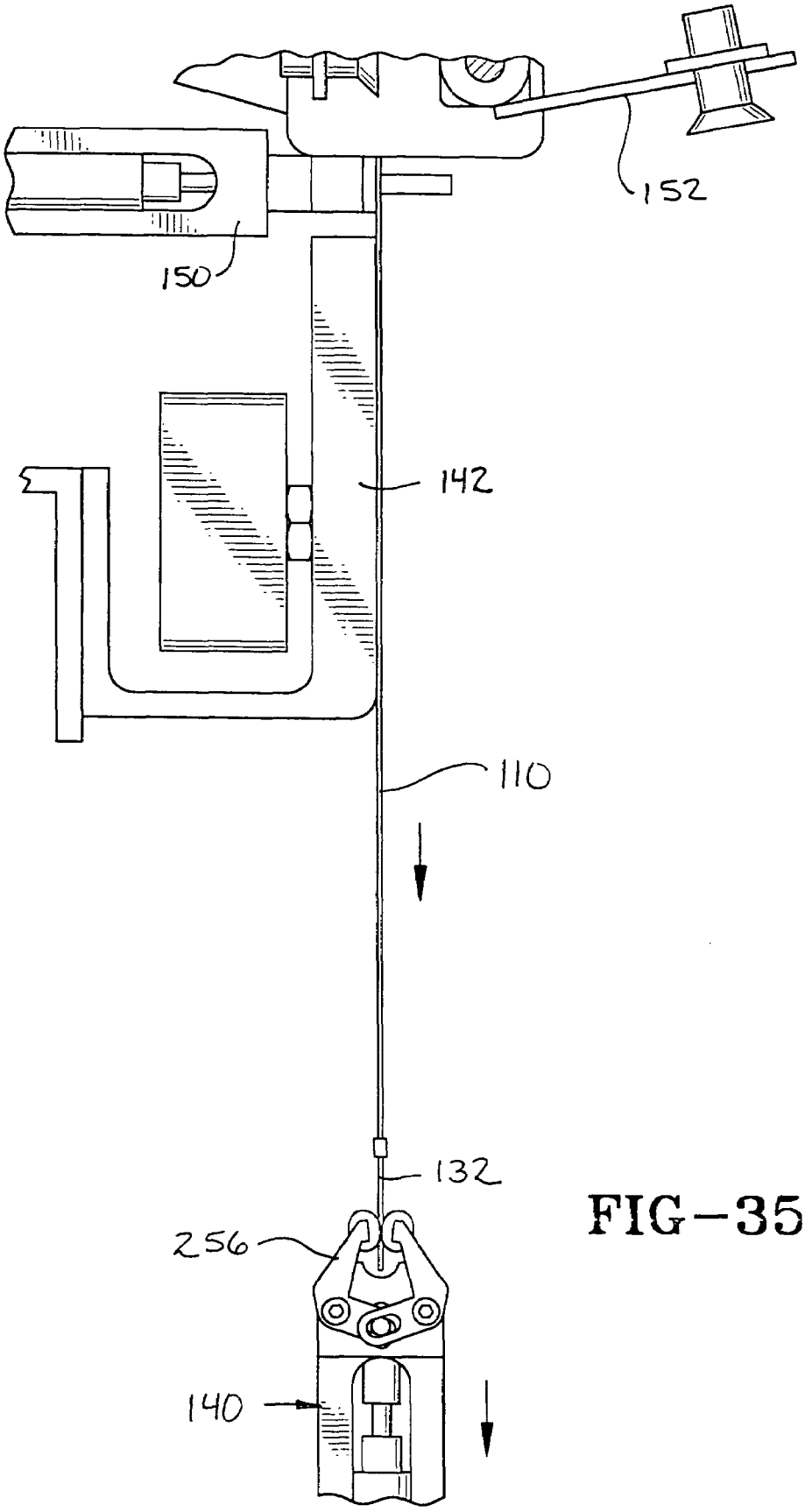
FIG. 35 shows the first pouch completely removed.
Figure 36:
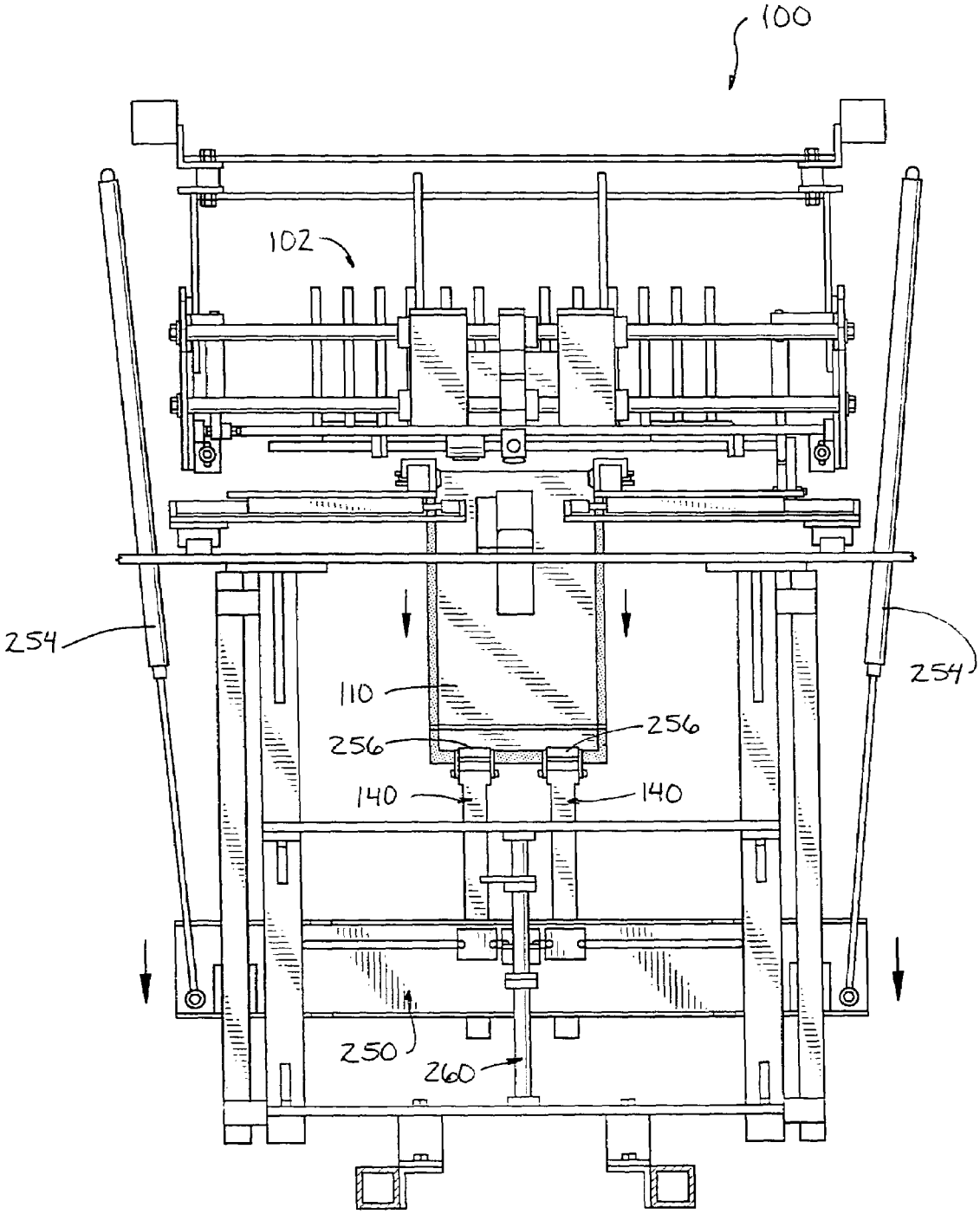
FIG. 36 is a rear view of FIG. 35.

One or a plurality of pouch removal arms 140 (FIGS. 29-36) may be provided to slide pouch 110 from magazine 102. Arms 140 are carried by a movable carriage 250 that slides up and down on a portion of frame 210. Bearings 252 provide for a smooth sliding motion. A Arms 140 are adjustable mounted to carriage 250 such that they may be moved side-to-side as shown in FIG. 29A for use with different-width pouches. Controllable cylinders 254 are used to drive carriage up and down as needed to place the grabbers 256 of arms 140 in the proper location for engaging pouch 110. In another configuration, grabbers 256 may be combined with grabber 220 so that arms 140 move up to bend the pouch edge down and then remove the pouch from the stack of pouches in a single movement.

An adjustable stop 260 is used to control how far down pouch removal arms 140 move from magazine 102. Stop 260 adjusts apparatus 100 for pouches of differing lengths. When magazine 102 is properly configured, edge 132 is always in the same location regardless of the width and length of pouch 110. Stop 260 is thus used to limit how far arms 140 pull pouch 110 down from magazine. Stop 260 includes a selectively rotatable shaft 262 that carries a plurality of stop tabs 264. Each stop tab 264 is positioned along shaft 262 in a position that corresponds to a different pouch length. The user sets the length of the pull down by rotating shaft 262 until the desired stop tab 264 is disposed under a portion of carriage 250. Carriage 250 may include a fine adjustment finger 266 that engages stop tab 264. Rotation of finger 266 allows for fine height adjustments so that the position of pouch may be precisely controlled when it is pulled down from magazine. Stop 260 allows apparatus to readily set up for different length pouches without extensive measuring.

Figure 41:
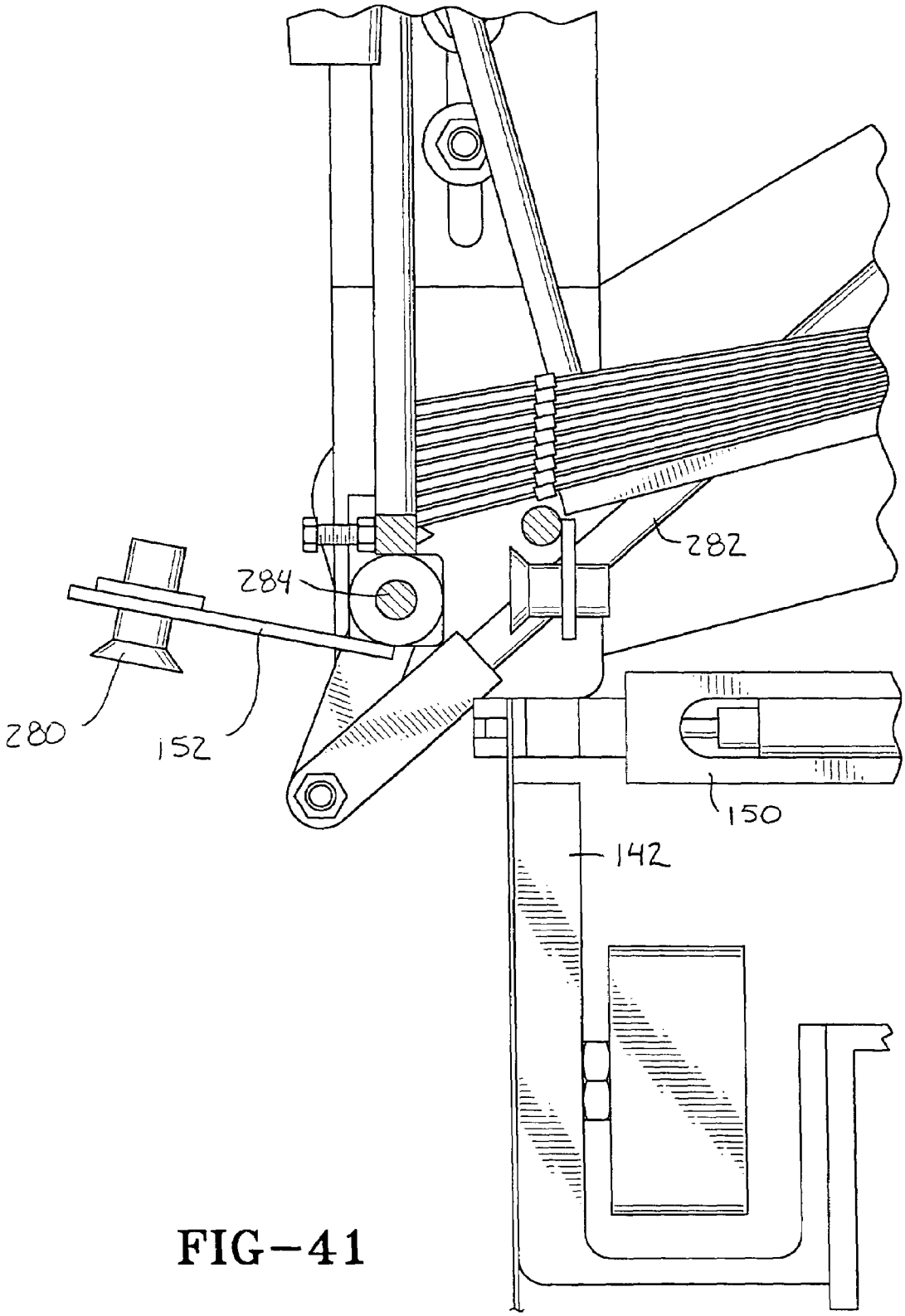
FIG. 41 is an enlarged side view of the top of the first pouch while it is held by the shuttle arms and with its first side engaged by the tensioning device with the bag opener in a first position.
Figure 42:
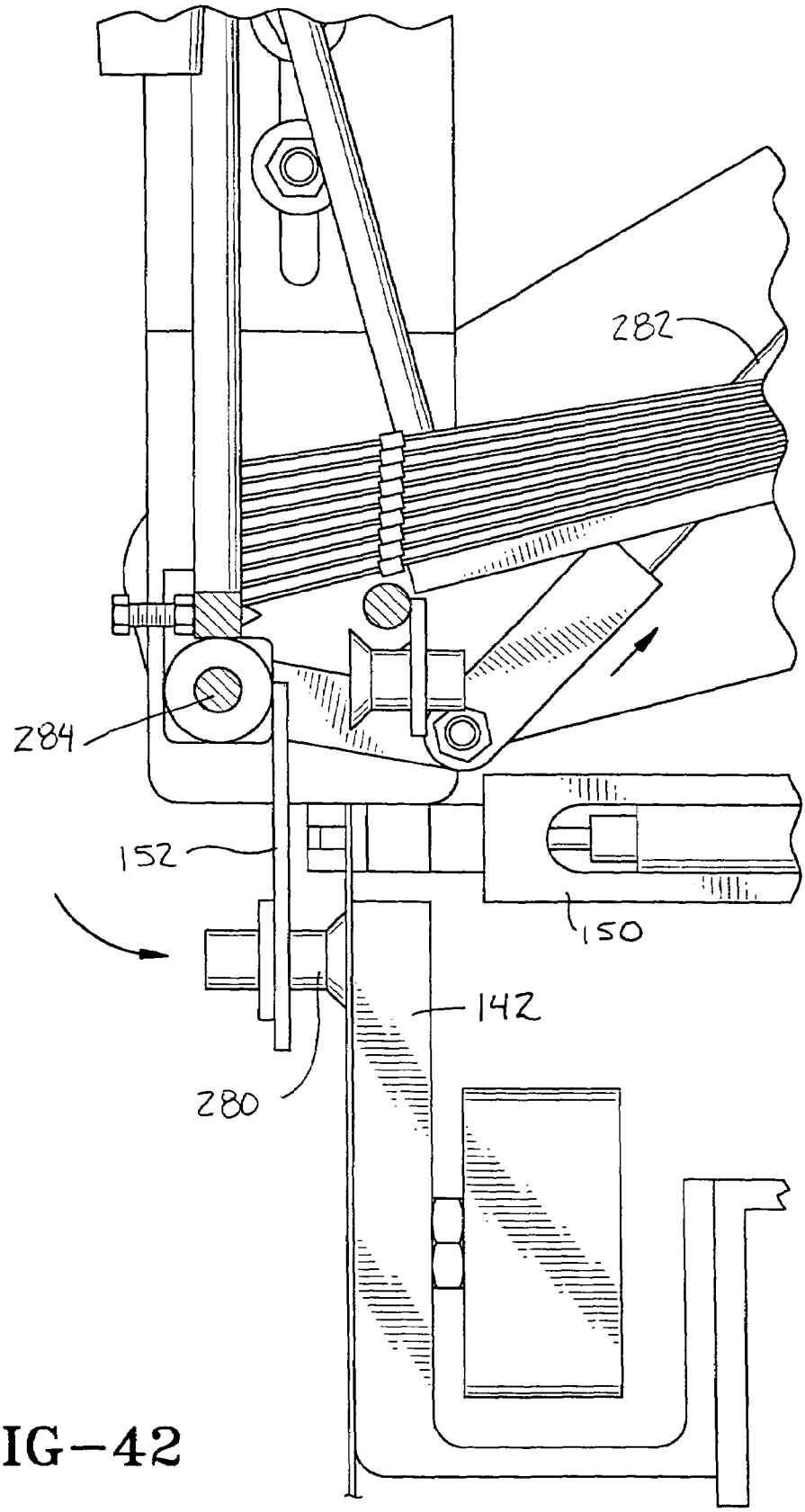
FIG. 42 is a view similar to FIG. 41 showing the bag opener in a second position engaged with the second side of the first pouch.

FIGS. 33-36 show how first pouch 110 is slid out of pouch stack 104 and positioned in an upright position so that pouch opener 114 and shuttle 116 may perform their functions. Pouch holder 142 is disposed along the path of pouch 110 as it is pulled from stack 104 down to its "removed" position. Holder 142 applies a force to pouch 142 so that the pouch will not fall over or crumpled when it finally disengages from stack 104 before it is engaged by shuttle arms 150. An exemplary holder 142 is a vacuum plate that applies a small vacuum force to the body of pouch 110 to keep it in its upright position. Holder 142 may be positioned toward or at the top of pouch 110 as shown in FIGS. 41-43 so that the upper corners are held in an uncollapsed position while provided space for shuttle arms 150 to engage pouch 110. Another type of holder 142 is a body that defines a pair of slots that receive the opposite sides of pouch 110 as it is pulled down. The vacuum embodiment of holder 142 may be used to help open pouch 110 below.

An exemplary operation and the adjustability of shuttle 116 are shown in FIGS. 37-49. An alternative configuration is depicted in FIGS. 68-71. In an alternative configuration, shuttle 116 moves the pouch laterally from the direction depicted in these drawings. Apparatus may thus move one pouch to the right with a second pouch to the left in order to increase throughput. In the exemplary embodiment, a controllable drive is used to move shuttle 116 back and forth between its ready (FIG. 37), intermediate (FIG. 43), and second (FIG. 48) positions. The controllable drive may be provided in any of a variety of those known in the art. In the exemplary embodiment, extendable cylinders are used to control the movement of shuttle 116. Shuttle 116 may be slid between its first and second positions with shuttle cylinders 260. In order to precisely control the intermediate position of shuttle 116, an offset cylinder 262 is used to move shuttle 116 from its first position to its intermediate position. Fine adjustment screws 264 are used to provide for fine adjustments of the first and second positions. Screws 264 function to limit the movement of shuttle 116.

Figure 37:
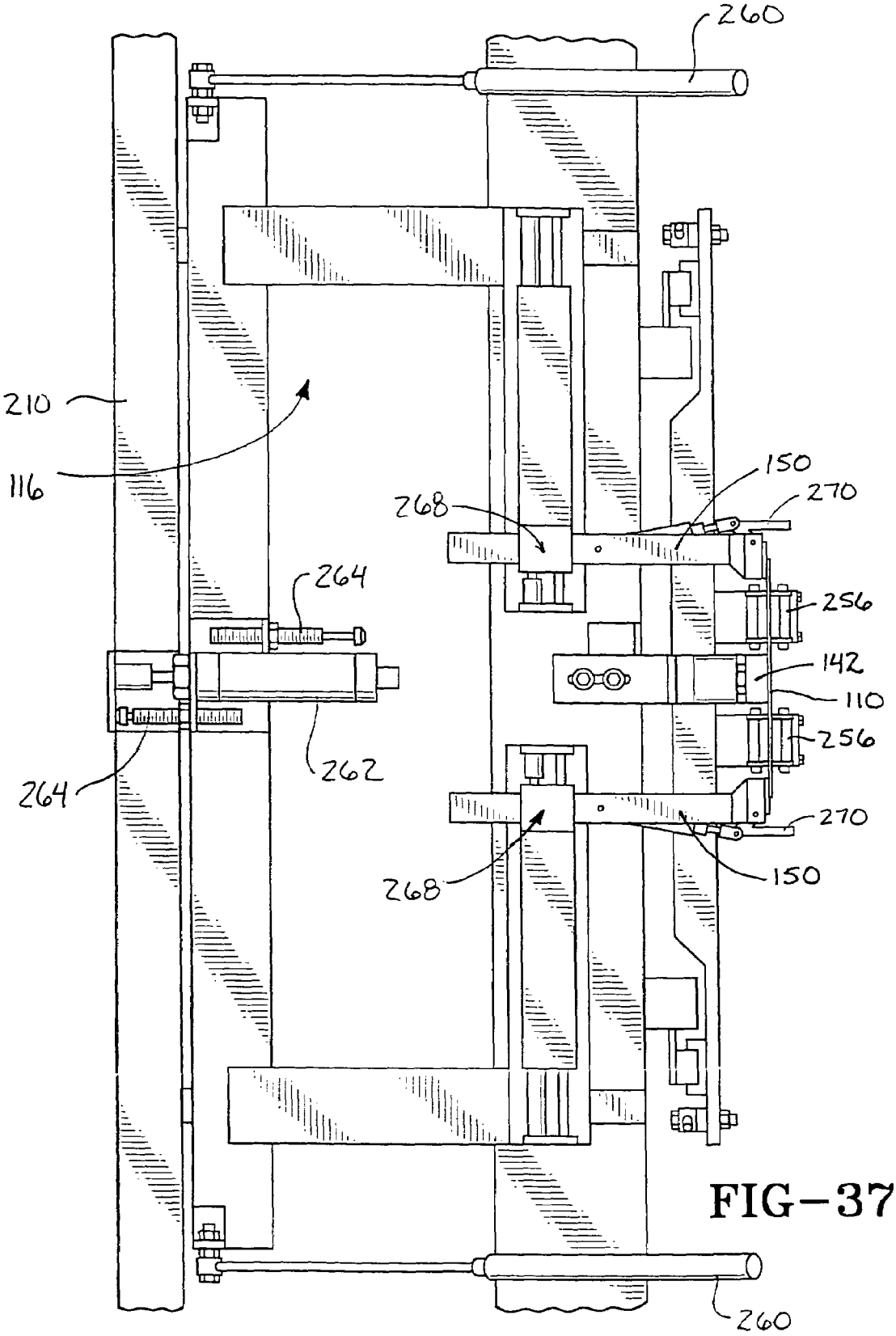
FIG. 37 is a top view of the shuttle in a first position where the shuttle arms are ready to grasp opposite portions of the first pouch.
Figure 37A:
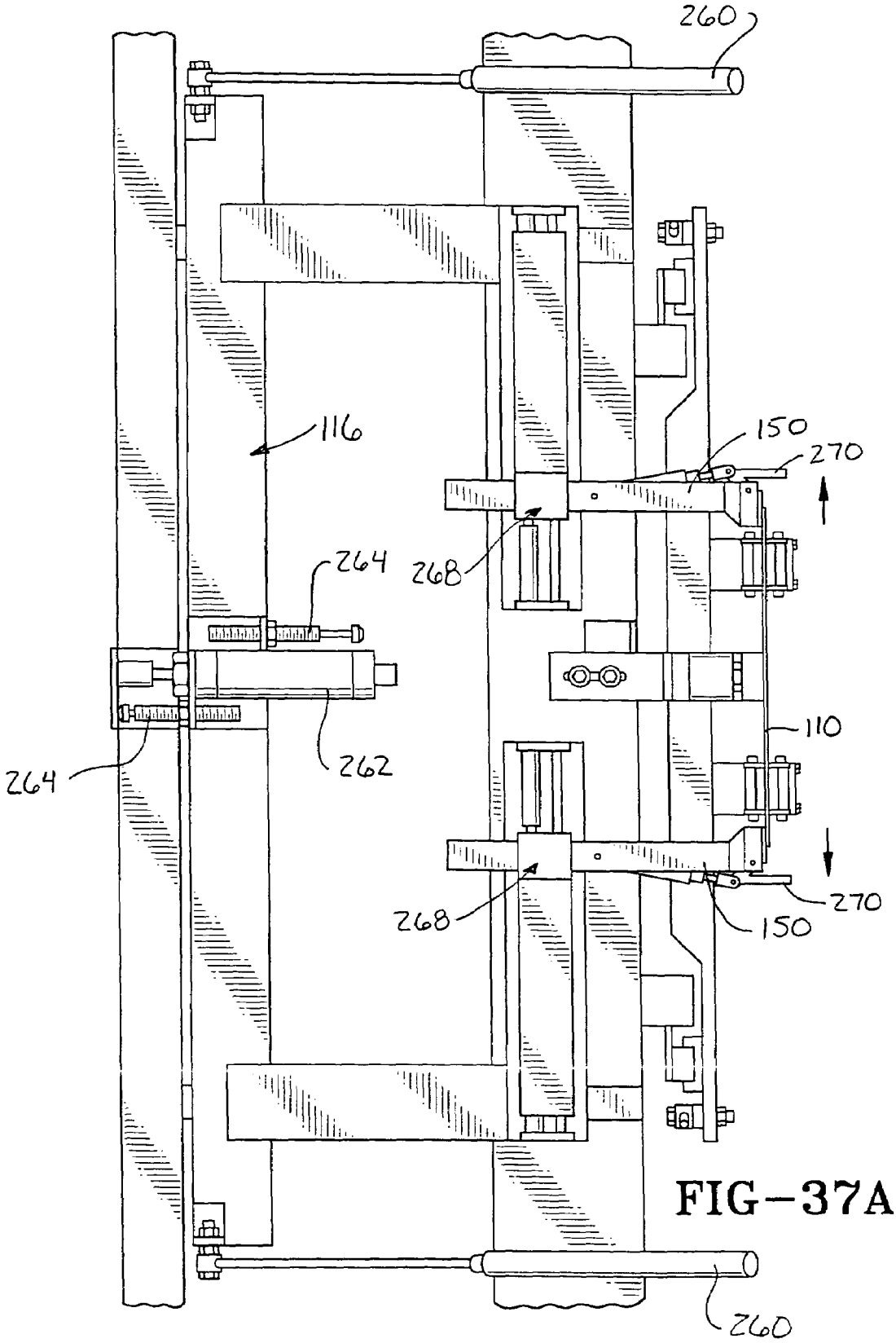
FIG. 37A is a view similar to FIG. 37 showing the shuttle being adjusted for a second size pouch wider than the first size pouch.
Figure 38:
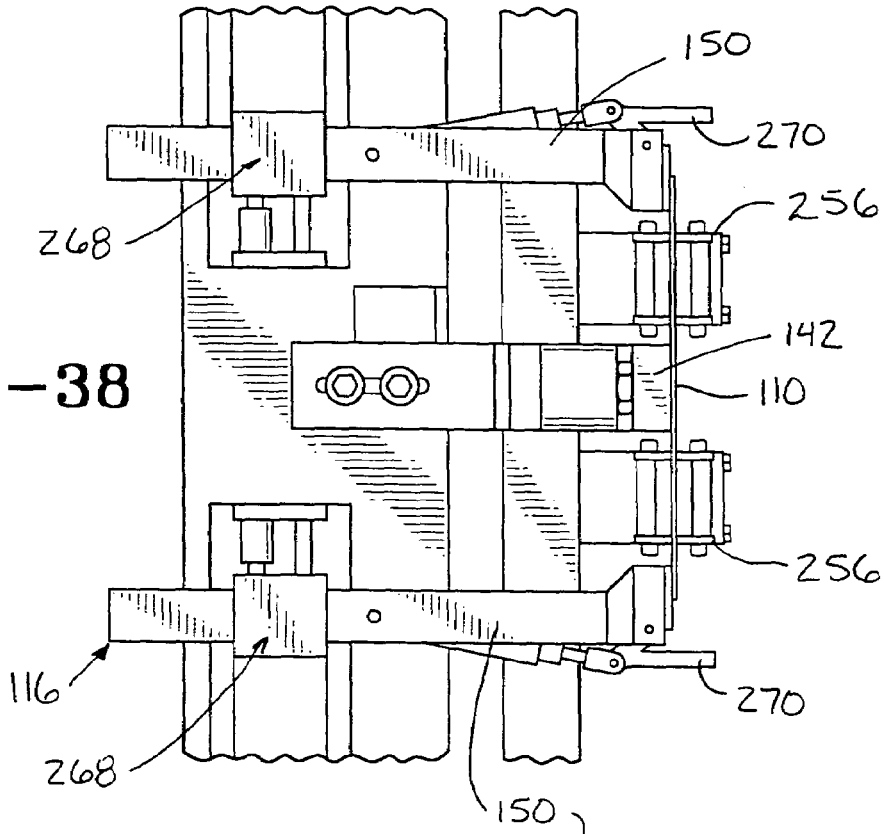
FIG. 38 is a top view of the shuttle arms positioned with respect to the first pouch.
Figure 40:
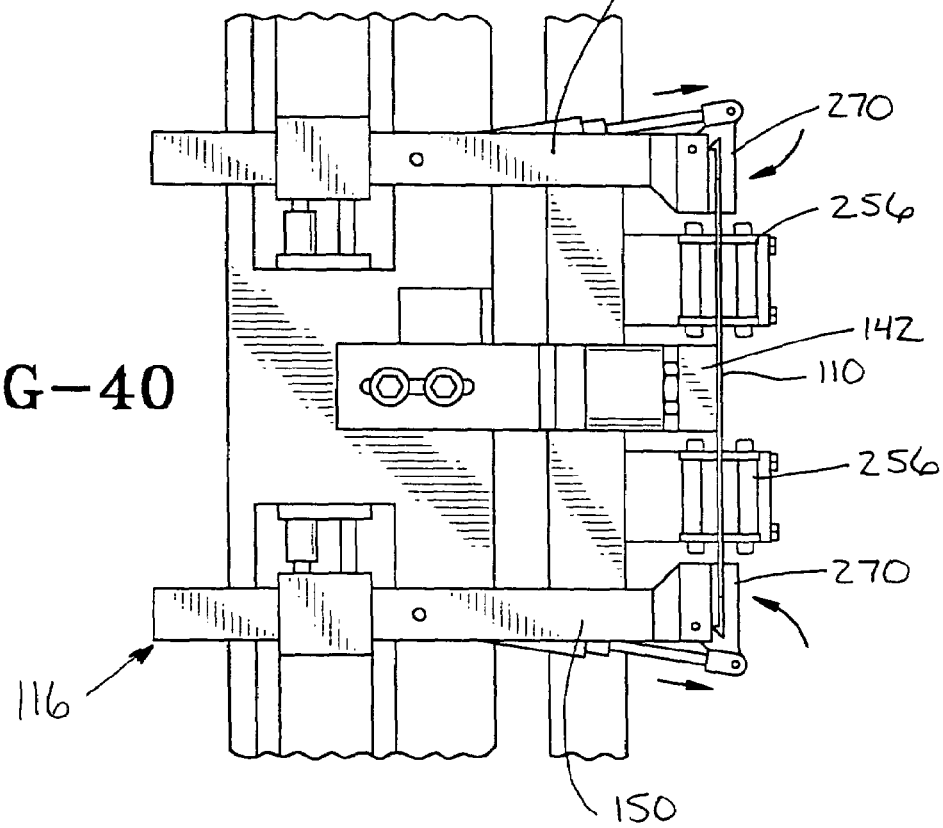
FIG. 40 is a top view of the shuttle arms grasping opposite portions of the first pouch.
Figure 39:
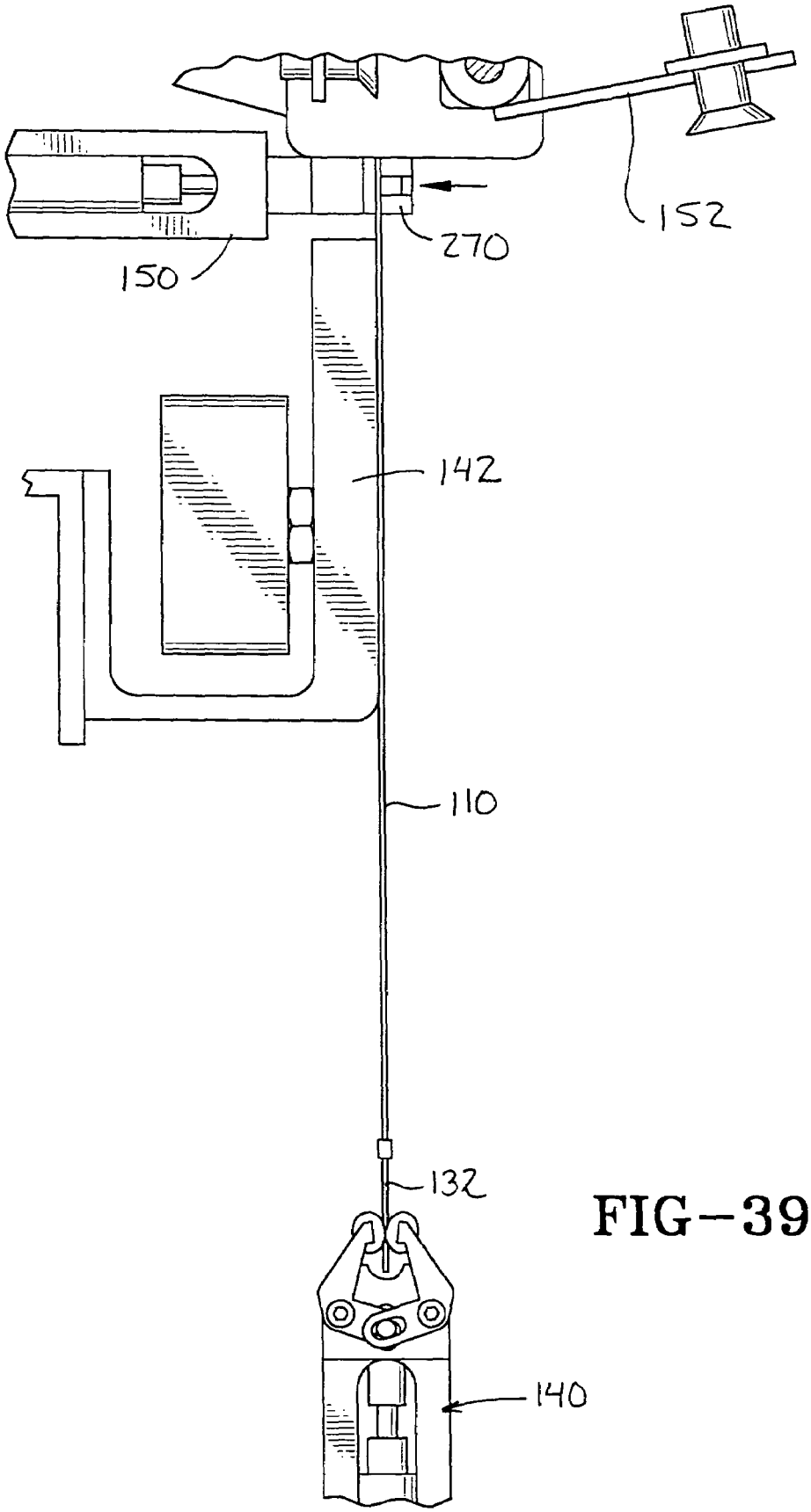
FIG. 39 is a side view of one shuttle arm grasping a portion of the first pouch.

As described above, shuttle 116 carries shuttle arms 150 that engage pouch 110 to move it from its pulled down position to filling station 118. Arms 150 may also hold pouch 110 while pouch 110 is being initially opened. FIGS. 37 and 37A show how the position of arms 150 may be adjusted on shuttle 116 for different pouch widths. Each arm is held on a slide 268. In one embodiment, slides 268 are tied together so that a width adjustment of one arm 150 automatically moves the other arm 150 while keeping them centered about pouch 110. Each arm 150 carries a controllable gripping finger 270 that is adapted to pinch and hold a portion of pouch 110. Pouch 110 is engaged by arms 150 when fingers 270 pinch the edges of pouch 110 near the upper corners of pouch 110 as shown in FIGS. 40 and 39.

Once pouch 110 is engaged by arms 150, apparatus 110 opens pouch 110 so that it may be filled. The opening step may occur before moving pouch 110 away from the pull down position shown in FIG. 42 or an intermediate pouch position may be used between the pull down position of FIG. 42 and the filling position of FIG. 48. The intermediate position allows second pouch 112 to be pulled down while shuttle 116 is delivering pouch 110 to filling station 118.

Figure 70:
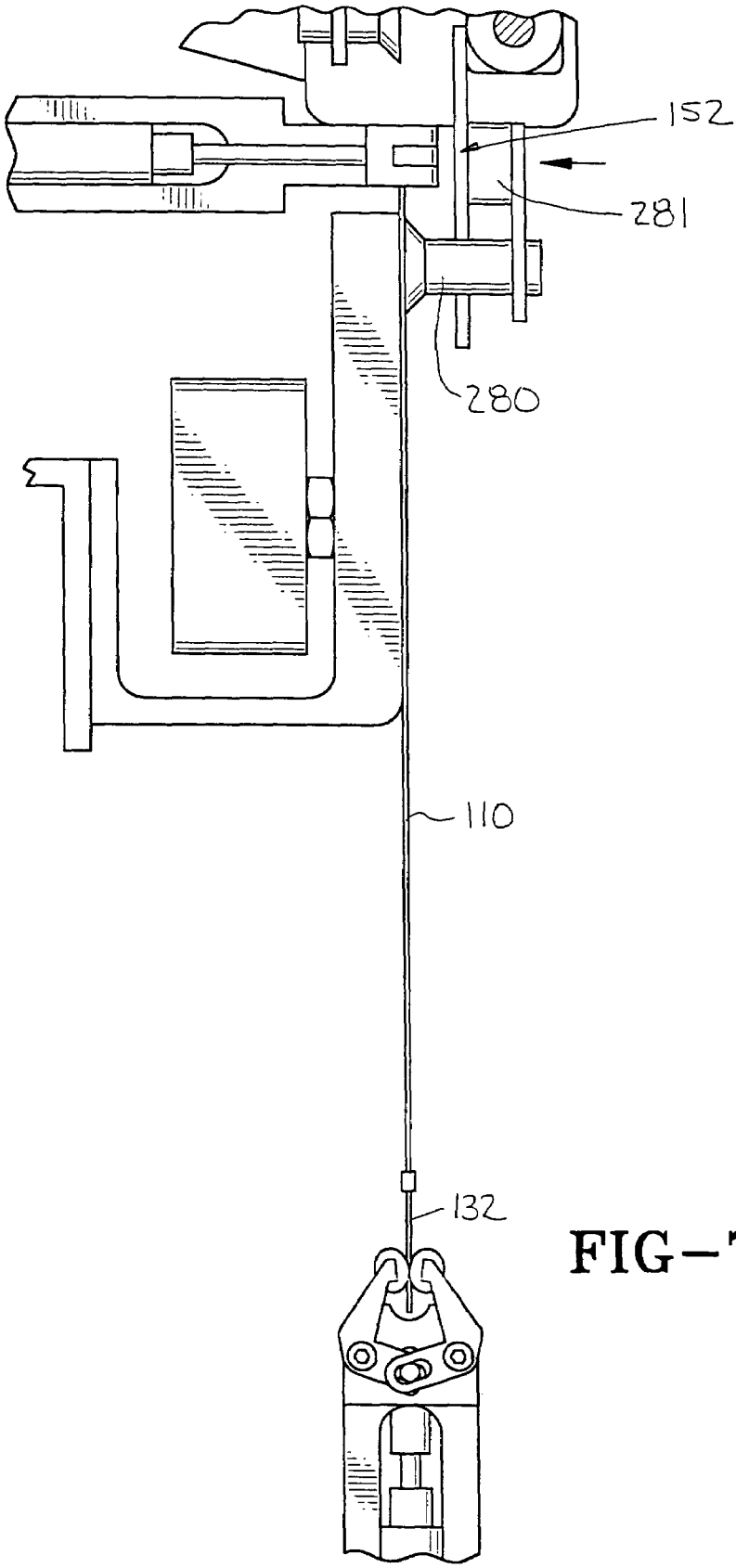
Figure 71:
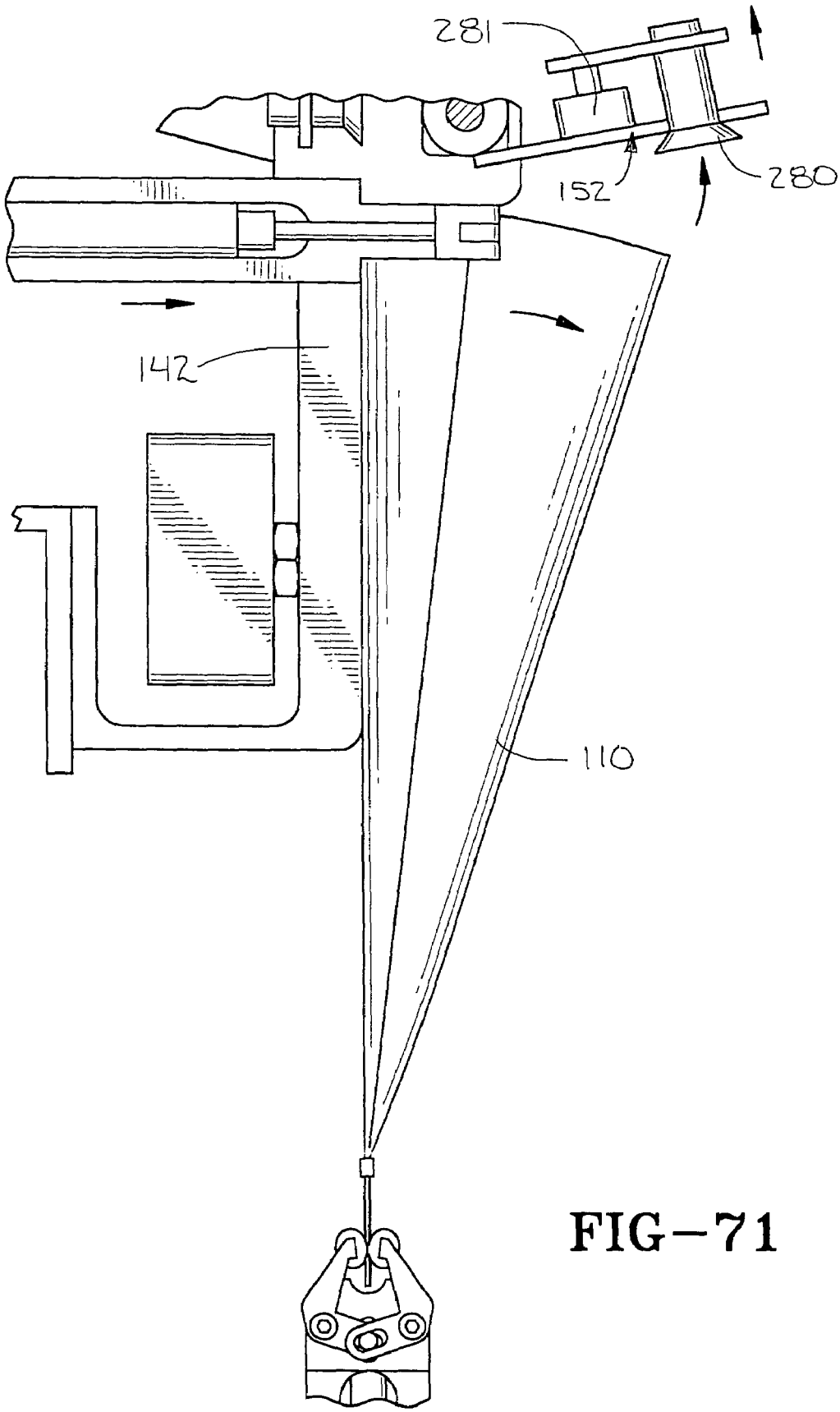
Figure 72:
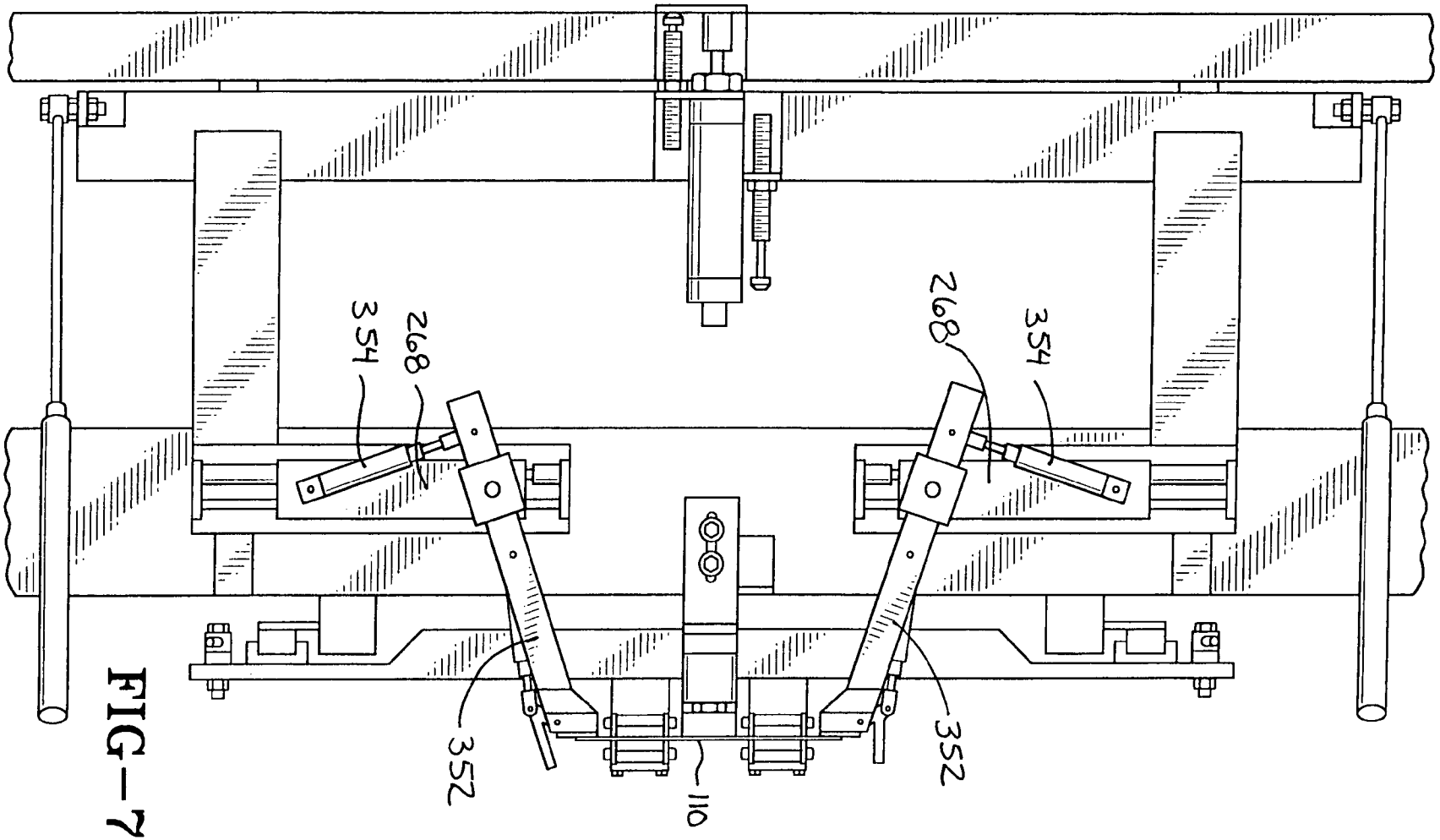
Figure 73:
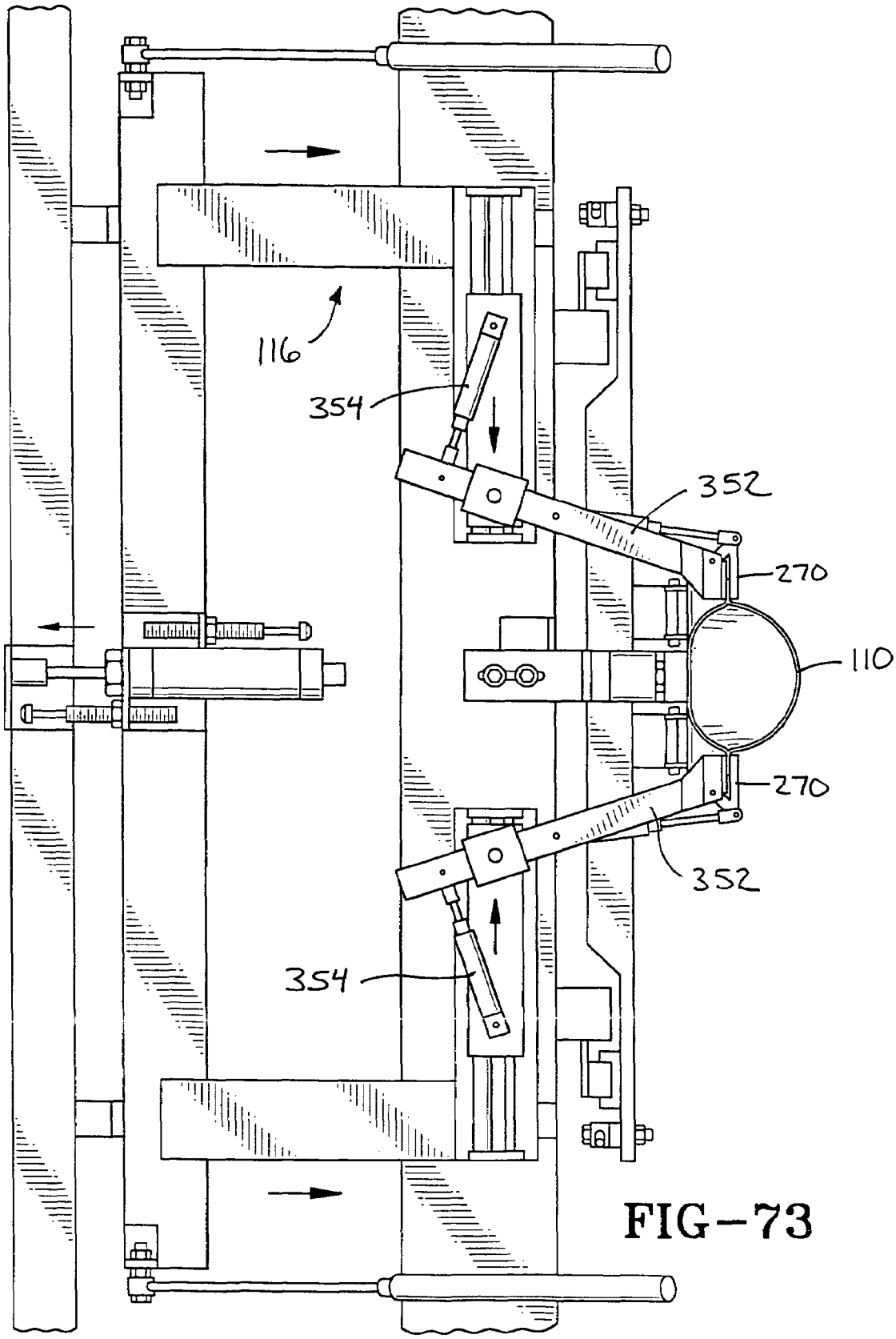
Figure 74:
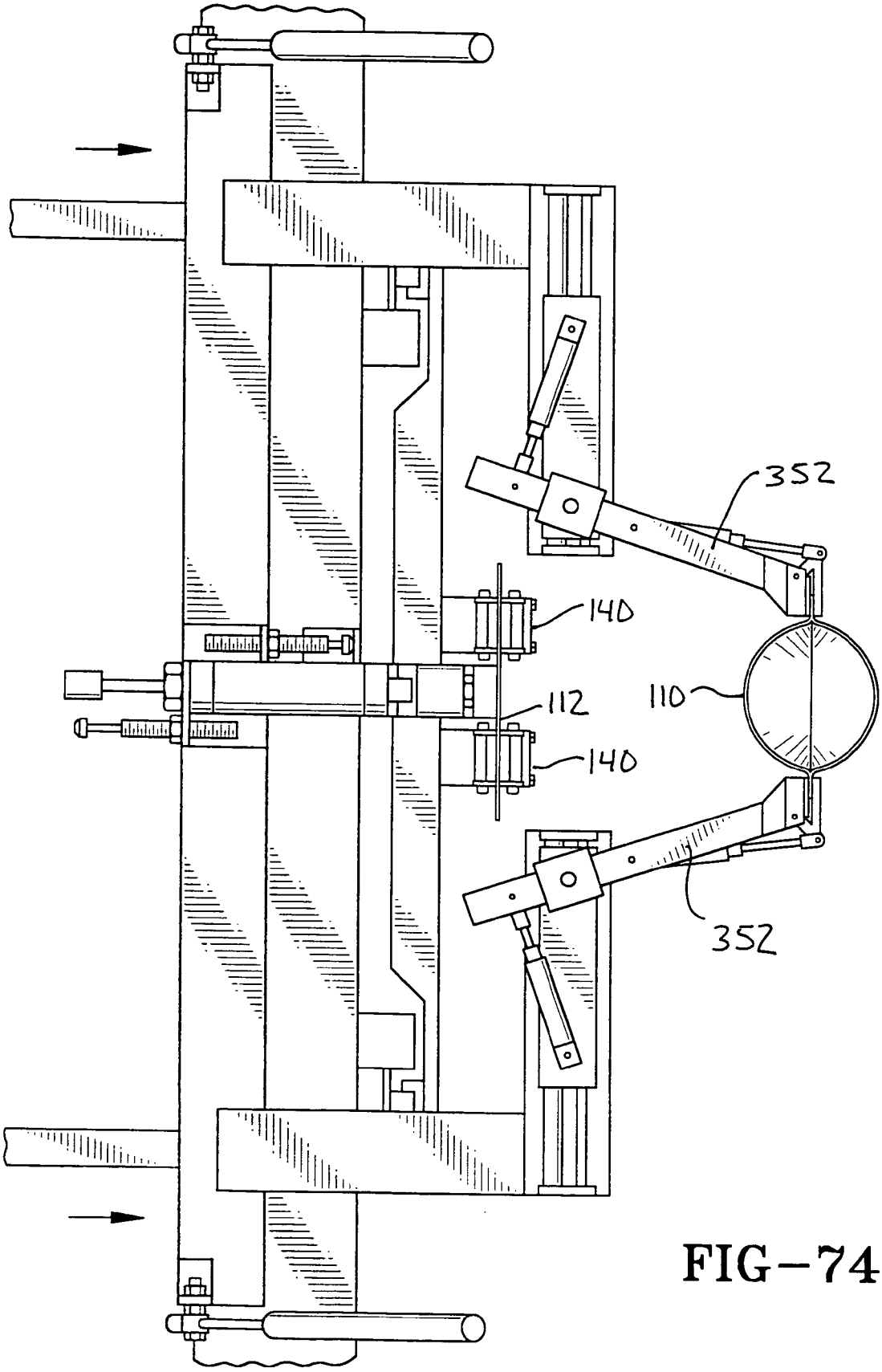
Figure 75:
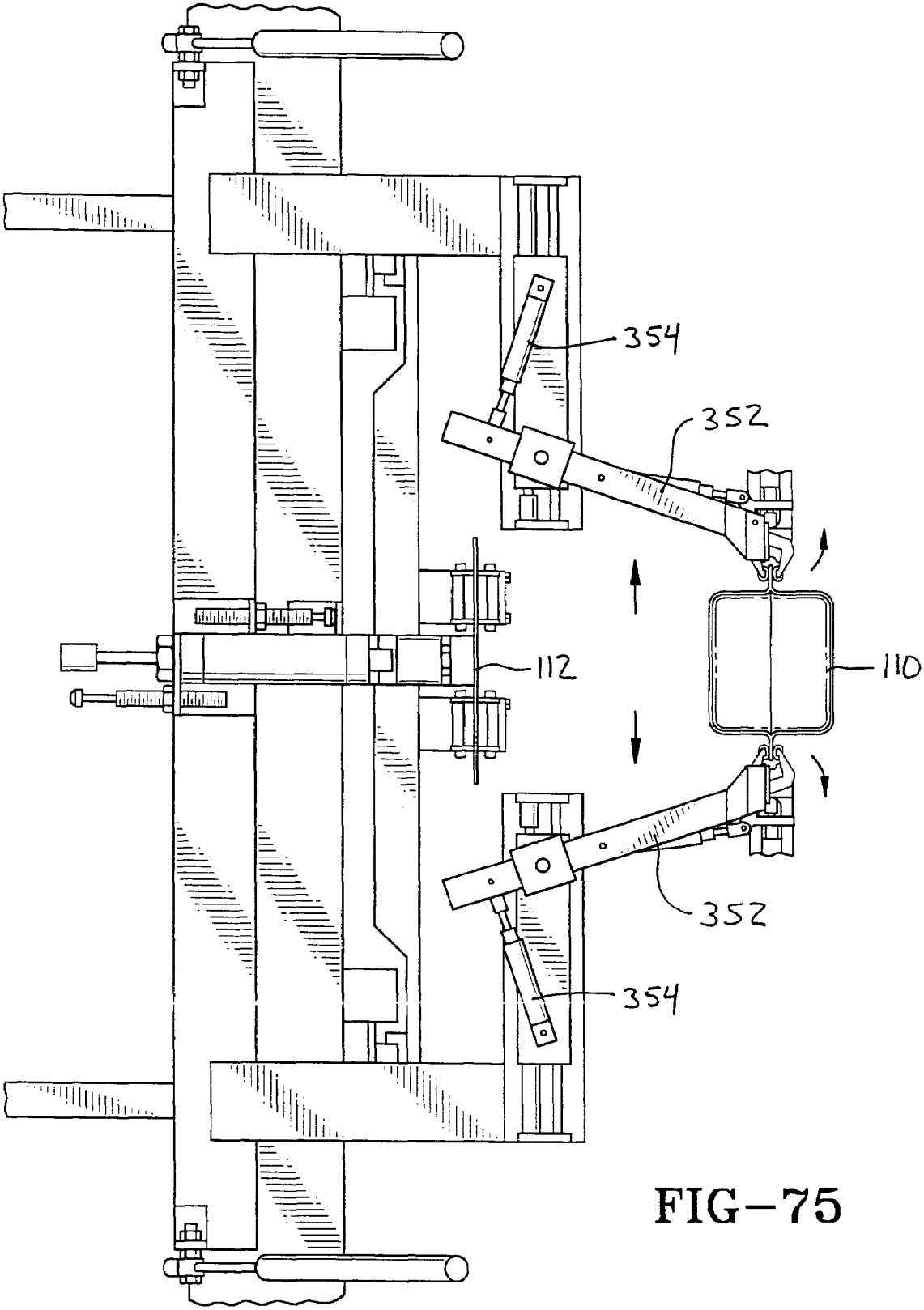
Figure 76:
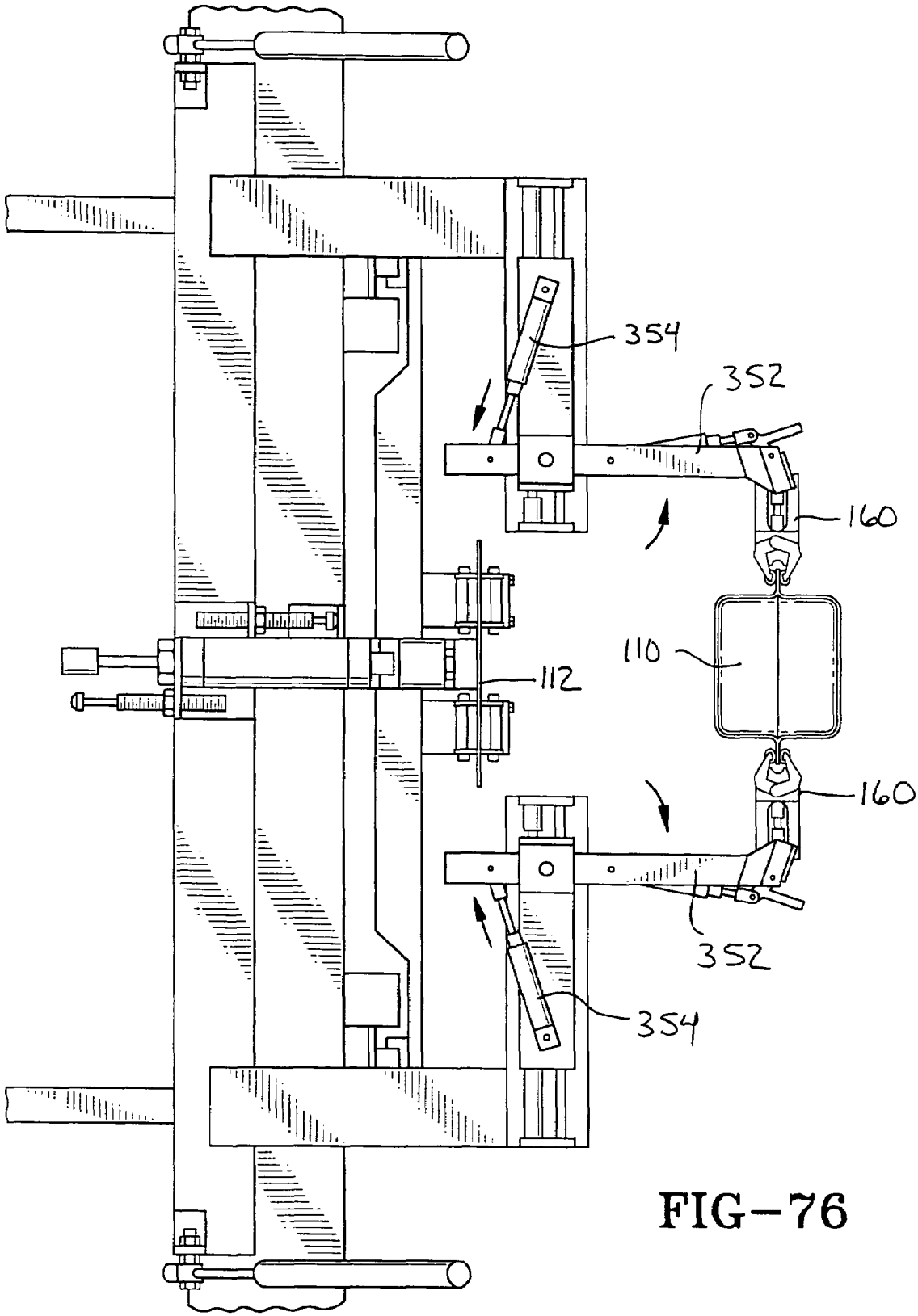
Figure 77:
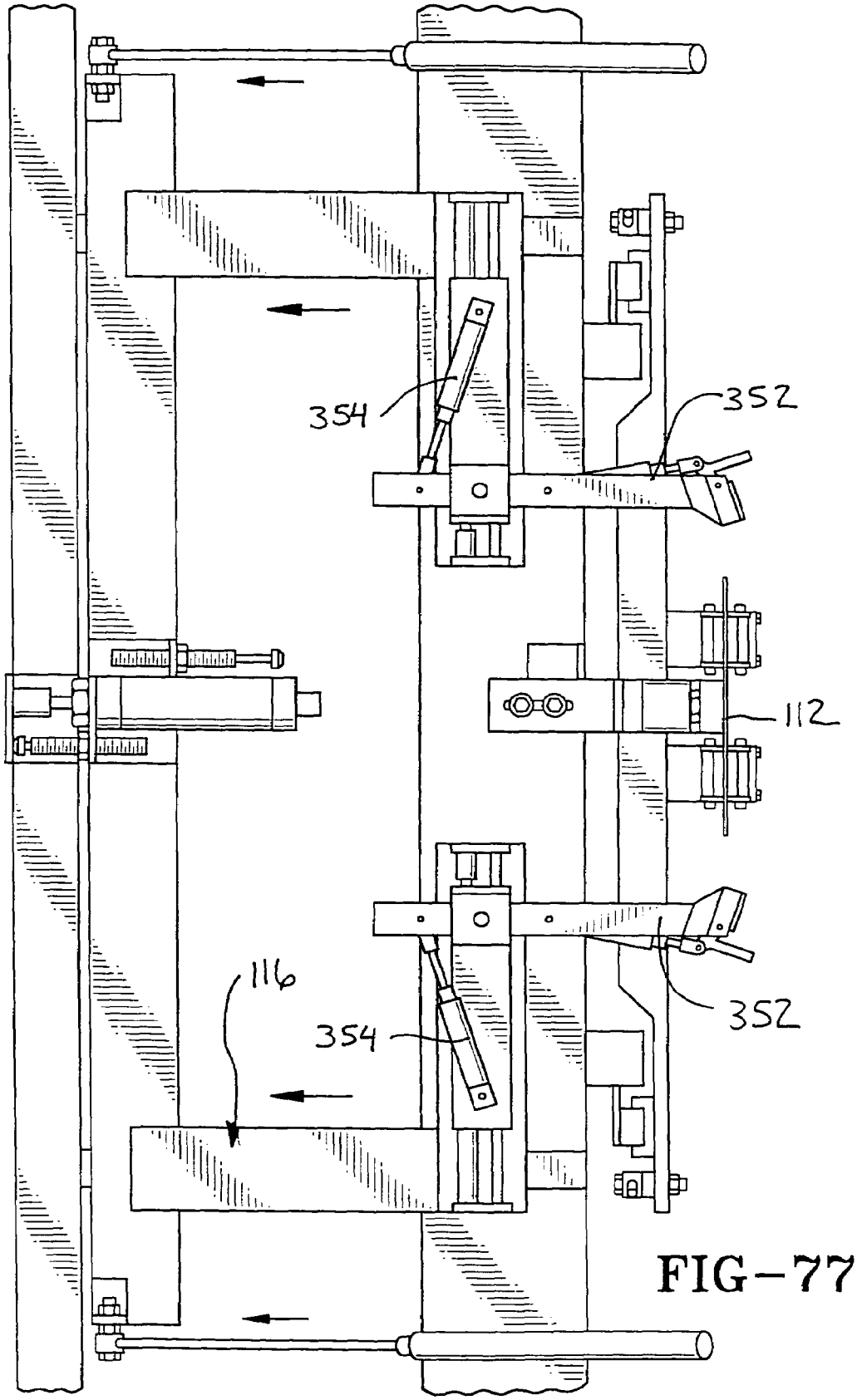
Figure 78:
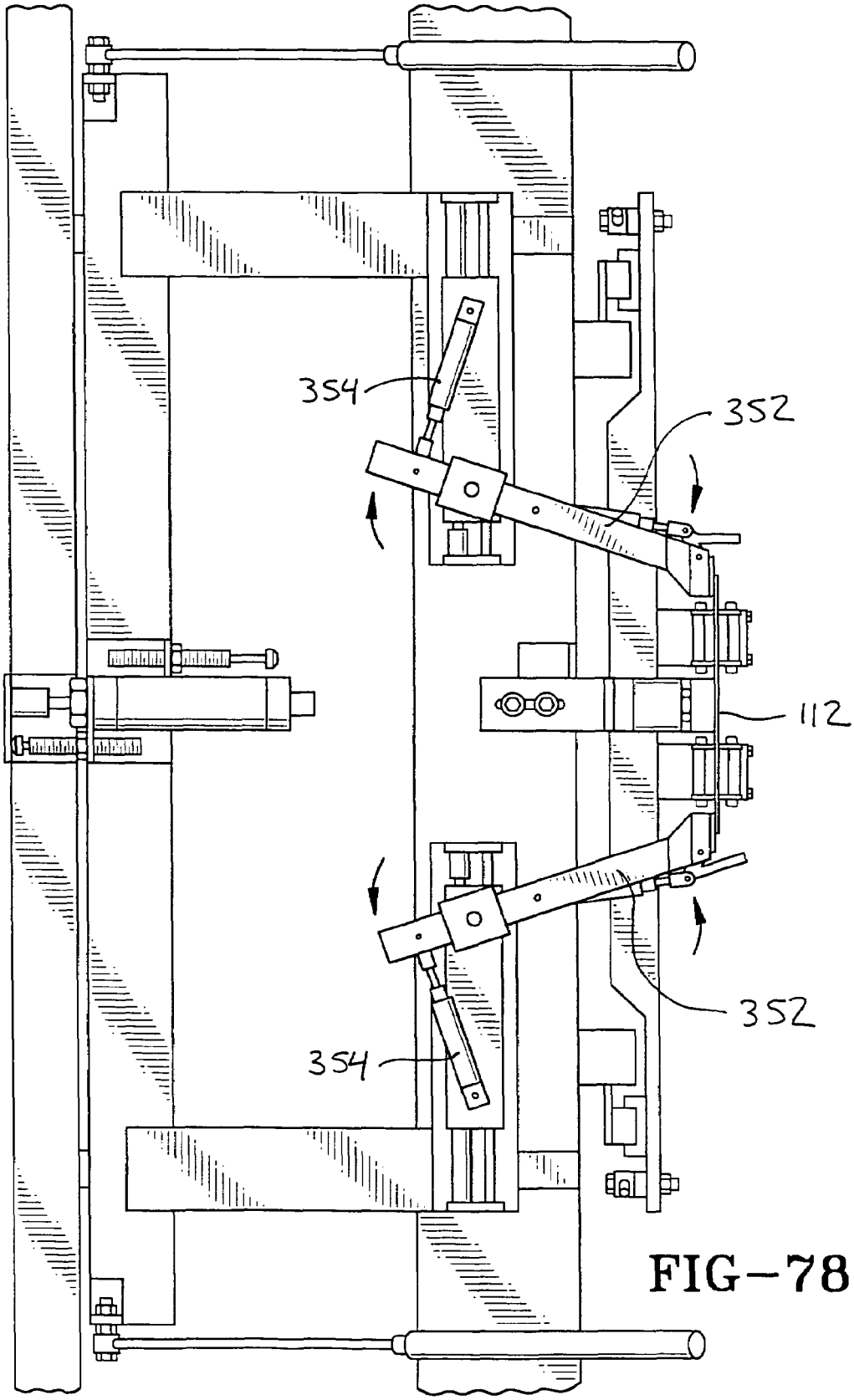

Opening arm 152 pivots to engage the front of pouch 110 as shown in FIGS. 41 and 42. Arm 152 includes an engagement device such as a suction cup 280 that can pull move the front of pouch 110 outwardly as arm 152 is retracted. Arm 152 may be controlled by a drive 282 and pivot rod 284. Arm 152 is retracted away from pouch 110 to pull pouch open. In FIGS. 68-71, arm 152 positions cup 280 in front of, but spaced from, the pouch. A drive 281 then moves cup 280 into engagement with the pouch as shown in FIG. 70. The pouch is opened when either arm 152 pivots back up or drive 281 moves cup 280 back to its ready position. Arms 150 slide inwardly as shown in FIGS. 44 and 45 (through the use of controllable slides 268) at the same time so that the sides of pouch 110 are moved toward each other to give the pouch enough slack to open. Air blast 156 is timed to coincide with the retraction of arm 152 so that pouch 110 almost immediately fills with air and remains open after arm 152 has disengaged from pouch 110 as shown in FIGS. 43 and 44. In the embodiment of the invention where pouch 110 is opened at the pull down position, the bag opening steps are performed while pouch removal arms hold the bottom of pouch as shown in FIG. 45 and while holder 142 optionally holds the rear of pouch.

In the exemplary embodiment, pouch 110 remains held by arms 150 while funnel 158 engages pouch to held hold pouch 110 in position while it is filled as shown in FIGS. 50-53. Arms 150 release pouch 110 after transfer arms 160 engage pouch 110 as shown in FIG. 54. FIGS. 57-64 show exemplary steps of filling and sealing the pouch. These mechanisms and methods are disclosed in U.S. Pat. No. 6,550,226, the disclosures of which are incorporated herein by reference.

Arms 150 may move straight back to the first position of shuttle 116 as shown in FIG. 56 or arms 352 may be provided as shown in FIGS. 72-78 that move out and around second pouch 112 after arms 352 have delivered first pouch 110 to filling station 118. Arms 352 may pivot with respect to shuttle 116 so that they may be moved around pouch 112. Drives 354 control the pivoting movement. The method shown in FIGS. 72-78 increases the throughput of apparatus 100 by allowing pouch 112 to be pulled down while pouch 110 is being delivered to filling station 118.

FIGS. 65-67 depict an alternative configuration for pouch magazine 102 wherein a second stack of pouches 104 is carried above and spaced from the first stack of pouches 104. When the first stack 104 is exhausted, magazine 102 pivots its retaining fingers 170 from the holding position of FIG. 66 to a release position of FIG. 67 to allow the upper stack 104 to drop into the bottom of magazine 102 where the pouches are removed by the pouch separator. Drives 172 such as pneumatic cylinders are adapted to pivot fingers 170 back and forth between the two positions. The configuration of magazine in FIGS. 65-67 allow the user to load twice as many pouches into apparatus 100 to allow the operator more time to monitor the aspects of apparatus.

In the foregoing description, certain terms have been used for brevity, clearness, and understanding. No unnecessary limitations are to be implied,therefrom beyond the requirement of the prior art because such terms are used for descriptive purposes and are intended to be broadly construed.

Moreover, the description and illustration of the invention is an example and the invention is not limited to the exact details shown or described. The different elements of apparatus may be used singularly in combination with other apparatus configurations in combination with one another to define apparatus and methods.

The invention claimed is:

1. A method for removing a first couch from a plurality of adjacent pouches; the plurality of adjacent pouches including a second pouch disposed immediately adjacent to the first pouch; each of the pouches having edges; the method comprising the steps of:

bending an edge of the first pouch away from the second pouch to define a bent edge and a bend in the first pouch;

pulling the first pouch away from the second pouch by the bent edge of the first pouch to remove the first pouch from the plurality of adjacent pouches; and pulling the first pouch over a vacuum plate that holds the first pouch in a non-collapsed condition.

2. The method of claim 1, further comprising the step of engaging opposite portions of the pouch with shuttle arms and moving the first pouch to a loading position.

3. The method of claim 2, further comprising the step of pulling the second pouch over the vacuum plate while the first pouch is in the loading position.

4. The method of claim 2, further comprising the step of opening the first pouch before the first pouch reaches the loading position.

5. The method of claim 1, further comprising the step of vibrating the plurality of adjacent pouches before the first pouch is removed from the plurality of adjacent pouches.

6. The method of claim 1, wherein the second pouch is disposed in a reference plane and further comprising the steps of bending the edge about an axis disposed in a direction parallel to the reference plane; and pulling the first pouch in a direction non-parallel to the reference plane.

7. The method of claim 6, wherein the step of bending an edge includes the step of bending the edge more than 30 degrees from the reference plane.

8. The method of claim 7, further comprising the step of engaging the edge of the first pouch with a suction device and bending the edge by pivoting the suction device.

9. The method of claim 8, further comprising the step of moving the edge of the first pouch over a static stop during the step of bending the edge of the first pouch away from the second pouch.

10. A method for removing a first pouch from a plurality of adjacent pouches; the plurality of adjacent pouches including a second pouch disposed immediately adjacent the first pouch; each of the pouches having a body and edges; the second pouch having first and second edges with the pouch body disposed in a reference plane; the method comprising the steps of:

pivoting a first portion of the body of the first pouch about an axis disposed intermediate the first and second edges of the second pouch;

separating the remaining body portion of the first pouch from the second pouch by moving the first portion of the body of the first pouch in a direction non-parallel to the reference plane of the second pouch to pull the remaining body portion of the first pouch across a portion of the second pouch to the pivot axis where the first pouch is separated from the second; and pulling the first pouch over a pouch holder having a vacuum that holds the pouch in an non-collapsed position.

11. The method of claim 10, further comprising the step of engaging the first body portion of the first pouch with a suction device and pivoting the first body portion by pivoting the suction device.

12. The method of claim 11, further comprising the steps of moving an edge of the first pouch over a static stop during the pivoting step and catching an edge of the second pouch on the static stop.

13. A method for removing a first pouch from a plurality of adjacent pouches; the plurality of adjacent pouches including a second pouch disposed immediately adjacent and in contact with the first pouch; each of the pouches having edges; the method comprising the steps of:

bending an edge of the first pouch away from the second pouch to define a bent edge;

moving the edge of the first pouch over a static stop during the step of bending the edge of the first pouch away from the second pouch and catching an edge of the second pouch on the static stop;

pulling the first pouch away from the second pouch by the bent edge of the first pouch to remove the first pouch from the plurality of adjacent pouches; and applying a vacuum to the first pouch to support the first pouch in an uncollapsed configuration while the first pouch is being removed from the second pouch.

14. The method of claim 13, further comprising the step of supporting the first pouch in an uncollapsed configuration after the first pouch is removed from the second pouch.

15. The method of claim 14, further comprising the steps of filling and sealing the first pouch.

* * * * *